US010260240B1

(12) United States Patent
Bilge

(10) Patent No.: US 10,260,240 B1
(45) Date of Patent: Apr. 16, 2019

(54) SYSTEM FOR MOUNTING WALL PANELS TO A WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 15/655,278

(22) Filed: Jul. 20, 2017

Related U.S. Application Data

(63) Continuation-in-part of application No. 15/488,897, filed on Apr. 17, 2017.

(51) Int. Cl.
*E04F 13/08* (2006.01)
*E04B 9/18* (2006.01)
*E04F 13/12* (2006.01)

(52) U.S. Cl.
CPC ..... *E04F 13/0803* (2013.01); *E04B 9/18* (2013.01); *E04F 13/0801* (2013.01); *E04F 13/12* (2013.01)

(58) Field of Classification Search
CPC ..... E04F 13/0892; E04F 13/0894; E04F 13/0801; E04F 13/12; E04F 13/0803; E04B 9/18
USPC ..... 52/506.01, 506.06, 235, 775
See application file for complete search history.

(56) References Cited

U.S. PATENT DOCUMENTS 2,591,361 A * 4/1952 Knott ..... E04F 13/0814 52/489.1
3,235,915 A * 2/1966 Glaser ..... E04B 2/827 52/64
4,625,481 A * 12/1986 Crandell ..... E04F 13/0889 52/235
4,672,784 A * 6/1987 Pohlar ..... E04B 2/96 52/209
4,768,321 A * 9/1988 Crandell ..... E04F 13/0808 52/235
4,782,635 A * 11/1988 Hegle ..... E04B 2/94 52/126.4
4,936,065 A * 6/1990 Hutchinson ..... E04B 2/96 52/235
4,977,717 A * 12/1990 Niwata ..... E04B 2/967 52/204.593
5,644,878 A * 7/1997 Wehrmann ..... E04B 2/7457 52/235
5,720,571 A * 2/1998 Frobosilo ..... E04B 2/96 403/2
5,829,216 A * 11/1998 Newcomb ..... E04F 13/0807 52/395

(Continued)

*Primary Examiner* — Brent W Herring
(74) *Attorney, Agent, or Firm* — Richard M. Goldberg

(57) ABSTRACT

A system for mounting wall panels to an existing wall, includes adjustment support members to be secured either directly or indirectly to an existing wall; connecting panels for connecting together spaced apart adjustment support members, with each connecting panel adapted to support a wall panel thereon; each adjustment support member including a central platform wall, and two U-shaped tracks extending along opposite side edges thereof, each U-shaped track including an upper exposed surface arranged parallel to the existing wall when the adjustment support member is secured to the existing wall and first and second end walls extending at orthogonally from opposite sides of the upper exposed surface so as to define a channel therebetween; and each connecting panel including a main panel wall and two opposite slide walls extending from opposite side edges of the main panel wall to be positioned in the channel for sliding movement therein.

27 Claims, 70 Drawing Sheets

(56) References Cited

U.S. PATENT DOCUMENTS 5,846,018 A * 12/1998 Frobosilo ..... E04B 2/96 403/403
5,906,080 A * 5/1999 diGirolamo ..... E04B 2/7453 411/546
6,098,364 A * 8/2000 Liu ..... E04F 13/0855 52/235
6,213,679 B1 * 4/2001 Frobosilo ..... E04B 2/82 403/14
6,226,947 B1 * 5/2001 Bado ..... E04F 13/0805 52/483.1
6,260,321 B1 * 7/2001 Rudduck ..... E04B 2/7455 52/281
6,688,069 B2 * 2/2004 Zadeh ..... E04B 1/2403 52/712
7,043,884 B2 * 5/2006 Moreno ..... E04F 13/0808 52/235
7,168,213 B2 * 1/2007 Rudduck ..... A47B 91/02 52/235
7,174,690 B2 * 2/2007 Zadeh ..... E04B 1/2403 52/712
7,503,150 B1 * 3/2009 diGirolamo ..... E04B 2/96 403/403
7,562,509 B2 * 7/2009 Ness ..... E04F 13/081 52/235
7,926,230 B2 * 4/2011 Yoshida ..... E04F 13/0808 52/235
7,966,783 B2 * 6/2011 Wilson ..... E04F 13/18 52/235
8,033,066 B2 * 10/2011 Griffiths ..... E04F 13/081 52/235
8,127,507 B1 * 3/2012 Bilge ..... E04F 13/0823 52/235
8,240,099 B2 * 8/2012 Hummel, III ..... E04F 13/0892 52/235
8,347,569 B1 * 1/2013 McIntyre ..... E04F 13/0814 52/235
8,365,484 B2 * 2/2013 Foley ..... E04B 1/4114 403/403
8,453,388 B2 * 6/2013 Neuhofer, Jr. ..... A47B 96/067 211/94.01
8,468,765 B1 * 6/2013 Kim ..... E04F 13/0835 52/235
8,555,577 B2 * 10/2013 Maday ..... E04B 2/00 52/235
8,745,935 B2 * 6/2014 DuPont ..... H02S 20/00 52/173.3
9,010,056 B2 * 4/2015 Ben David ..... E04C 2/543 52/466
9,068,358 B2 * 6/2015 MacDonald ..... E04F 13/0805
9,091,078 B2 * 7/2015 Desch nes ..... E04F 13/0803
9,091,079 B2 * 7/2015 Wright ..... E04F 13/0816
9,540,804 B1 * 1/2017 Farahmandpour .. E04F 13/0801
9,783,993 B2 * 10/2017 Gleeson ..... E04B 1/40
10,011,997 B1 * 7/2018 Bilge ..... E04F 13/26
2002/0023405 A1 * 2/2002 Zadeh ..... E04B 1/2403 52/714
2002/0083655 A1 * 7/2002 Paul ..... E04B 9/122 52/105
2002/0083656 A1 * 7/2002 Paul ..... E04B 9/122 52/105
2003/0150179 A1 * 8/2003 Moreno ..... E04F 13/0808 52/235
2004/0118075 A1 * 6/2004 Zadeh ..... E04B 1/2403 52/715
2004/0194417 A1 * 10/2004 Paul ..... E04B 9/067 52/716.8
2005/0223581 A1 * 10/2005 Hale ..... G01B 3/004 33/758
2006/0016137 A1 * 1/2006 Ferro ..... E04B 2/965 52/235
2008/0010927 A1 * 1/2008 Wilson ..... E04F 13/0803 52/387
2008/0134594 A1 * 6/2008 Ness ..... E04F 13/081 52/200
2009/0241451 A1 * 10/2009 Griffiths ..... E04F 13/081 52/309.4
2009/0282751 A1 * 11/2009 Orfield ..... B29C 47/0066 52/105
2012/0017530 A1 * 1/2012 Hummel, III ..... E04F 13/081 52/506.05
2012/0096799 A1 * 4/2012 Wright ..... E04F 13/0816 52/578
2012/0186170 A1 * 7/2012 MacDonald ..... E04F 13/0805 52/235
2013/0091786 A1 * 4/2013 DuPont ..... H02S 20/00 52/173.3
2013/0111840 A1 * 5/2013 Bordener ..... E04B 1/68 52/393
2014/0112698 A1 * 4/2014 Ben David ..... E04C 2/543 403/28
2014/0123585 A1 * 5/2014 Desch nes ..... E04F 13/0803 52/506.05
2014/0290166 A1 * 10/2014 Bordener ..... E04F 13/0803 52/474
2015/0308098 A1 * 10/2015 Tessadori ..... E04F 13/0807 52/698
2015/0345152 A1 * 12/2015 Libreiro ..... E04F 13/0848 52/506.05
2016/0153189 A1 * 6/2016 Wright ..... E04B 1/98 52/167.1
2016/0244967 A1 * 8/2016 Zhou ..... E04F 13/0801
2016/0369496 A1 * 12/2016 Farahmandpour .. E04F 13/0801
2017/0130464 A1 * 5/2017 Gleeson ..... E04B 1/40

* cited by examiner

SYSTEM FOR MOUNTING WALL PANELS TO A WALL

REFERENCE TO RELATED APPLICATION

The present application is a Continuation-in-Part of U.S. patent application Ser. No. 15/488,897 filed Apr. 17, 2017 to the same inventor herein, and entitled SYSTEM FOR MOUNTING WALL PANELS TO A WALL, the entire disclosure of which is incorporated herein by reference.

BACKGROUND OF THE INVENTION

The present invention relates generally to a wall system, and more particularly, to a system for easily mounting wall panels over an existing wall.

In order to enhance the look of a wall structure, it is known to secure wall panels to the wall structure. However, the securement of wall panels to the wall structure is generally a long and tedious job since it entails using fastening devices such as nails and/or screws to secure the walls panels directly to the wall structure.

When securing the wall panels to an existing wall, precise measurements must be taken and the wall panels must be precisely positioned over the existing wall. This is time consuming and tedious. Further, if a mistake is made as to the positioning of one wall panel, this will affect the positioning of the remaining wall panels, and may result in removing the misaligned wall panels and re-securing these wall panels correctly in position. In addition, no consideration is taken for any unevenness in the existing wall.

It would therefore be desirable to provide wall panels that can be positioned and adjusted on the existing wall during assembly.

SUMMARY OF THE INVENTION

Accordingly, it is an object of the present invention to provide a system and method for easily mounting wall panels over an existing wall that overcomes the aforementioned problems.

It is another object of the present invention to provide a system and method for easily mounting wall panels over an existing wall, while permitting adjustment of the position of the wall panels in three dimensions.

It is still another object of the present invention to provide a system and method for mounting wall panels over an existing wall with exact precision.

It is yet another object of the present invention to provide a system and method for easily mounting wall panels over an existing wall which easily captures and restrains ends of the wall panels.

It is a further object of the present invention to provide a system and method for easily mounting wall panels over an existing wall which allows for thermal expansion of the wall panels.

In accordance with an aspect of the present invention, a system for mounting wall panels to an existing wall, includes at least one adjustment support member adapted to be secured either directly to an existing wall or indirectly to the existing wall through intermediary members; at least one connecting panel for connecting together spaced apart adjustment support members, with the at least one connecting panel adapted to support wall panels thereon. Each adjustment support member includes at least one U-shaped track extending along at least one side edge thereof, with each U-shaped track including an upper exposed surface arranged parallel to the existing wall when a respective adjustment support member is secured to the existing wall and first and second end walls extending at an angle from opposite sides of the upper exposed surface so as to define a channel therebetween. Each connecting panel includes a main panel wall and at least one slide wall extending from a side edge of the main panel wall and adapted to be positioned in the channel for sliding movement therein.

Each slide wall is positioned in a channel for sliding movement in two orthogonal directions therein. Further, each slide wall includes at least one opening for insertion of a fastening member therethrough into the upper exposed surface to secure the connecting panel thereof to a respective adjustment support member. Each opening is elongated to permit adjustment of each slide wall in a respective channel.

Further, each adjustment support member includes measuring markings adjacent side edges thereof, and each main panel wall includes measuring markings adjacent side edges thereof for alignment with the measuring markings of each adjustment support member.

Preferably, each adjustment support member includes a central plate and two U-shaped tracks, each extending from an opposite side edge of the central plate. Specifically, an upper end of the first end wall of each U-shaped track is connected to a respective side edge of the central plate, such that each upper exposed surface is positioned in parallel offset relation to the central plate. Each second end wall includes an inturned lip extending therealong.

Each adjustment support member further includes an adjustment plate having an upper edge connected centrally to a lower surface of the central plate, for securement to an intermediary member.

Preferably, each connecting panel includes at least one slot therein, and there is at least one hook member slidably mounted in the at least one slot and adapted to hang a respective wall panel thereon. Each hook member includes a securing base adapted to be slidably held in a respective slot, and a hook connected with the base; and each wall panel includes a bracket for engaging with the hook to support the wall panel in a hanging manner thereon.

Positioning of each slide wall on the upper exposed surface of a respective U-shaped track is in a flush face to face arrangement.

In another embodiment, each wall panel includes at least one hook member on a rear surface thereof for hooking over at least one connecting panel to hang the wall panel thereon. Each hook member includes a securing arrangement for securing each wall panel to the at least one connecting panel at a desired position. Specifically, each hook member defines a channel therein for receiving a respective connecting panel, and the securement arrangement includes a member for wedge locking the connecting panel in the channel.

Further, each hook member includes an adjustment arrangement for engaging an edge of the connecting panel to adjust a position of the connecting panel in the channel prior to wedge locking the connecting panel in the channel. Preferably, the wedge locking arrangement includes at least one screw positioned between a surface of the connecting panel and the hook member, and the adjustment arrangement includes at least one biasing screw for engaging the edge of the connecting panel to adjust a position of the connecting panel in the channel.

In accordance with another aspect of the present invention, a system for mounting wall panels to an existing wall, includes at least one adjustment support member adapted to be secured either directly to an existing wall or indirectly to the existing wall through intermediary members; at least one connecting panel for connecting together spaced apart adjustment support members. Each connecting panel includes at least one slot therein, and each wall panel includes at least one slot therein for alignment with the at least one slot of each connecting panel when the connecting panel and wall panel are positioned adjacent each other. At least one locking bar is provided for engaging within the at least one slot in both the connecting panel and the wall panel to support the wall panel on the connecting panel.

Specifically, each locking bar has a first section for securement within one slot of the wall panel, and a second section for securement within one slot of the connecting panel. The width of each locking bar at a connecting area between the first end and second sections thereof is of a lesser dimension than at portions of the first end and second sections spaced from the connecting area. As such, each of the first and second sections preferably have a cross-sectional shape selected from one of the following shapes: dovetail shaped, circular shaped, T-shaped, and triangular shaped.

In one modification, at least one of the first and second sections has a recess for receiving a fastening member therethrough.

In one modification, each locking bar is made of a thermally insulating material, and includes a spacer section to separate the wall panel from the connecting panel by a gap.

In accordance with still another aspect of the present invention, a system for mounting wall panels to an existing wall, includes at least one adjustment support member adapted to be secured either directly to an existing wall or indirectly to the existing wall through intermediary members; and at least one connecting panel for connecting together spaced apart adjustment support members. Each connecting panel includes at least one slot therein; and at least one securing member is slidably mounted in the at least one slot to support a wall panel on the connecting panel. Each securing member includes a securing base adapted to be slidably held in a respective slot, an extension wall extending from the base, and a rod extending through the extension wall for engagement within an opening in a wall panel.

In accordance with still another aspect of the present invention, a system for mounting wall panels to an existing wall, includes at least one adjustment support member adapted to be secured either directly to an existing wall or indirectly to the existing wall through intermediary members; and at least one connecting panel for connecting together spaced apart adjustment support members. Each connecting panel includes at least one slot therein; and at least one securing member is slidably mounted in the at least one slot to support a wall panel on the connecting panel. Each securing member includes a securing base adapted to be slidably held in a respective slot, a housing extending outwardly from the securing base, a slide member slidably received in the housing, a securing arrangement for locking the slide member at a desired location within the housing, and at least one tab extending from the slide member for insertion within a respective opening in a wall panel to secure the wall panel to the securing member.

In one modification, the slide member includes a plurality of spaced apart recesses for receiving the securing arrangement.

Preferably, the securing base has a cross-sectional shape selected from one of the following shapes dovetail shaped, circular shaped, T-shaped, and triangular shaped.

The above and other features of the invention will become readily apparent from the following detailed description thereof which is to be read in connection with the accompanying drawings.

DETAILED DESCRIPTION

Figure 1:
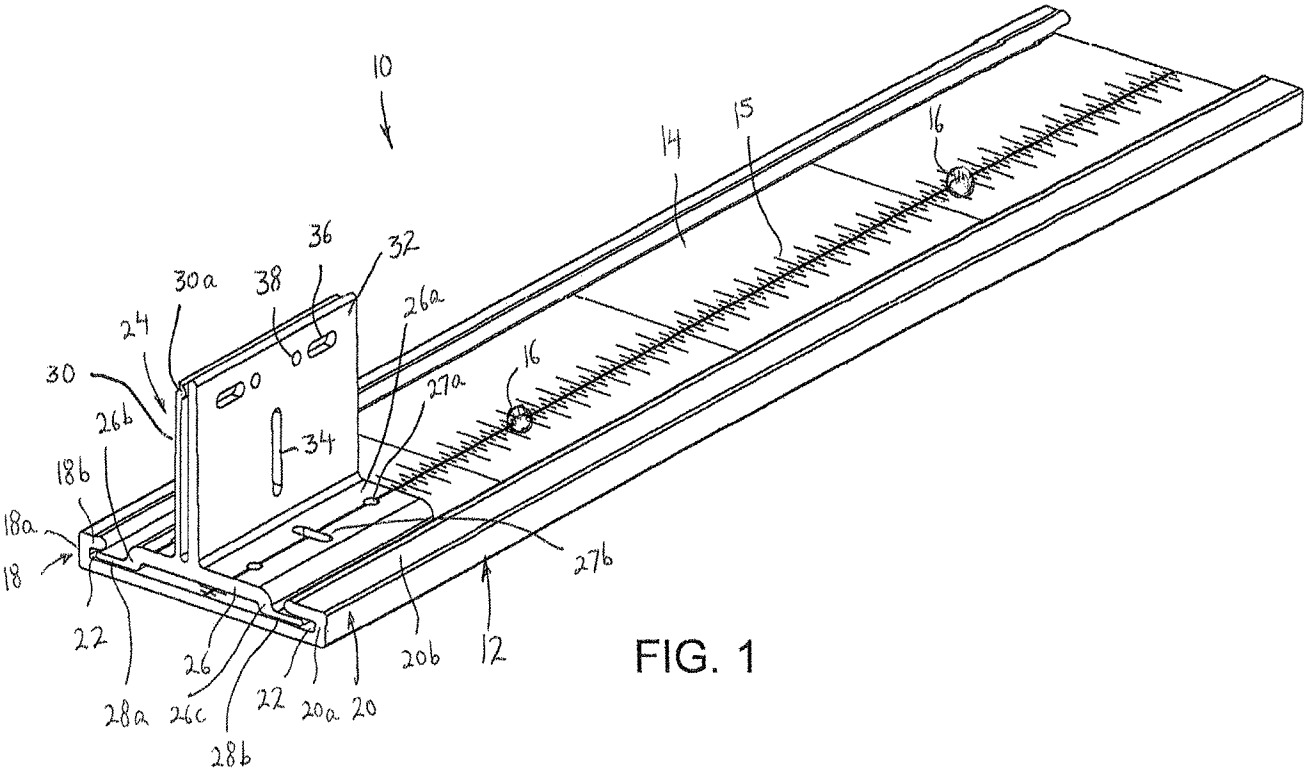
FIG. 1 is a perspective view of the base support and sliding support member of a system for easily mounting wall panels over an existing wall.

Referring to the drawings in detail, and initially to FIG. 1 thereof, there is shown a portion of a system 10 for easily mounting wall panels over an existing wall.

System 10 includes a base assembly including an elongated base support 12 that is adapted to be secured to an existing wall (not shown). Base support 12 includes an elongated base plate 14 having measuring gradations 15 along the upper surface thereof and openings 16 therealong through which screws (not shown) are adapted to extend to secure base plate 14 to the existing wall. L-shaped retaining walls 18 and 20 extend outwardly from opposite side edges of base plate 14. Specifically, each L-shaped retaining wall 18, 20 includes a first wall 18*a*, 20*a* that extends at a right angle from a side edge of base plate 14 and an inwardly extending second wall 18*b*, 20*b* that extends toward the opposite side edge of base plate 14 in parallel spaced apart relation to base plate 14 with a space 22 therebetween. Preferably, inwardly extending second wall 20*b* has a greater width than inwardly extending second wall 18*b*, as show best in FIG. 1C, although the present invention is not limited thereto.

An adjustment arrangement for adjustably securing the wall panels to base support 12 at a position with at least two degrees of freedom, includes a sliding support member 24 slidably retained within base support 12. Sliding support member 24 includes a central member formed by an inverted U-shaped plate 26 that fits in the space between the spaced-apart free edges of second walls 18*b*, 20*b*. Inverted U-shaped plate 26 thereby includes an upper plate 26*a* and two downwardly extending leg plate 26*b*, 26*c* at opposite ends thereof that position upper plate 26*a* in parallel, spaced apart relation from the upper surface of base plate 14. A plurality of threaded openings 27*a* and at least one slot 27*b* extend through upper plate 26*a*.

Wing plates 28*a*, 28*b* extend outwardly from opposite free ends of leg plates 26*b*, 26*c* at the side edges of inverted U-shaped plate 26, with wing plates 28*a*, 28*b* slidably retained in spaces 22. It will be appreciated that the distance between the free end edges of wing plates 28*a*, 28*b* is less than the distance between first walls 18*a*, 20*a* of L-shaped retaining walls 18, 20 so as to permit lengthwise sliding adjustment of sliding support member 24 along a first lengthwise direction of base support 12, while also permitting transverse, side to side sliding adjustment of sliding support member 24 within base support 12 along a second transverse direction, thereby providing two degrees of freedom.

In this manner, adjustment bolts 25 (FIG. 1A) are adapted to be threadedly received within threaded openings 27*a* to engage the upper surface of base plate 14 in order to adjust the height of sliding support member 24 relative thereto. In other words, as bolts 25 are rotated, with the free ends of bolts 25 in contact with the upper surface of base plate 14, sliding support member 24 moves up or down on bolts 25, depending upon the direction of rotation of bolts 25, to thereby raise or lower sliding support member 24. This also causes the upper surfaces of wing plates 28*a* and 28*b* to tightly engage against the underside of second walls 18*b* and 20*b*, respectively, to lock sliding support member 24 in that position. Thereafter, a screw (not shown) can be inserted through each slot 27*b* into base plate 14 and, if desired, into the existing wall, to further lock sliding support members 24 in position. Thus, sliding support member 24 can be locked to base plate 14 after sliding support member 24 has been moved and adjusted in the first lengthwise direction and second transverse direction. Further, slots 27*b* permit further later transverse adjustment by loosening any screws therein, transversely adjusting sliding support member 24 and re-tightening the screws.

Two parallel, spaced apart capture walls 30, 32 extend upwardly at the center of upper plate 26*a*, preferably along the entire length of upper plate 26*a*. The upper end of capture wall 30 includes an inwardly directed lip 30*a*, as best shown in FIG. 1D. Each capture wall 30, 32 preferably includes at least one slot 34 oriented in a third direction which is orthogonal to the first lengthwise direction and second transverse direction, at least one slot 36 oriented in the first lengthwise direction and at least one circular threaded will opening 38.

Although base support 12 has been shown with L-shaped retaining walls 18 and 20, second walls 18*b* and 20*b* can be eliminated.

Figure 1A:
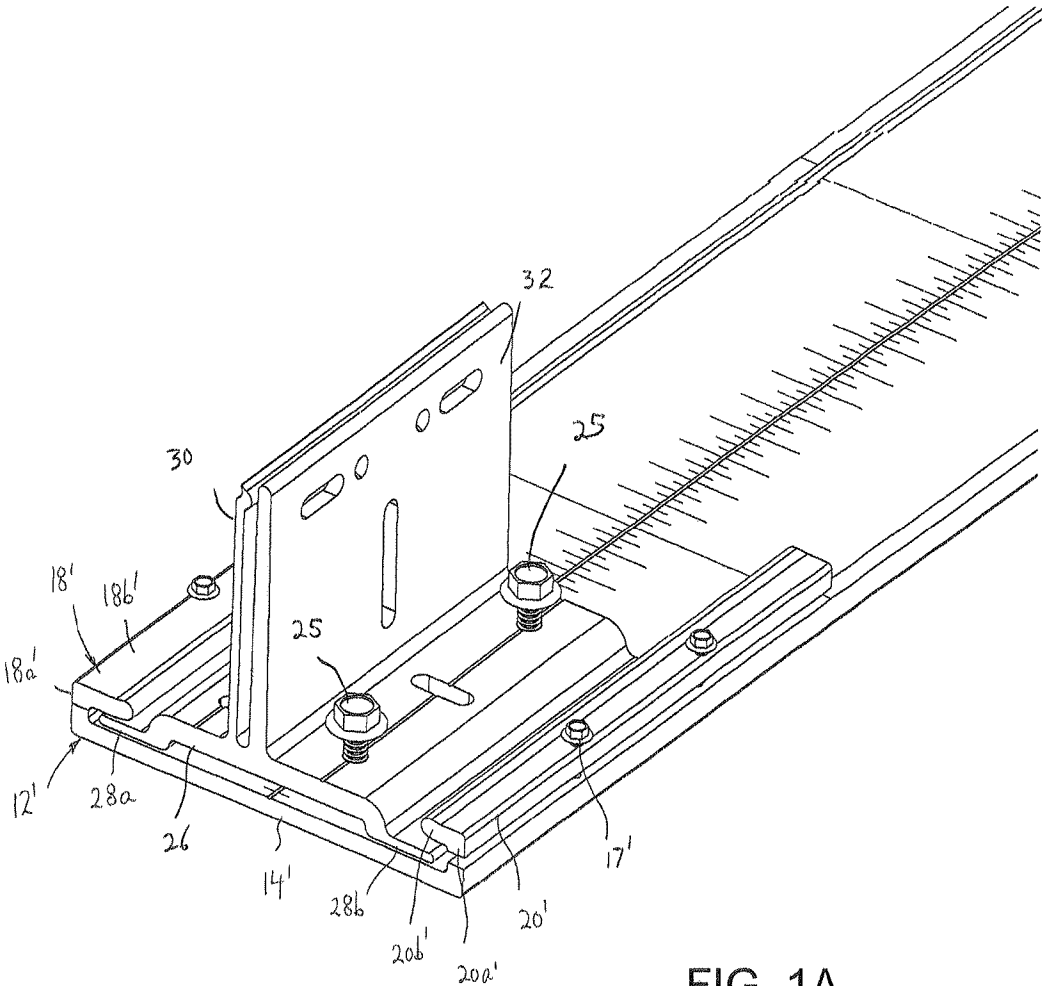
FIG. 1A is a perspective view of a first modified base support with sliding support member.

A first modified base support 12' is shown in FIG. 1A, in which second walls 18*b*', 20*b*' and a portion 18*a*', 20*a*' of the first walls of L-shaped retaining walls 18', 20' are formed separate from base plate 14', and are secured to base plate 14' by screws 17' that provide a small height adjustment of second walls 18*b*', 20*b*' relative to base plate 14' in the aforementioned third direction in order to accommodate different thickness wing plates 28*a*, 28*b* and/or allow for further height adjustment of wing plates 28*a*, 28*b* in a third direction by adjustment bolts 25.

Figure 1B:
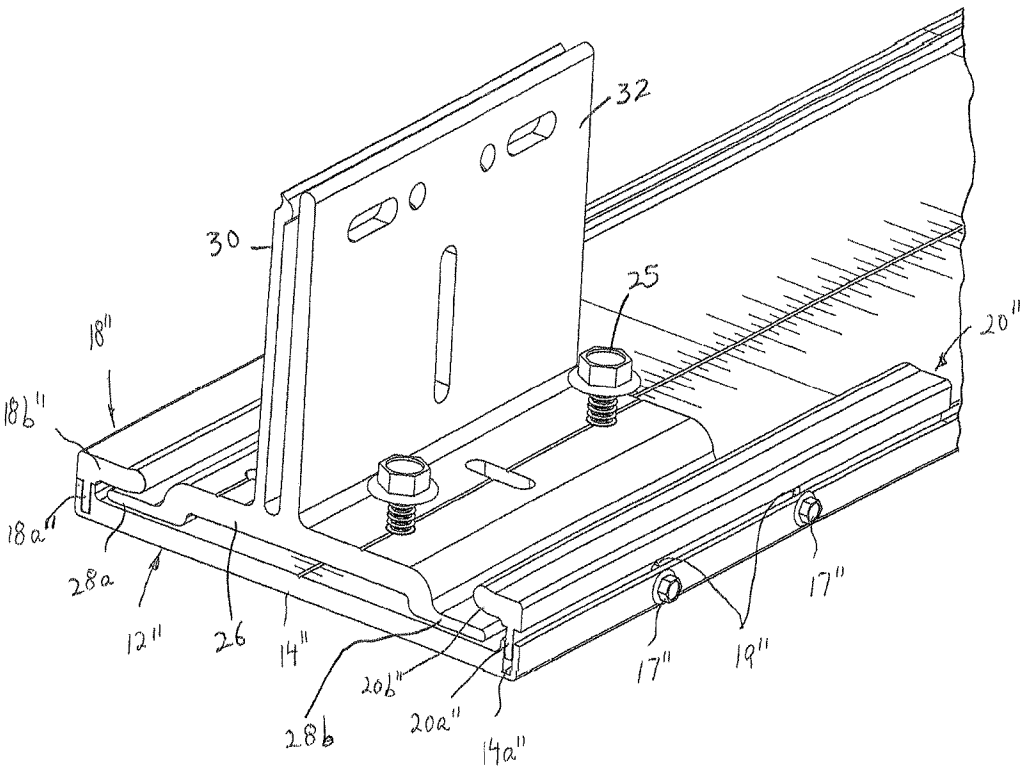
FIG. 1B is a perspective view of a second modified base support with sliding support member.

A second modified base support 12" is shown in FIG. 1B, in which L-shaped retaining walls 18", 20" are formed separate from base plate 14". In this modification, base plate 14" is provided with lengthwise slots 14*a*" along each side edge, and first walls 18*a*", 20*a*" of L-shaped retaining walls 18", 20" fit within slots 14*a*". Each first wall 18*a*", 20*a*" has a plurality of elongated slots 19" extending in the third direction and screws 17" extend through openings in side edges of base plate 14" and extend through elongated slots 19" and are tightened so as to hold L-shaped retaining walls 18", 20" at a small desired adjusted height in the third direction.

Figure 1C:
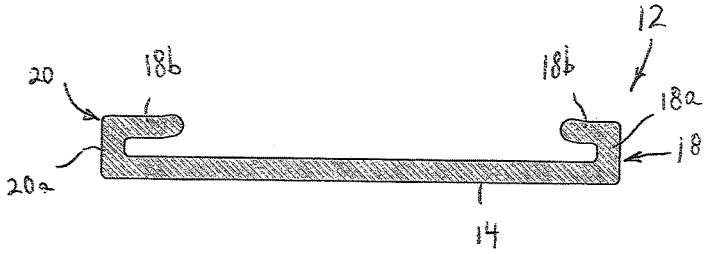
FIG. 1C is a cross-sectional view of the base support of FIG. 1.
Figure 1D:
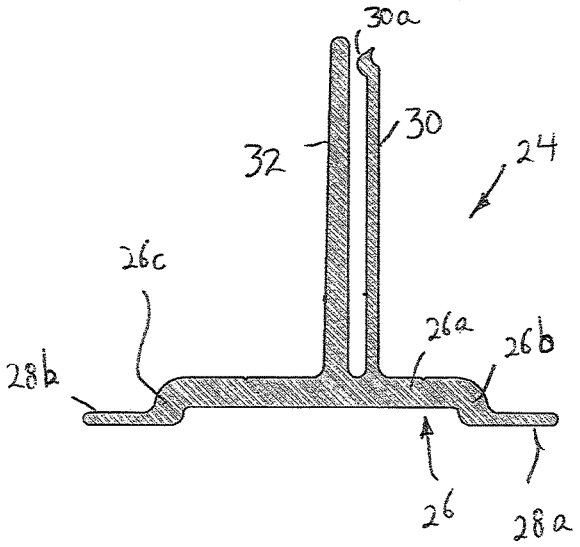
FIG. 1D is a cross-sectional view of the sliding support member of FIG. 1.

As shown best in FIG. 1C, second wall 18*b* is preferably shorter in the second transverse direction than the other second wall 20*b*, and the free ends of each second wall 18*b*, 20*b* are preferably upturned slightly.

Figure 1E:
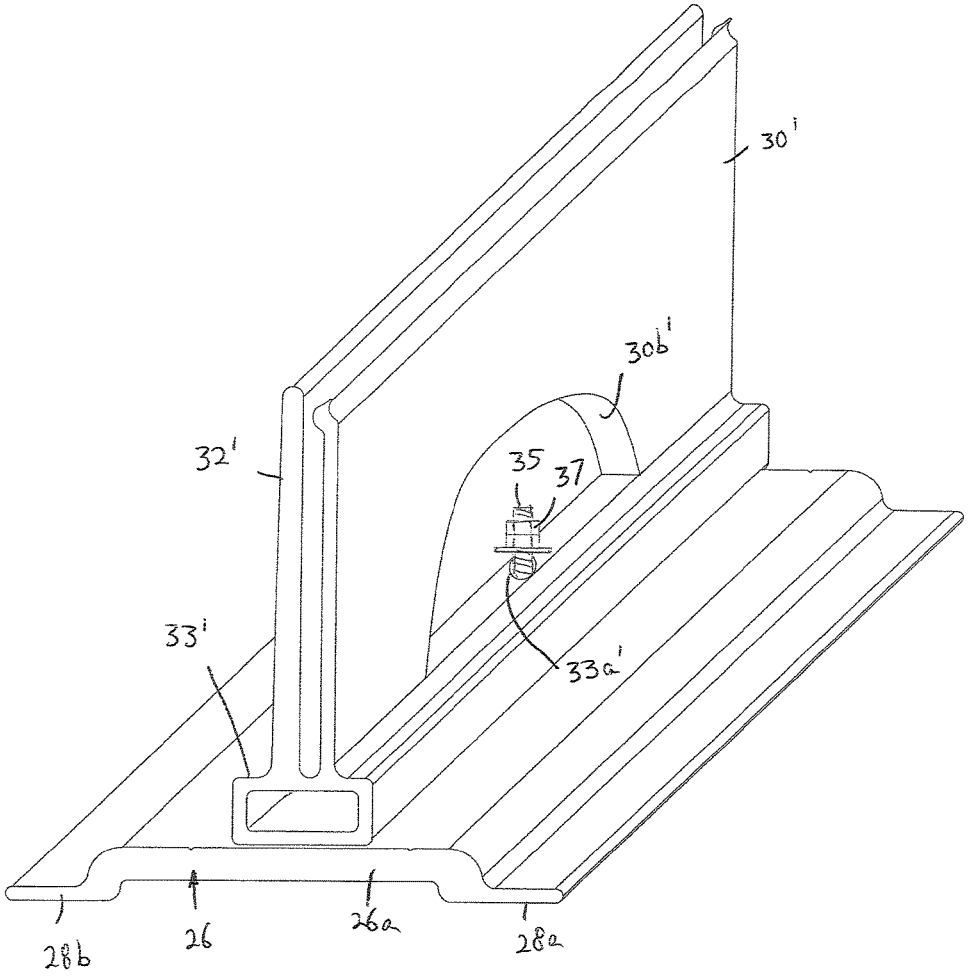
FIG. 1E is a perspective view of a modified sliding support member.
Figure 1F:
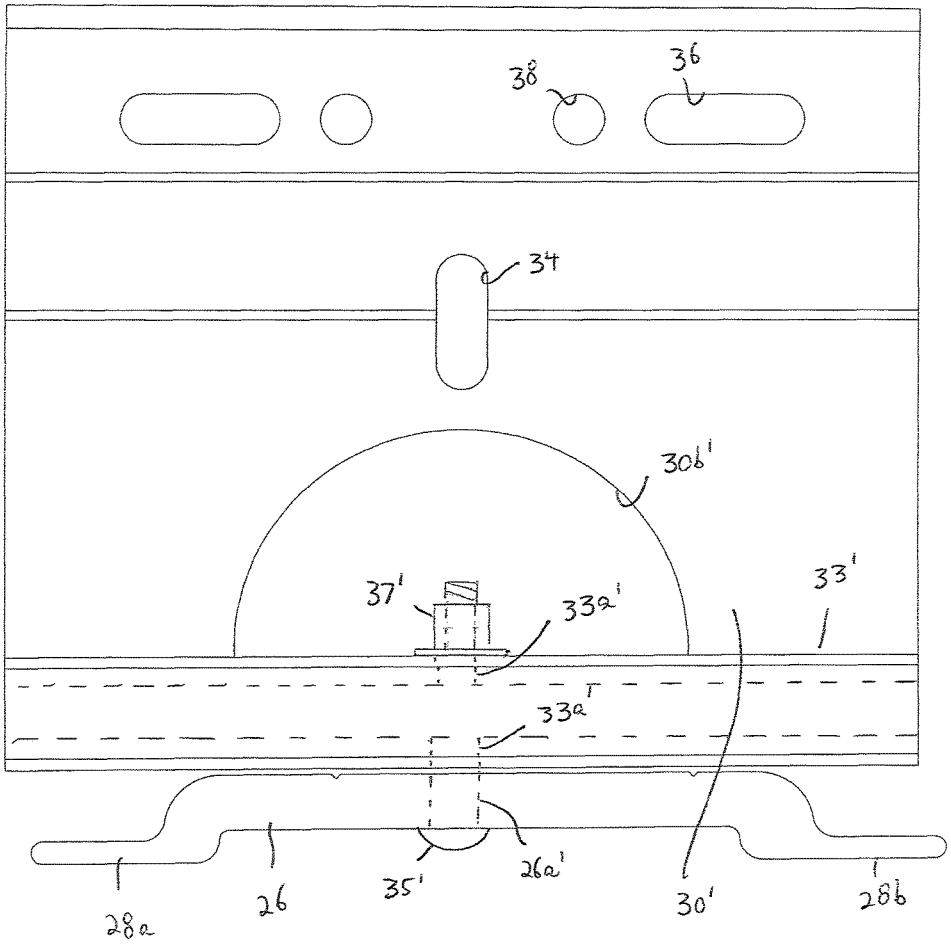
FIG. 1F is a plan view of the modified sliding support member of FIG. 1E.

It will be appreciated that, although sliding support member 24 is shown as a single piece, unitary member, it can be formed from a plurality of parts, for example, as shown in FIGS. 1E and 1F. Specifically, inverted U-shaped plate 26 and wing plates 28*a* and 28*b* are formed as a single, unitary member. Another single, unitary member is formed by capture walls 30' and 32' connected at the lower ends to an elongated hollow rectangular bar 33' that seats in the first lengthwise direction centrally on the upper surface of upper plate 26*a*. Capture wall 30' includes a central arc shaped opening 30*b*', and aligned through openings 33*a*' extend through the upper and lower portions of rectangular bar 33' and which are aligned with an opening 26*a*' through U-shaped plate 26. A bolt 35' extends upwardly through opening 26*a*' and openings 33*a*', and a nut 37' is threateningly connected to bolt 35' so as to secure rectangular bar 33' to U-shaped plate 26. It will be appreciated that this arrangement provides a further degree of adjustment, that is, an angular or rotating adjustment of capture walls 30' and 32' relative to the lengthwise direction of U-shaped plate 26.

Figure 1H:
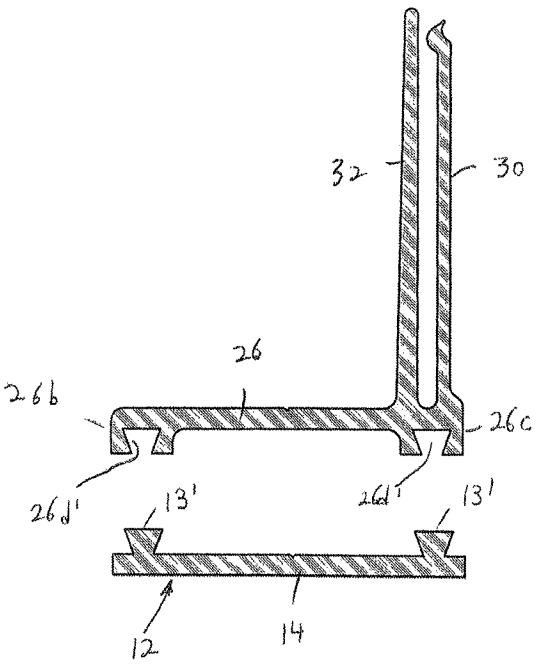
FIG. 1H is a cross-sectional view of a further modified sliding support member.
Figure 1G:
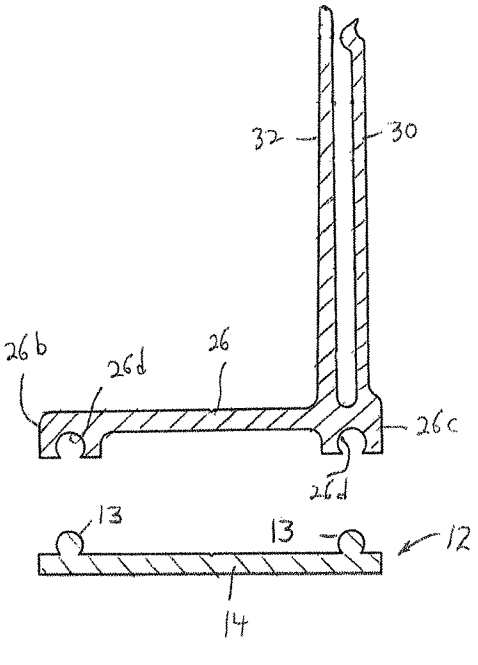
FIG. 1G is a cross-sectional view of a further modified sliding support member.

As another example, as shown in FIG. 1G, wing plates 28*a* and 28*b* are eliminated, and the underside of leg plates 26*b* and 26*c* are provided with elongated part circular openings 26*d*. In such case, L-shaped retaining walls 18 are eliminated from base support 12, with the upper surface of base plate 14 being provided with bulbous projections 13 that are adapted to snap or slide into part circular openings 26*d*. With such arrangement, after projections 13 have been snap or slid fit into openings 26*d*, inverted U-shaped plate 26 can either be permanently fixed, or alternatively, slid, relative to base plate 14. In addition, as shown, retaining walls 30 and 32 are positioned immediately over leg plate 26*c*, rather than being centered on inverted U-shaped plate 26.

FIG. 1H shows a modification in which the part circular openings 26*d* and bulbous projections 13 are replaced with dovetail shaped openings 26*d*' and dovetail shaped projections 13'.

Figure 2:
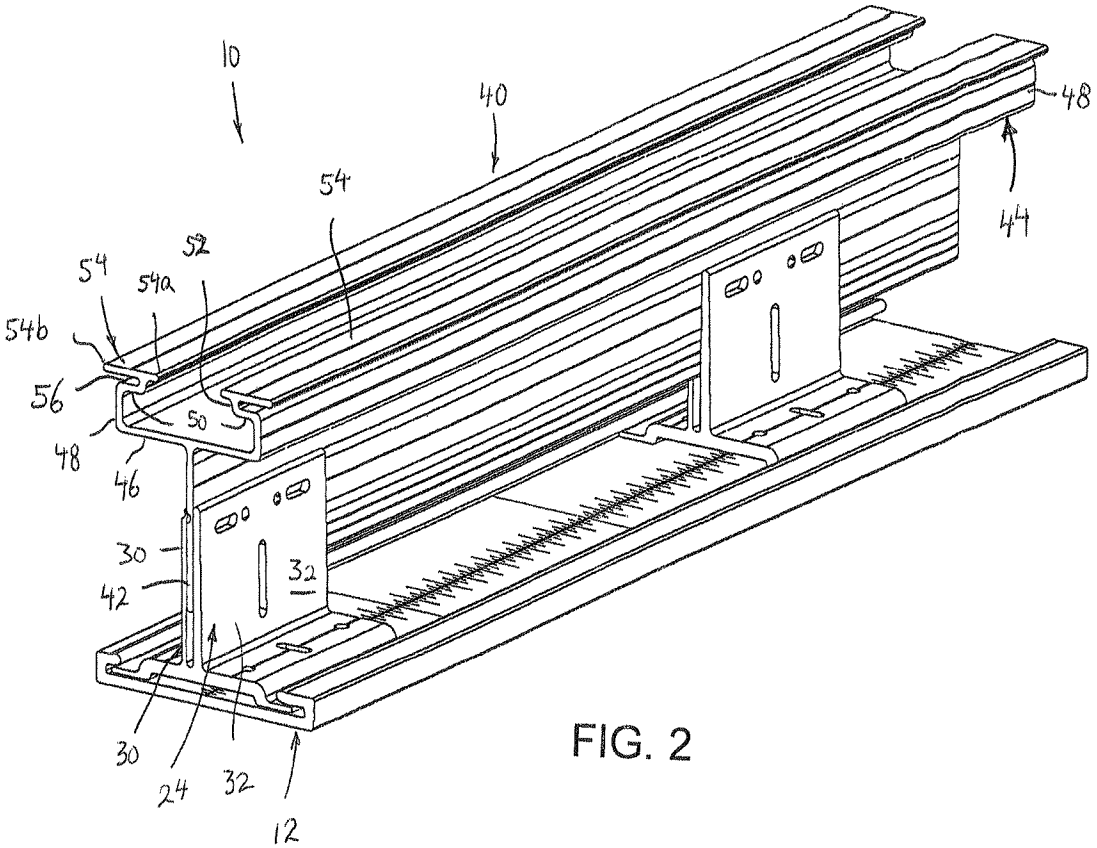
FIG. 2 is a perspective view of an adjustment support member with the assembly of FIG. 1.

As shown in FIG. 2, in order to provide large adjustment in the third direction which is orthogonal to the first lengthwise direction and second transverse direction, an adjustment support member 40 is connected with sliding support member 24 and can be adjusted relative thereto in the third direction which is orthogonal to the first lengthwise direction and second transverse direction.

Specifically, adjustment support member 40 includes an elongated rectangular plate 42 that is dimensioned to fit snugly between capture walls 30 and 32, such that retaining lip 30*a* applies pressure to plate 42. It will be appreciated that plate 42 can be moved in the first lengthwise direction, as well as the third direction which is orthogonal to the first lengthwise direction and second transverse direction, and once positioned at the desired location, is secured in that position by screws extending through at least one of slots 34, 36 and openings 38. Although there are no fixed openings in plate 42, the screws can still pass therethrough. Alternatively, openings can also be provided in plate 42. Further, at any time, the screws can be loosened, plate 42 is then adjusted in position and the screws are retightened. Alternatively, it will be appreciated that slots 34, 36 and openings 38 can be provided in plate 42 instead of, or in addition to, capture walls 30 and 32.

Adjustment support member 40 includes a U-shaped track 44, with an elongated rectangular lower plate 46 and two upstanding, parallel, spaced apart walls 48 extending in the third direction from opposite lengthwise edges of lower plate 46. The opposite free lengthwise edge of rectangular plate 42 is fixed centrally to the lower surface of lower plate 46 in the lengthwise direction thereof, such that when plate 42 is captured between capture walls 30 and 32, lower plate 46 of track 44 is preferably oriented in parallel spaced relation from base plate 14.

U-shaped track 44 further includes inwardly directed walls 50 extending inwardly toward each other from the lengthwise edges of spaced apart walls 48, in parallel, spaced apart relation to lower plate 46. A further elongated stub wall 52 extends in the third direction from the free lengthwise edge of each inwardly directed wall 50. Finally, an elongated retaining wall 54 is connected to the free end of each stub wall 52 and extends in a direction in parallel, spaced apart relation to inwardly directed walls 50. Specifically, each stub wall 52 is connected to each retaining wall 54 at a position slightly spaced from the inner edge thereof such that a first inner portion 54*a* of each retaining wall 54 extends inwardly of the respective stub wall 52 so as to be in parallel, spaced apart relation from lower plate 46, and such that a larger second outer portion 54*b* of each retaining wall 54 extends outwardly of the respective stub wall 52 so as to be in parallel, spaced apart relation from the respective inwardly directed wall 50 with an elongated gap 56 therebetween.

Although not shown in FIG. 2, lower plate 46 of adjustment support member 40 preferably includes measuring gradations thereon similar to the measuring gradations 15. In this regard, reference is made to measuring gradations 715 in FIG. 37. Further, although not shown in FIG. 2, each retaining wall 54 preferably also includes measuring gradations thereon similar to the measuring gradations 15. In this regard, reference is made to measuring gradations 719 in FIG. 37.

Preferably, base support 12, sliding support member 24 and adjustment support member 40 are made of a thermally isolated material such as polyamide, an equivalent thereof or any other suitable material.

With the above arrangement, it will be appreciated that adjustment of the position of the wall panels on an existing wall can occur in the first lengthwise, second transverse and third orthogonal directions by adjustment of sliding support members 24 in base support 12, and in the third orthogonal direction as well as the first lengthwise direction by adjustment of plates 42 in sliding support member 24.

Figure 3:
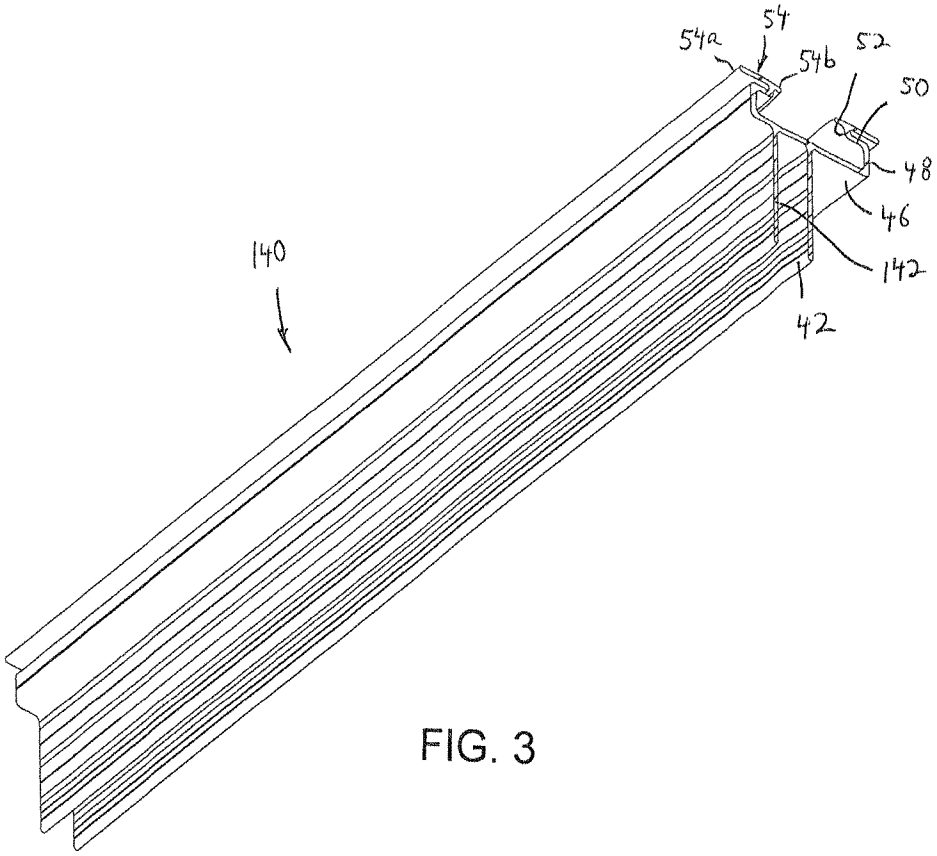
FIG. 3 is a perspective view of a modified adjustment support member.

Referring now to FIG. 3, there is shown a modified adjustment support member 140 which is identical to adjustment support member 40, and the same numerals are provided, except for any differences. Modified adjustment support member 140 provides a second elongated rectangular plate 142 that extends from the underside of lower plate 46 in parallel, spaced apart relation from elongated rectangular plate 42. In this manner, while elongated rectangular plate 42 is positioned between retaining walls 30 and 32, second elongated rectangular plate 142 is positioned to the outside of one of retaining walls 30 and 32, to provide additional securement and stability.

Figure 4:
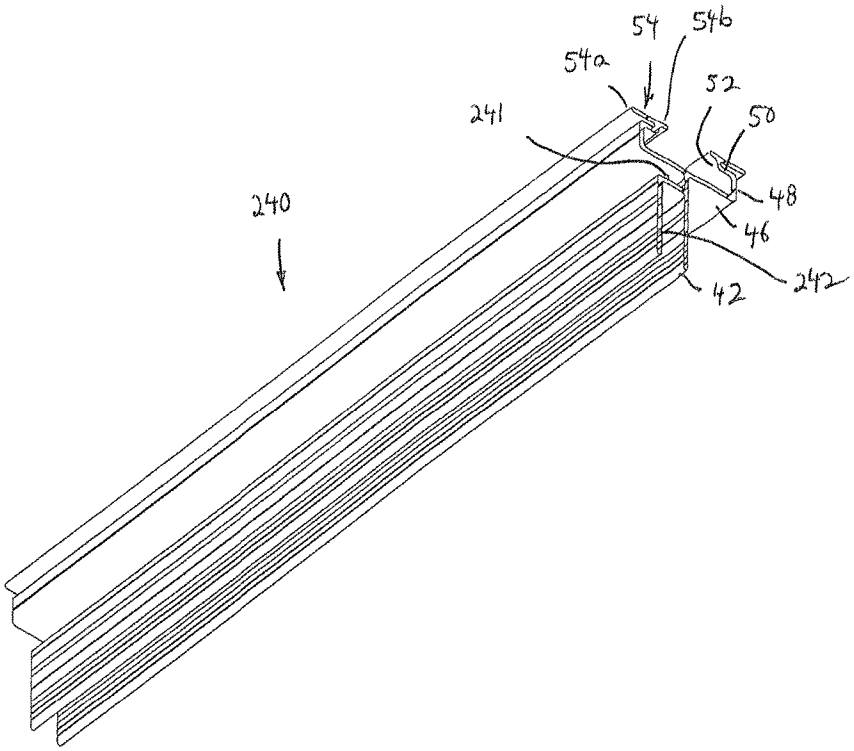
FIG. 4 is a perspective view of another modified adjustment support member.

FIG. 4 shows another modified adjustment support member 240 which is identical to adjustment support member 40, and the same numerals are provided, except for any differences. Modified adjustment support member 240 provides an L-shaped wall connected to elongated rectangular plate 42 at a position spaced slightly below the underside of lower plate 46, and thereby includes a transverse connecting wall 241 and a second elongated rectangular plate 242 that extend from the free end of transverse connecting wall 241 in parallel, spaced apart relation from elongated rectangular plate 42. This arrangement provides additional height adjustability of adjustment support member 40.

One manner of connecting wall panels over an existing wall with the above arrangement, will now be discussed.

Figure 5:
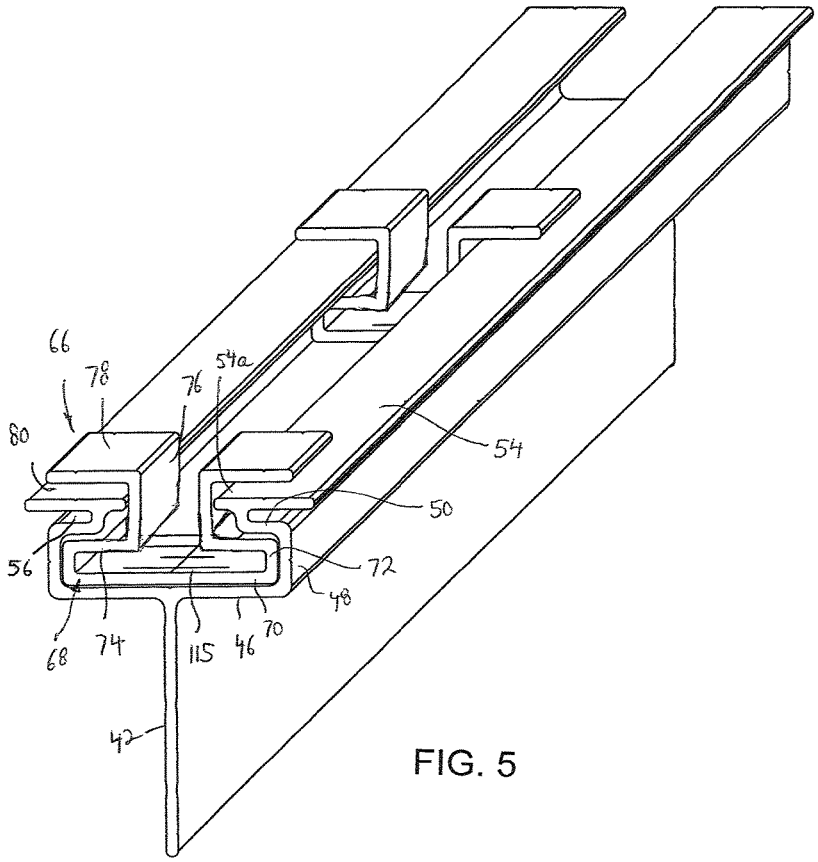
FIG. 5 is a perspective view of the adjustment support member of FIG. 2, assembled with wall panel sliding supports.
Figure 6:
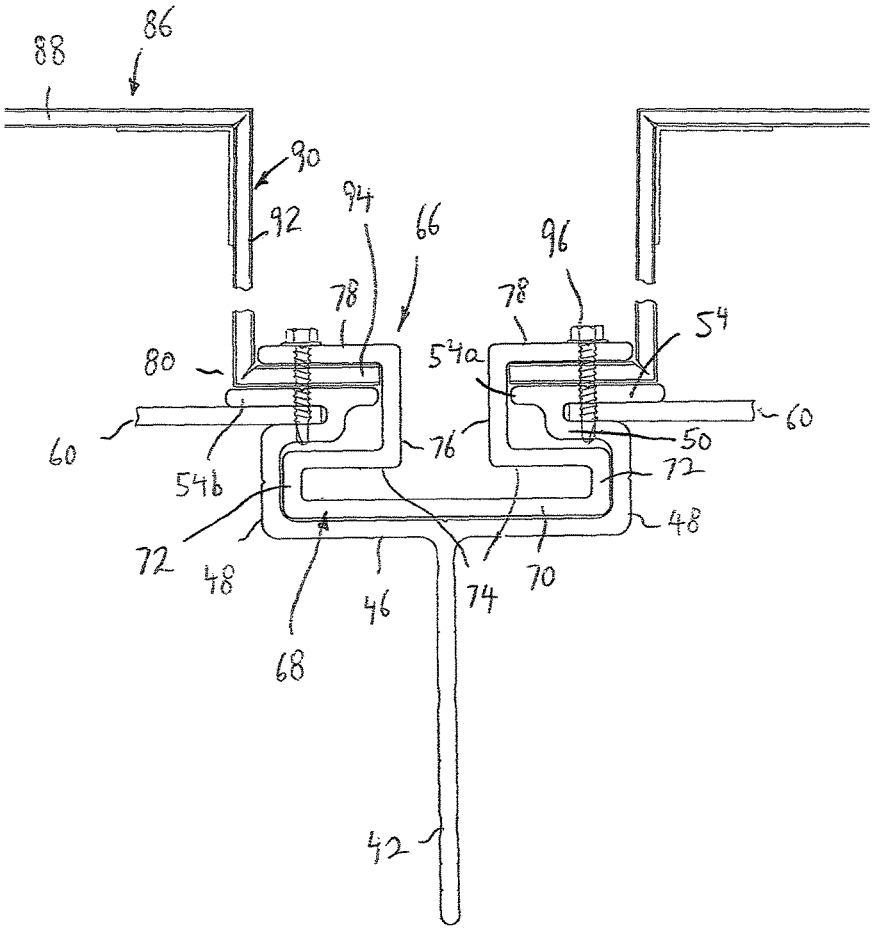
FIG. 6 is a plan view of arrangement of FIG. 5, assembled with wall panels and connecting panels.

Specifically, as shown in FIGS. 5 and 6, wall panel sliding supports 66 are slidably retained in each U-shaped track 44. Each wall panel sliding support 66 includes a U-shaped slide 68 that fits slidably within U-shaped track 44, and includes an elongated rectangular lower plate 70 positioned in sliding engagement on lower plate 46, and two upstanding, parallel, spaced apart walls 72 positioned in parallel, sliding engagement within upstanding walls 48 and extending from opposite lengthwise edges of lower plate 70. Measuring markings or gradations 115 are provided on the upper surface of elongated rectangular lower plate 70 similar to measuring gradations 15.

U-shaped slide 68 further includes inwardly directed walls 74 extending inwardly toward each other from the lengthwise edges of spaced apart walls 72 and positioned in parallel, sliding engagement beneath inwardly directed walls 50, so as to slidably capture U-shaped slide 68 within U-shaped track 44.

Extension walls 76 extend in the third direction from the free lengthwise edge of each inwardly directed wall 74 at a position inwardly of the first inner portion 54*a* of retaining walls 54 such that the opposite lengthwise edges of walls 76 terminate inwardly and are spaced above in the third orthogonal direction from the inner edge of first portion 54*a* of retaining walls 54. A retaining wall 78 is connected to the outer free end of each wall 76 and extends in a direction in the second transverse direction in parallel, spaced apart relation to the respective retaining wall 54 with a space 80 therebetween.

As shown in FIG. 6, connecting panels 60 can be provided to connect together spaced apart adjustment support members 40. Specifically, each connecting panels 60 has one end inserted in a gap 56 of one adjustment support member 40 and the opposite end in a gap 56 of another spaced apart adjustment support member 40.

With this arrangement, wall panels 86 to be secured over an existing wall, include an outer exposed main panel section 88 and inwardly extending L-shaped connecting walls 90 at each edge of outer exposed panel section 88. Outer exposed main panel section 88 is preferably a planar, rectangular panel, although the present invention is not limited thereby, and outer exposed main panel section 88 can have any suitable shape, including a three dimensional shape. Each L-shaped connecting wall 90 includes an inwardly extending bent end wall 92 that extends from an outer edge of a main panel section 88 in the third direction and a securing wall 94 that extends from the opposite free end of inwardly extending wall 92 in a direction parallel but opposite from main panel section 88. Securing wall 94 is inserted within the space 80 between retaining walls 54 and 78. Screws 96 are then inserted through retaining wall 78, securing wall 94, retaining wall 54, connecting panel 60 and inwardly directed wall 50 to secure these elements together, as shown in FIG. 6.

Accordingly, with this arrangement, each wall panel 86 can be adjusted easily in three dimensions to take into account any unevenness in the existing wall or any repositioning that may be required.

Figure 6A:
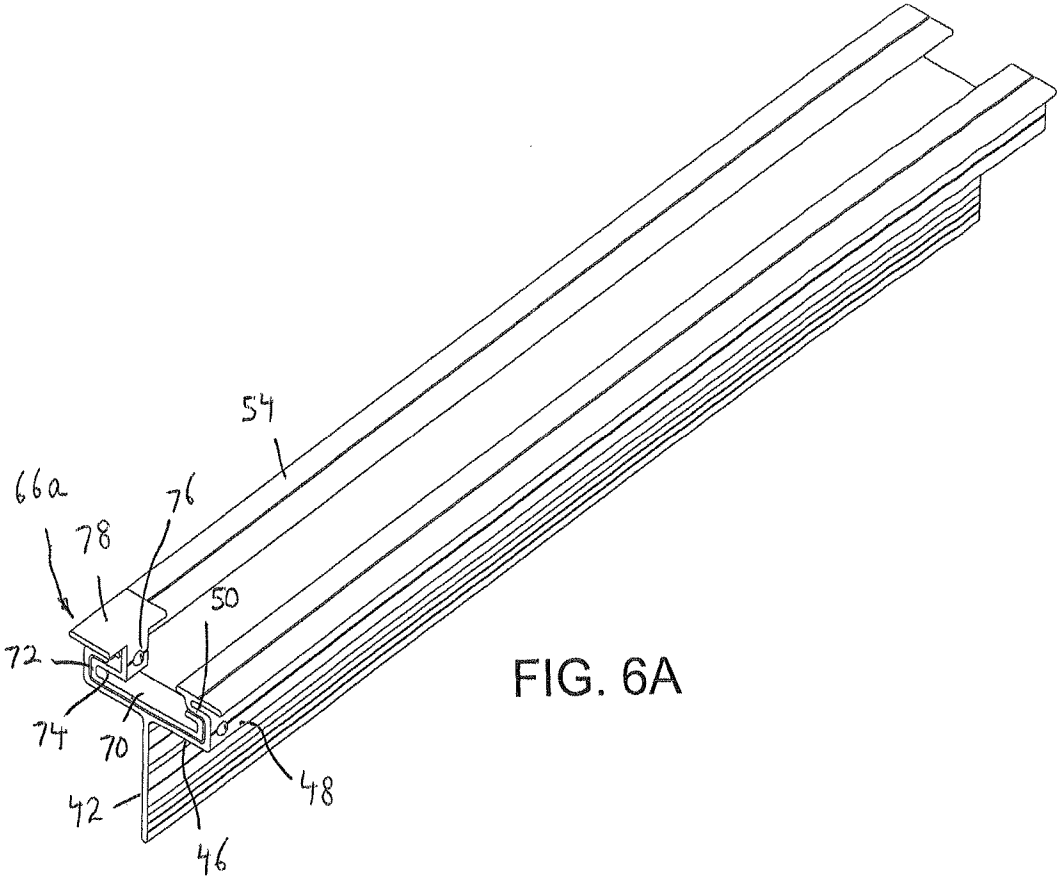
FIG. 6A is a perspective view of the adjustment support member of FIG. 2, assembled with a modified wall panel sliding support.

FIG. 6A shows a modified wall panel sliding support 66*a* in which one extension wall 76 and its corresponding retaining wall 78 are eliminated. Modified wall panel sliding support 66*a* is provided at a corner where only one retaining wall 78 is required.

Figure 7:
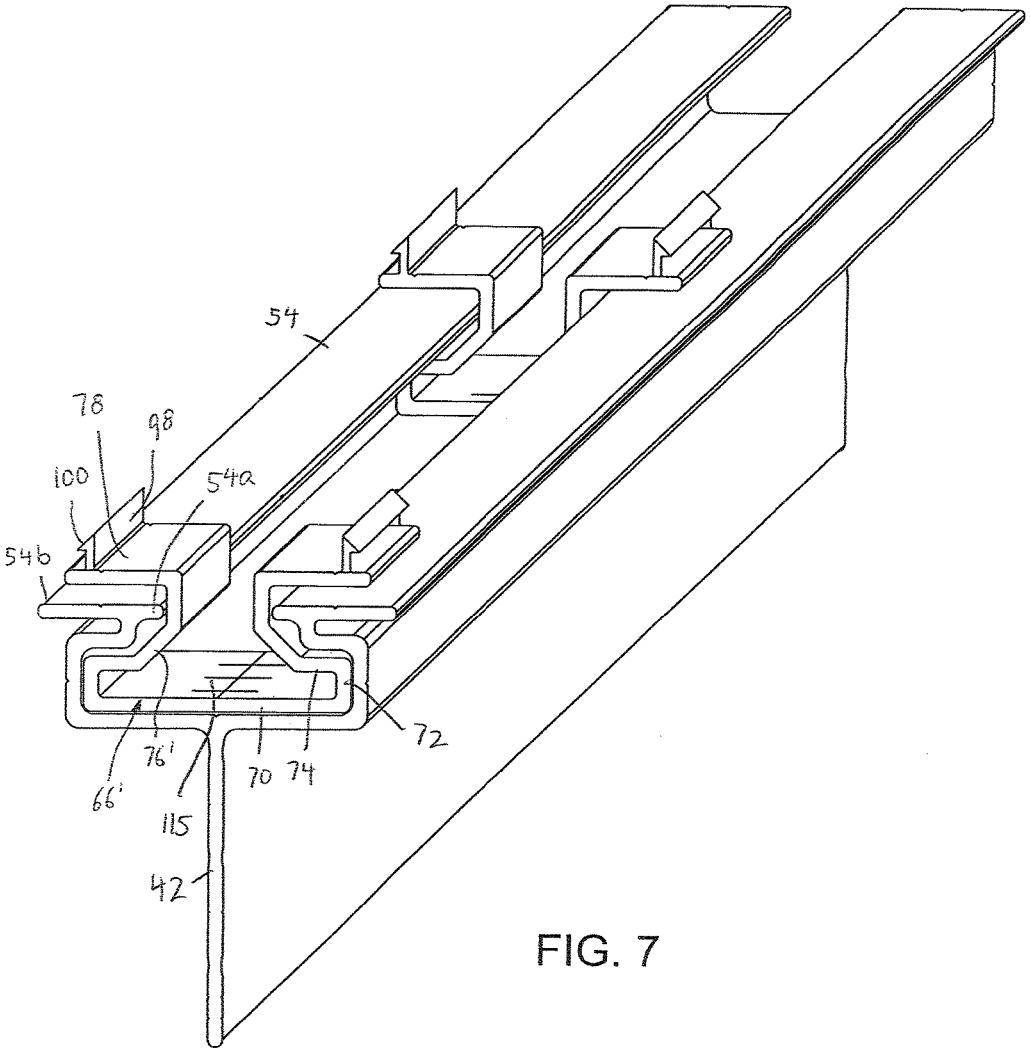
FIG. 7 is a perspective view of the adjustment support member of FIG. 2, assembled with a further modified wall panel sliding support.
Figure 8:
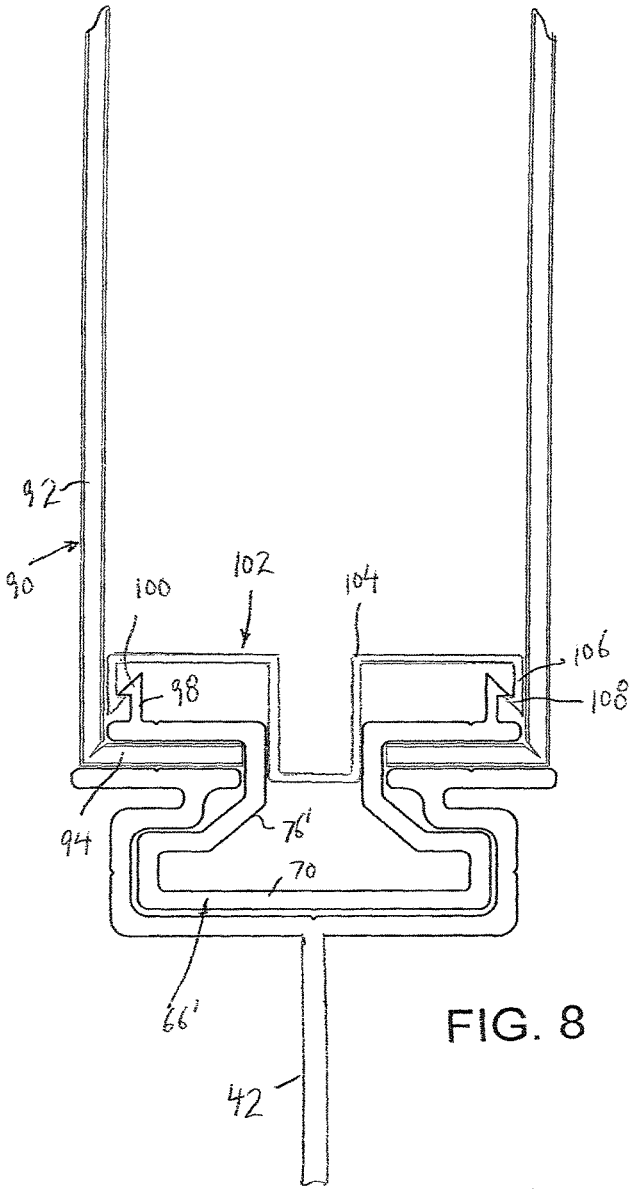
FIG. 8 is a plan view of the assembly of FIG. 7 with wall panels and a cover.

Referring now to FIGS. 7 and 8, modified wall panel sliding supports 66' are shown. Specifically, extension walls 76 are replaced by V-shaped extension walls 76'. More importantly, catch walls 98 extend outwardly from the exposed surface of each retaining wall 78 in the third direction at a position slightly spaced inwardly from the outer free edge thereof. Each catch wall 98 includes an outwardly facing V-shaped catch 100 at the upper end thereof.

A cover 102 having a central section 104 is adapted to be secured in covering relation to wall panel sliding support 66', and includes capture walls 106 at opposite ends thereof, with each capture wall 106 having an inwardly facing V-shaped latch 108 at the free end thereof for engaging with a respective V-shaped catch 100.

Figure 9:
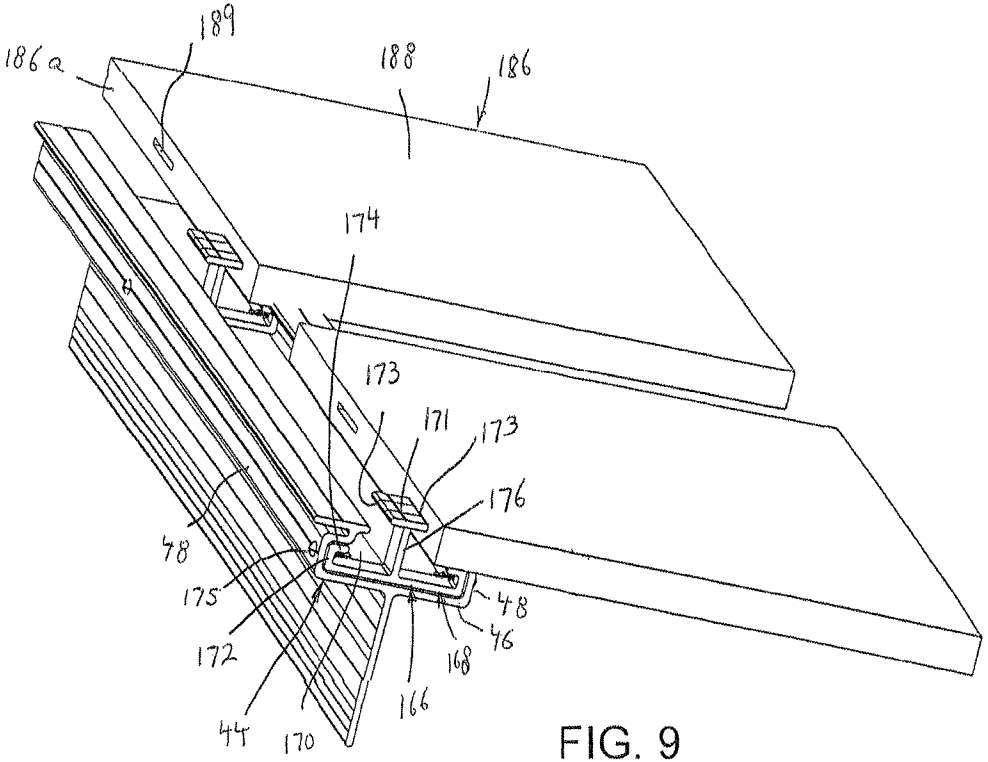
FIG. 9 is a perspective view of modified wall panel sliding supports assembled with the adjustment support member of FIG. 2.

Referring now to FIG. 9, there is shown modified wall panel sliding supports 166 which are slidably retained in U-shaped track 44. Each wall panel sliding support 166 includes a U-shaped slide 168 that fits slidably within U-shaped track 44, and includes an elongated rectangular lower plate 170 positioned in sliding engagement on lower plate 46, and two upstanding, parallel, spaced apart walls 172 positioned in parallel, sliding engagement within upstanding walls 48 and extending from opposite lengthwise edges of lower plate 170. U-shaped slide 168 further includes inwardly directed walls 174 extending inwardly toward each other from the lengthwise edges of spaced apart walls 172 and positioned in parallel, sliding engagement beneath inwardly directed walls 50, so as to slidably capture U-shaped slide 168 within U-shaped track 44.

A single extension wall 176 extends in the third direction from the center of the elongated rectangular lower plate 170, and a rectangular securing plate 171 is mounted centrally to the free end of extension wall 176 so as to define tabs 173 extending to opposite sides of single extension wall 176.

Each wall panel 186 is formed from a single panel member 188 having slots 189 at opposite side edges thereof. With this arrangement, each single panel member 188 has an end thereof seated on top of a respective retaining wall 54, with a tab 173 inserted into a slot 189 in a side wall thereof, in order to retain wall panels 186 in position.

Thus, wall panel sliding supports 166 are slid to desired positions with tabs 173 inserted into slots 189, and screws 175 are screwed through upstanding walls 48 of U-shaped track 44 and upstanding walls 172 of U-shaped slide 168 to lock slides 168 in the desired positions.

It will further be appreciated that each wall panel 186 can be made as a solid panel, or alternatively, as a hollow panel with bent down side walls 186*a* through which slots 189 are provided. It will further be appreciated that, although not shown, there will be measuring markings or gradations on the upper surface of elongated rectangular lower plate 170 similar to measuring gradations 15.

Figure 10:
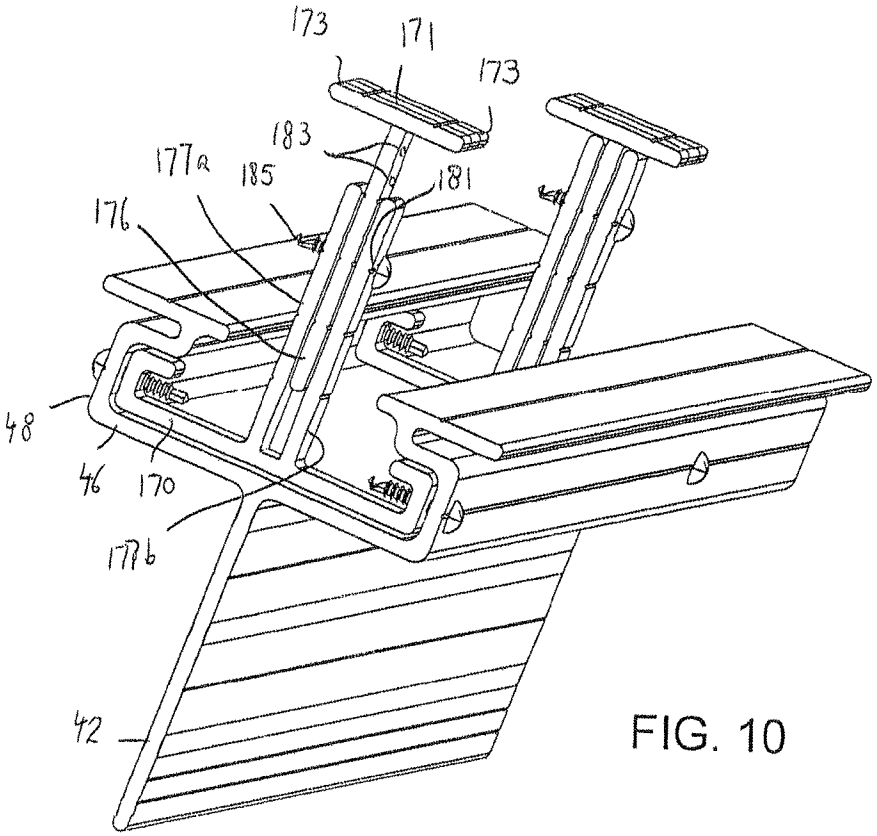
FIG. 10 is a perspective view of further modified wall panel sliding supports similar to those of FIG. 9, assembled with the adjustment support member of FIG. 2.

FIG. 10 shows a modification of the embodiment of FIG. 9 in which adjustability of rectangular securing plate 171 is provided relative to elongated rectangular lower plate 170 of U-shaped slide 168 in the third orthogonal direction.

Specifically, two parallel, spaced apart extension walls 177*a* and 177*b* extend outwardly in the third direction from the center of elongated rectangular lower plate 170, and have aligned openings 181. A single extension wall 176 is slidably positioned between extension walls 177*a* and 177*b*, and includes a plurality of spaced apart openings 183 therealong. Single extension wall 176 can be selectively secured at a desired height by adjusting the position of single extension wall 176 between extension walls 177*a* and 177*b*, and then secured in that position by a bolt 185 extending through aligned openings 181 and 183. Rectangular securing plate 171 is mounted centrally to the free end of single extension wall 176 so as to define tabs 173 extending to opposite sides of single extension wall 176.

It will be appreciated that other means for connecting the wall panels to the wall panel sliding supports can be provided.

Figure 11:
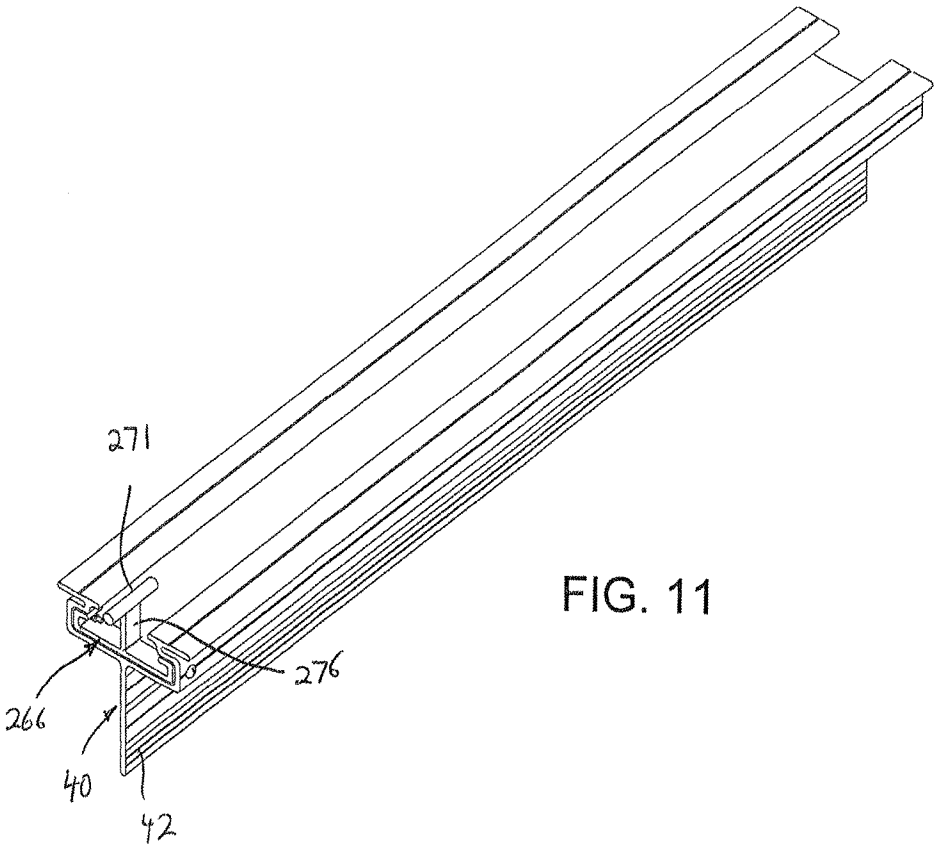
FIG. 11 is a perspective view of still further modified wall panel sliding supports similar to those of FIG. 9, assembled with the adjustment support member of FIG. 2.

For example, as shown in FIG. 11, a wall panel sliding support 266 is shown which is identical to wall panel sliding support 166 of FIG. 9, except that rectangular securing plate 171 is replaced with a rod 271 at the upper end of single extension wall 276, with rod 271 extending in the first lengthwise direction. With this arrangement, the wall panels would include circular openings (not shown) in place of rectangular slots 189 for receiving the ends of rod 271. It will be appreciated that the wall panels 186 will therefore be oriented perpendicular to the arrangement shown in FIG. 9 in order for the ends of the rod 271 to be inserted into the circular openings.

Figure 12:
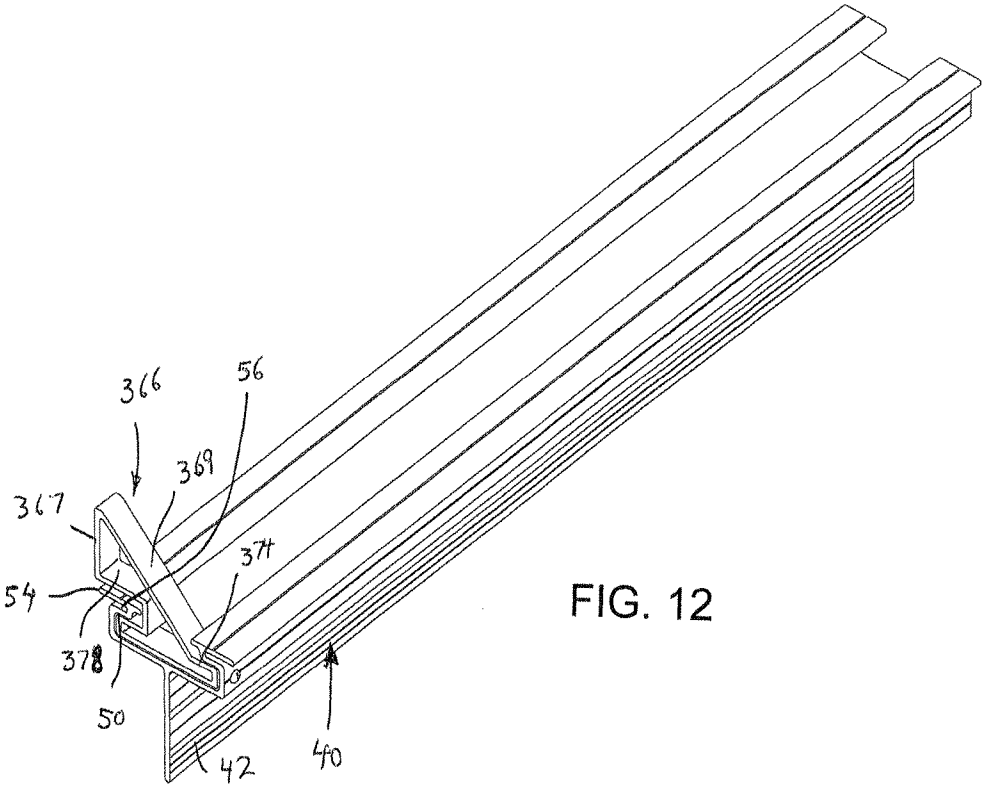
FIG. 12 is a perspective view of a yet further modified wall panel sliding support, assembled with the adjustment support member of FIG. 2.

FIG. 12 shows a modified wall panel sliding support 366 which is identical to wall panel sliding support 66 of FIG. 5, except that one extension wall 76 and its corresponding retaining wall 78 are eliminated. In place thereof, an extension wall 367 extends in the third orthogonal direction from the free end of the single retaining wall 378, and an inclined wall 369 connects the free end of extension wall 367 and the free and of inwardly directed wall 374 at the opposite side of wall panel sliding support 366.

Figure 13:
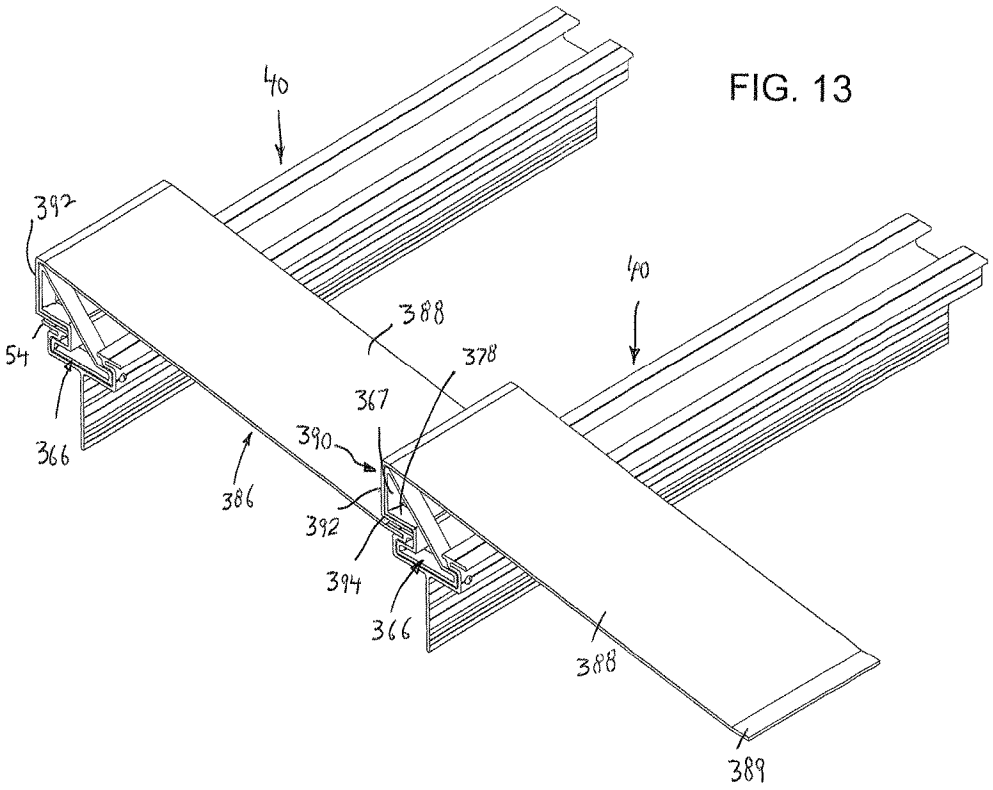
FIG. 13 is a perspective view of the assembly of FIG. 12, assembled with modified wall panels.

In this manner, as shown in FIG. 13, modified wall panels 386 can be secured thereto in an angled manner to provide a three-dimensional appearance. Specifically, each wall panel 386 includes an outer exposed panel section 388 having an inwardly extending L-shaped connecting wall 390 secured to one end thereof. Specifically, L-shaped connecting wall 390 includes an inwardly extending wall 392 that extends from an outer edge of main panel section 388 in the third orthogonal direction and at an acute angle relative to main panel section 388, and a securing wall 394 that extends from the opposite free end of inwardly extending wall 392 in the same direction as main panel section 388 but spaced therefrom. Securing wall 394 is inserted within the space between retaining walls 54 and 378, with inwardly extending wall 392 overlying extension wall 367.

The opposite end of main panel section 388 is slightly bent to define a bent end 389 which is inserted in the gap 56 between inwardly directed wall 50 and retaining wall 54. Screws (not shown) are then inserted through bent end 389, retaining wall 54, securing wall 394 and retaining wall 378 to secure these elements together.

It will be appreciated that, with this arrangement, because inclined wall 369 *h* foul as one end raised relative to the other end due to extension wall 367, one and of each wall panel 386 is raised relative to the other hand so as to present a three-dimensional arrangement.

Figure 14:
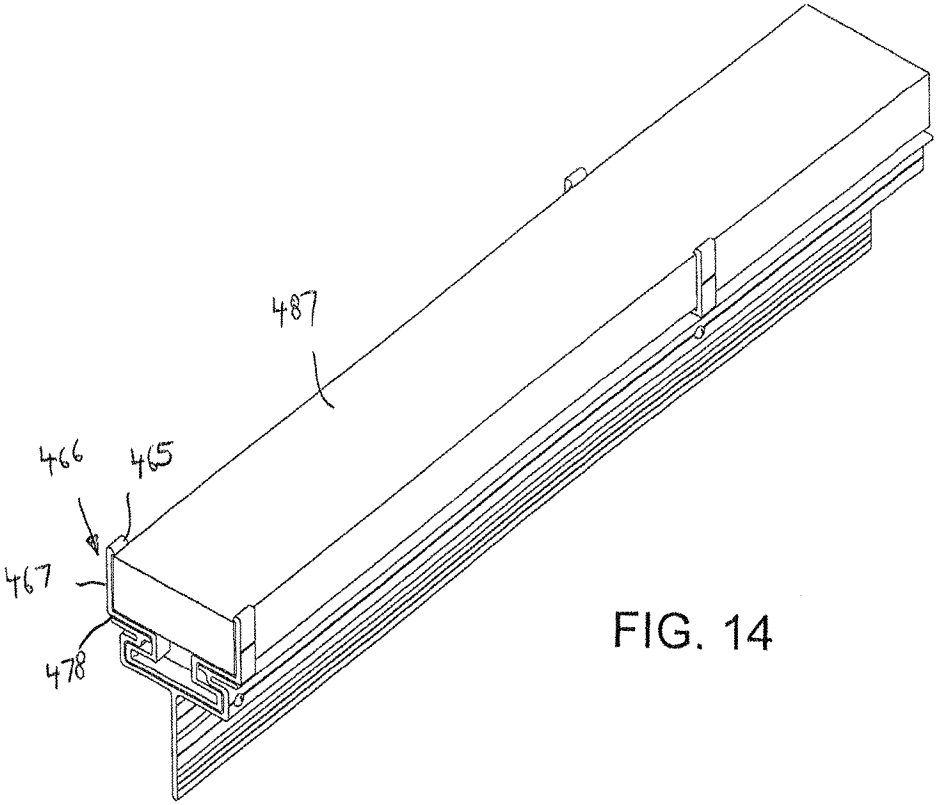
FIG. 14 is a perspective view of still further modified wall panel sliding supports for connection with a 2×4 framing stud, and assembled with the adjustment support member of FIG. 2.

FIG. 14 shows a further modified wall panel sliding support 466 which is identical to wall panel sliding support 66 of FIG. 5, except that an extension wall 467 extends in the third direction from the free end of each retaining wall 478 in a direction away from adjustment support member 40, with the free end of each extension wall 467 having a slightly inturned lip 465. With this arrangement, a 2×4 framing stud 487 (or any other size framing stud) or the like can be positioned between adjacent extension walls 467 and held by inturned lips 465. Planar wall panels can then be secured on top of the 2×4 framing studs 487, and secured thereto by screws. Of course, it will be appreciated that, in such case, the screws will be exposed on the outer facing surface of the wall panels.

Figure 15:
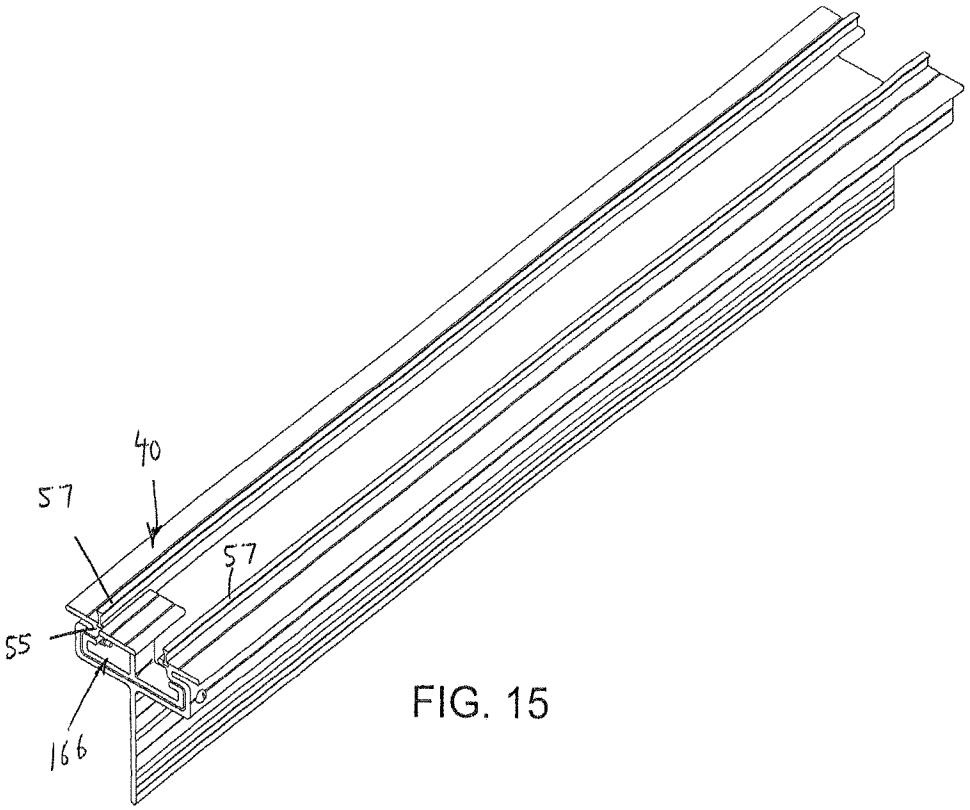
FIG. 15 is a perspective view of a wall panel sliding support which is the same as that of FIG. 9, assembled with a modified adjustment support member.
Figure 16:
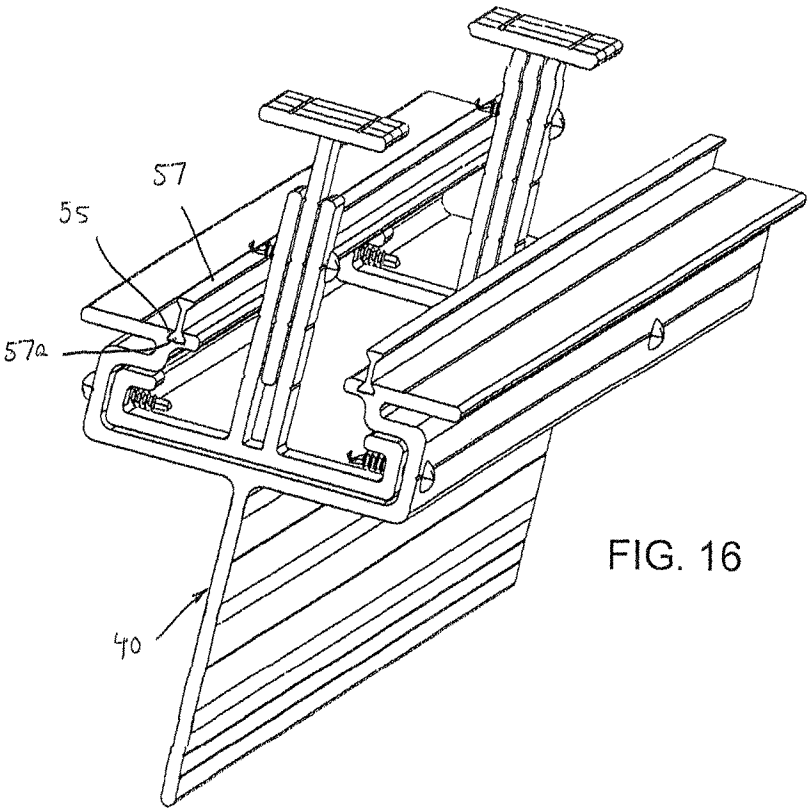
FIG. 16 is a perspective view of wall panel sliding supports which are the same as that of FIG. 10, assembled with a modified adjustment support member.
Figure 17:
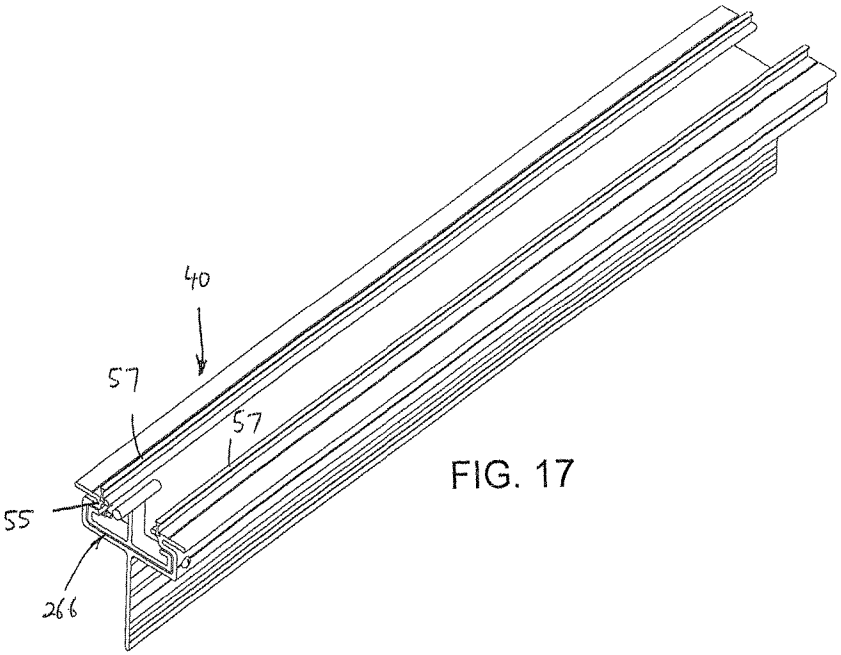
FIG. 17 is a perspective view of a wall panel sliding support which is the same as that of FIG. 11, assembled with a modified adjustment support member.

FIGS. 15-17 show embodiments which are identical to the embodiments of FIGS. 9-11, respectively, except that retaining walls 54 include elongated dovetail shaped slots 55 therein extending in the first lengthwise direction. Retaining bars 57 having at least one dovetail shaped end 57*a* fit within each dovetail shaped slot 55. Retaining bars 57 function as water locking panels to prevent water ingress. Retaining bars 57 can be inserted after wall panels 86 are assembled with adjustment support members 40, or alternatively, can be inserted prior to assembly of wall panels 86 and, in such case, wall panels 86 would be angled when assembled to pass by retaining bars 57.

It will be appreciated that, while wall panel sliding supports 66 have been disclosed as being slidable on the inside of U-shaped track 44 of adjustment support member 40, the wall panel sliding supports can be slidably positioned on the outside of adjustment support member 40 as well, as will now be disclosed.

Figure 18:
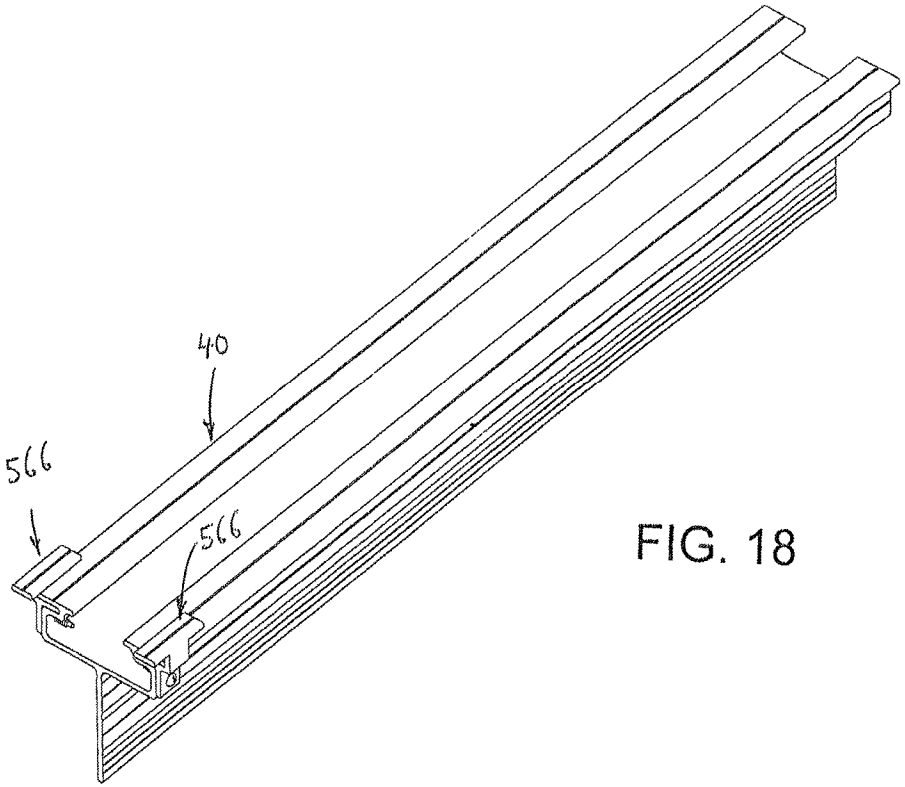
FIG. 18 is a perspective view of a modified wall panel sliding support assembled with the adjustment support member of FIG. 2.
Figure 19:
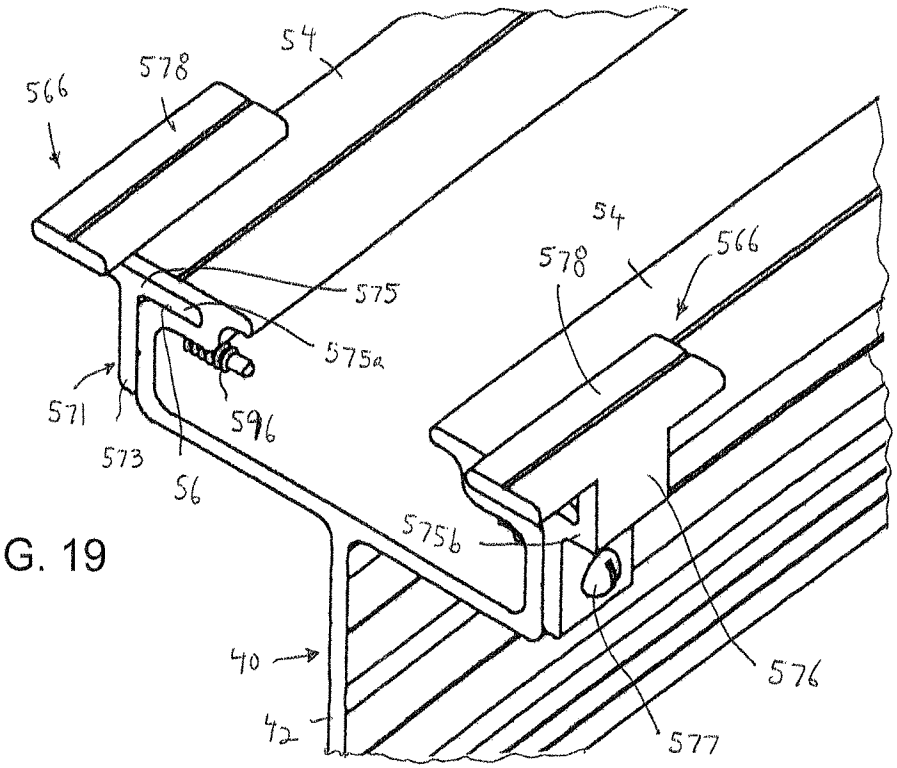
FIG. 19 is an enlarged perspective view of a portion of the assembly of FIG. 18.

Specifically, as shown in FIGS. 18 and 19, wall panel sliding supports 566 each include a T-shaped wall 571 formed by a wall 573 extending in the third orthogonal direction and a transverse wall 575 bisected by and connected at the upper end of wall 573 so as to form first and second wall sections 575*a* and 575*b* on opposite sides of transverse wall 575. An extension wall 576 extends in the third orthogonal direction from the free end of second wall section 575*b* in a direction away from wall 573. A rectangular retaining wall 578 has one edge connected to the upper end of extension wall 576. With this arrangement, first wall section 575*a* is inserted within elongated gap 56 of adjustment support member 40 sliding movement therein. In such position, wall 573 is positioned flush against the outer surface of the respective upstanding wall 48 of adjustment support member 40. Further, in such position, rectangular retaining wall 578 is positioned in parallel, spaced relation from the respective retaining wall 54 of adjustment support member 40.

With this arrangement, wall panels (not shown) which are identical to wall panels 86 of FIG. 6 are provided, except that securing wall 94 is oriented 180° from that shown in FIG. 6, that is, securing wall 94 is positioned in parallel spaced relation directly beneath outer exposed panel section 88. Thus, securing wall 94 is positioned between retaining walls 54 and 578. Wall panel sliding supports 566 are secured to upstanding walls 48 by screws 596 extending therethrough.

Figure 20:
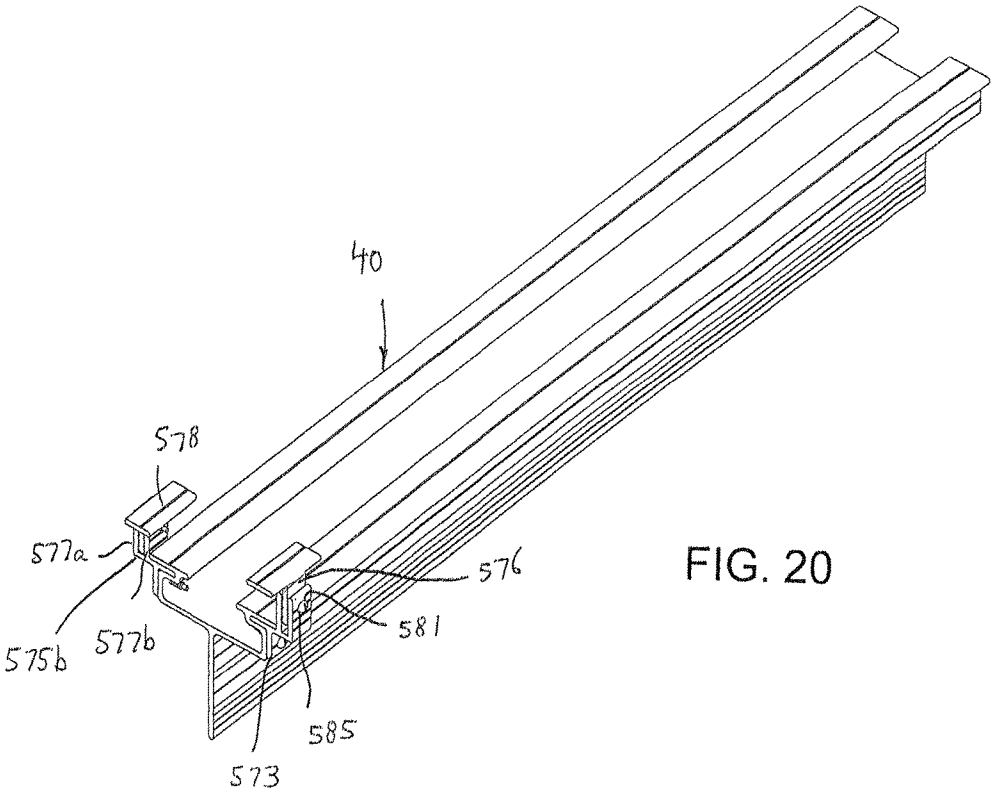
FIG. 20 is a perspective view of a further modified wall panel sliding support assembled with the adjustment support member of FIG. 2.

FIG. 20 shows a modification of the embodiment of FIGS. 18 and 19 in which adjustability of rectangular retaining wall 578 is provided relative to retaining wall 54.

Specifically, two parallel, spaced apart extension walls 577*a* and 577*b* extend outwardly in the third orthogonal direction from the free end of second wall section 575*b* in a direction away from wall 573, and have aligned openings 581. A single extension wall 576 is slidably positioned between extension walls 577*a* and 577*b*, and includes a plurality of spaced apart openings (not shown) therealong. Single extension wall 576 can be selectively secured at a desired height by adjusting the position of single extension wall 576 between extension walls 577*a* and 577*b*, and then secured in that position by a bolt 585 extending through aligned openings 581 and one of the openings in single extension wall 576. Retaining wall 578 has one edge connected to the upper end of extension wall 576.

Figure 21:
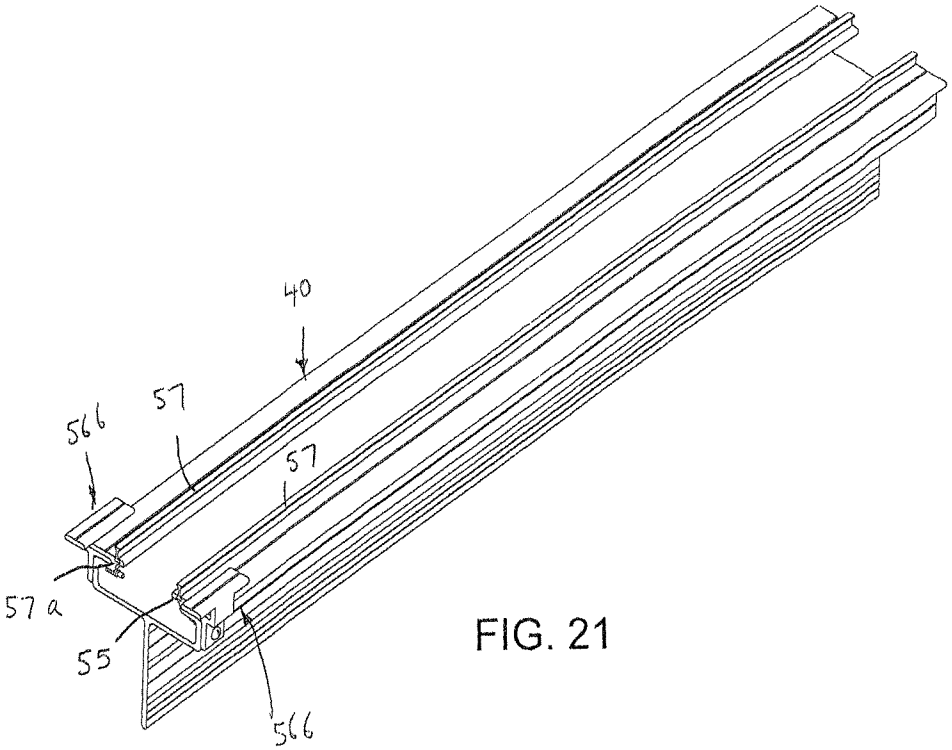
FIG. 21 is a perspective view of a wall panel sliding support which is the same as that of FIG. 18, assembled with a modified adjustment support member.
Figure 22:
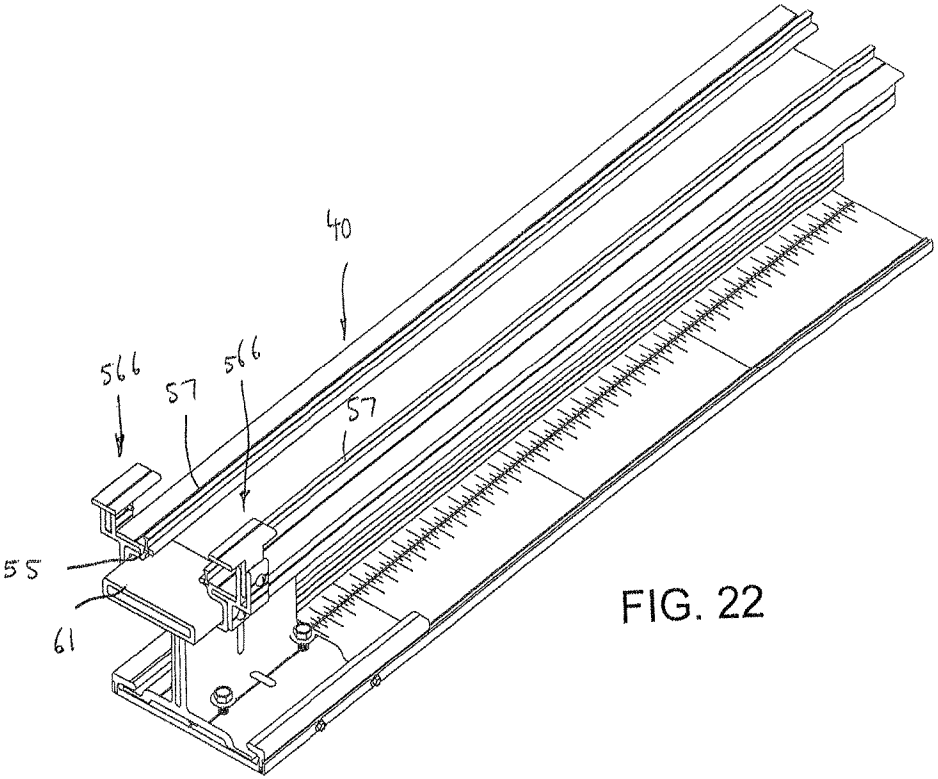
FIG. 22 is a perspective view of a wall panel sliding support which is the same as that of FIG. 20, assembled with a modified adjustment support member.

FIGS. 21 and 22 show embodiments which are identical to the embodiments of FIGS. 18-20, respectively, except that retaining walls 54 include elongated dovetail shaped slots 55 therein extending in the first lengthwise direction. Retaining bars 57 have at least one dovetail shaped end 57*a* which fits within each dovetail shaped slot 55. Retaining bars 57 function as water locking panels to prevent water ingress. Retaining bars 57 can be inserted after wall panels 86 are assembled with adjustment support members 40, or alternatively, can be inserted prior to assembly of wall panels 86 and, in such case, wall panels 86 would be angled when assembled to pass by retaining bars 57.

In addition, as shown in FIG. 22, a rectangular parallelepiped connecting member 61 is slid within track 44 to connect together in line, abutting or near abutting, adjustment support members 40.

Figure 23:
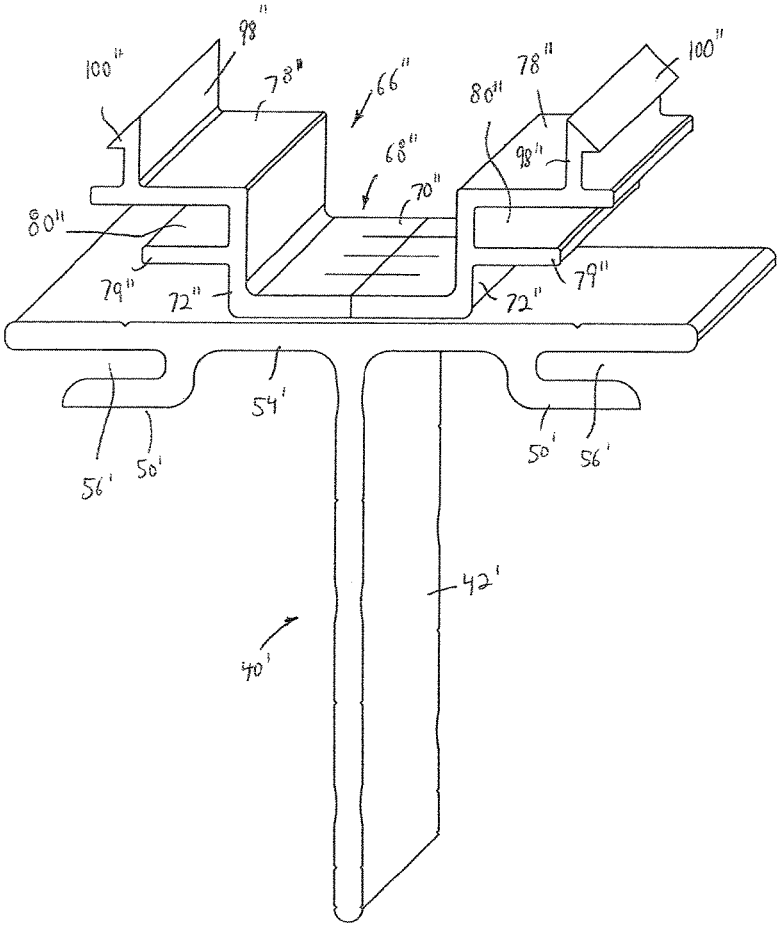
FIG. 23 is a perspective view of a modified adjustment support member and a wall panel support.
Figure 24:
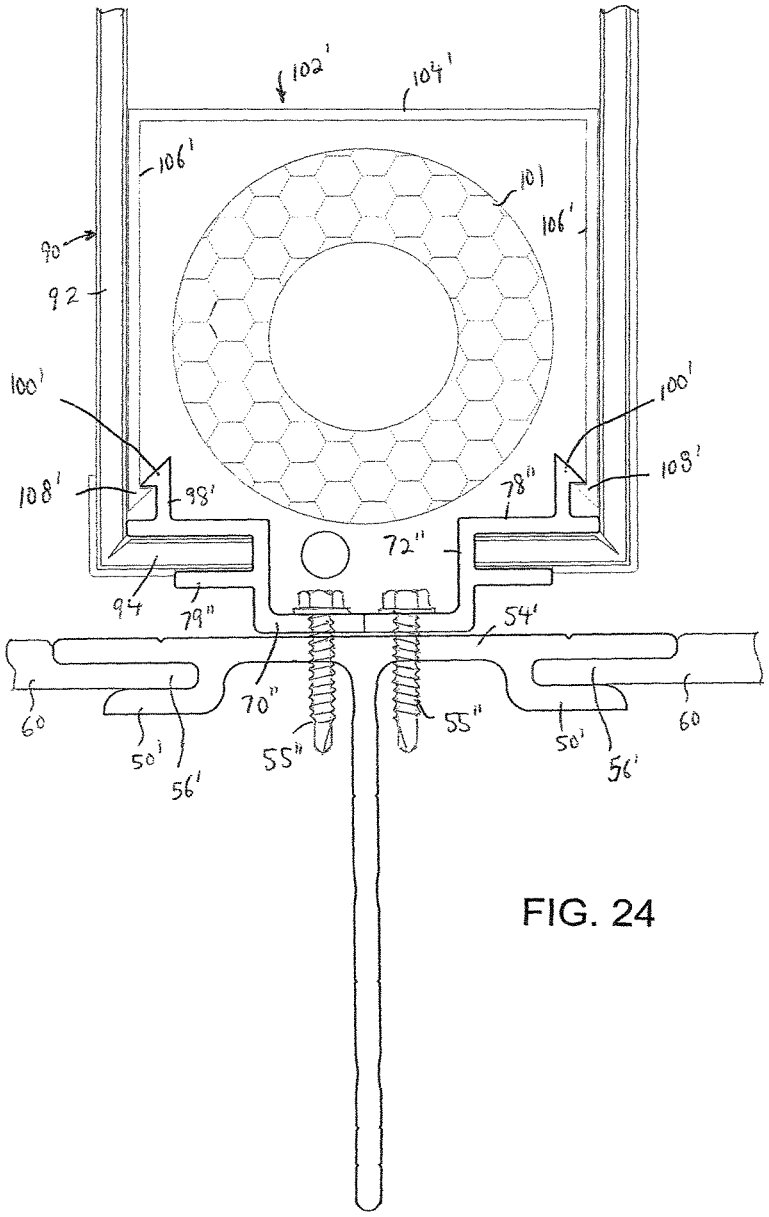
FIG. 24 is a plan view of the arrangement of FIG. 23, assembled with wall panels and connecting panels.

A further modification is shown in FIGS. 23 and 24 in which a modified adjustment support member 40' includes an elongated rectangular plate 42' that is dimensioned to fit snugly between capture walls 30 and 32, such that retaining lip 30*a* applies pressure to plate 42'. The opposite free lengthwise edge of rectangular plate 42' is fixed centrally to the lower surface of a platform wall 54'. Two L-shaped walls 50' extend from the underside of platform wall 54' on opposite sides of rectangular plate 42' and face away from rectangular plate 42', whereby a gap 56' is defined between each L-shaped wall 50' and platform wall 54' for receiving an end of a connecting panel 60 therein.

A wall panel support 66" is mounted on each modified adjustment support member 40' and includes a U-shaped support 68" having an elongated rectangular lower plate 70" and two upstanding, parallel, spaced apart walls 72" extending in the third direction from opposite lengthwise edges of lower plate 70". Rectangular lower plate 70" is secured centrally to the upper surface of platform wall 54' by screws 55". A retaining second wall 78" is connected to the outer free end of each wall 72" and extends in a direction in the second transverse direction in parallel, spaced apart relation to lower plate 70" but extending outwardly in a direction away from lower plate 70". A third retaining wall 79" extends outwardly from the outer surface of each wall 72" in parallel, spaced relation from second retaining wall 78" so as to provide a space 80" therebetween for capturing securing wall 94 of a wall panel 86. Of course, screws are then inserted between the elements to secure them together.

Catch walls 98" extend outwardly from the exposed surface of each retaining wall 78" in the third direction at a position slightly spaced inwardly from the outer edge thereof. Each catch wall 98" includes an outwardly facing V-shaped catch 100" at the upper end thereof.

As shown in FIG. 24, a heating pipe 101 can be positioned between inwardly extending walls 92 of adjacent wall panels 86. Accordingly, a modified cover 102' is provided having a central wall 104' adapted to be secured in covering relation to heating pipe 101, and capture walls 106' at opposite ends thereof which extend in parallel adjacent relation to respective inwardly extending walls 92, with each capture wall 106' having an inwardly facing V-shaped latch 108' at the free end thereof for engaging with a respective V-shaped catch 100'.

Figure 25:
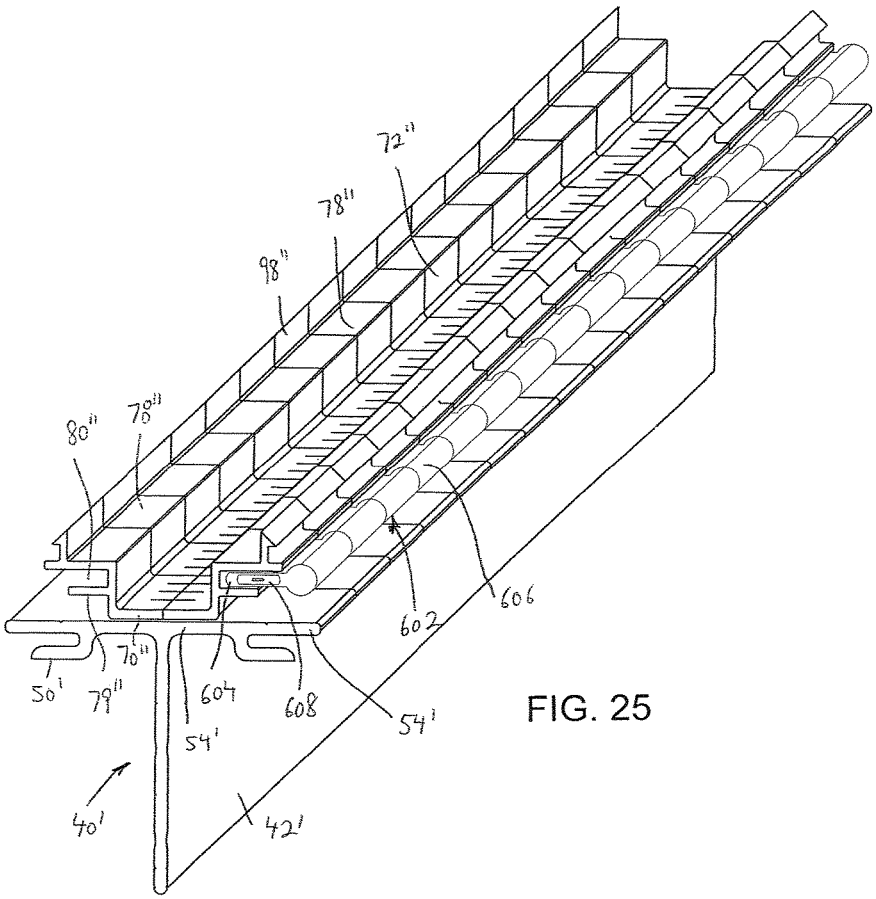
FIG. 25 is a perspective view of the arrangement of FIG. 23, used with a carpenter level.
Figure 26:
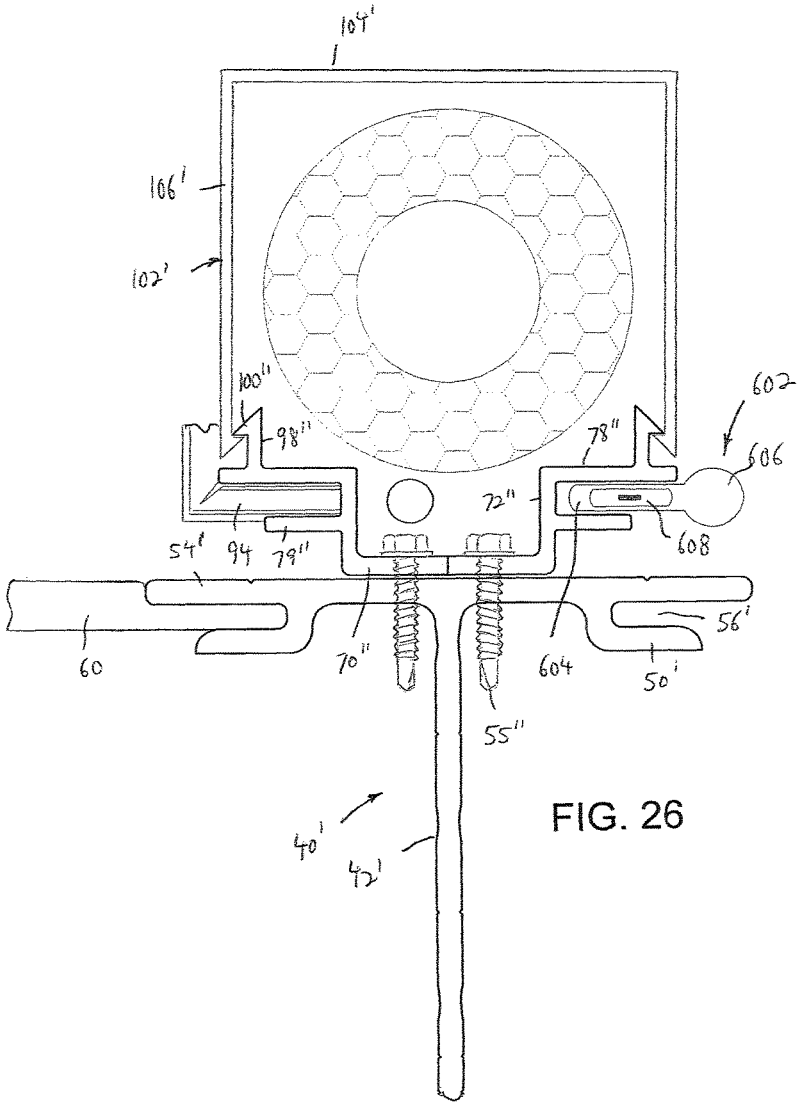
FIG. 26 is a plan view of the arrangement of FIG. 25.

As shown in FIGS. 25 and 26, in order to level each modified adjustment support member 40', a carpenter level 602 is provided which includes an elongated rectangular parallelepiped body 604 with a cylindrical grasping member 606 along an elongated edge thereof. Elongated rectangular parallelepiped body 604 includes a conventional bubble level 608 therein at a visible sign edge thereof. Thus, when assembling modified adjustment support member 40' with sliding support member 24, elongated rectangular parallelepiped body 604 of carpenter level 602 is inserted within space 80" and adjustment is made in accordance with the reading of the bubble level 608 to achieve a desired level and orientation. Thereafter, grasping member 606 is grabbed and carpenter level 602 is removed from space 80", whereupon the wall panels can then be assembled therewith.

Figure 27:
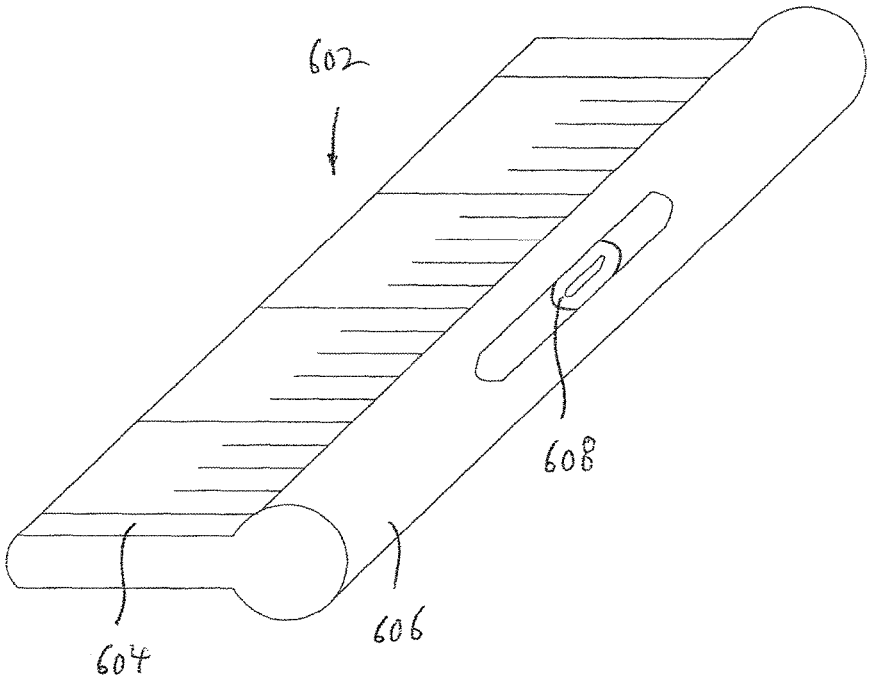
FIG. 27 is a perspective view of a modified carpenter level.

Alternatively, as shown in FIG. 27, bubble level 608 can be provided in cylindrical grasping member 606.

It will be appreciated that carpenter level 602 can be used with any of the embodiments in the present application, and instead of being positioned within space 80", it can be positioned in spaces 56, 56' as well.

It will be appreciated that the invention described above has permitted adjustment in at least three orthogonal directions. However, the present invention can also be provided with fewer degrees of freedom or adjustment, for example, adjustment in a single direction such as the first lengthwise direction.

In this regard, in all of the above embodiments, elongated rectangular plate 42 can be removed from adjustment support member 40, and lower plate 46 of adjustment support member 40 can be secured directly to an existing wall. In such case, wall panel sliding supports 66 would provide the only adjustment in the first lengthwise direction.

Figure 28:
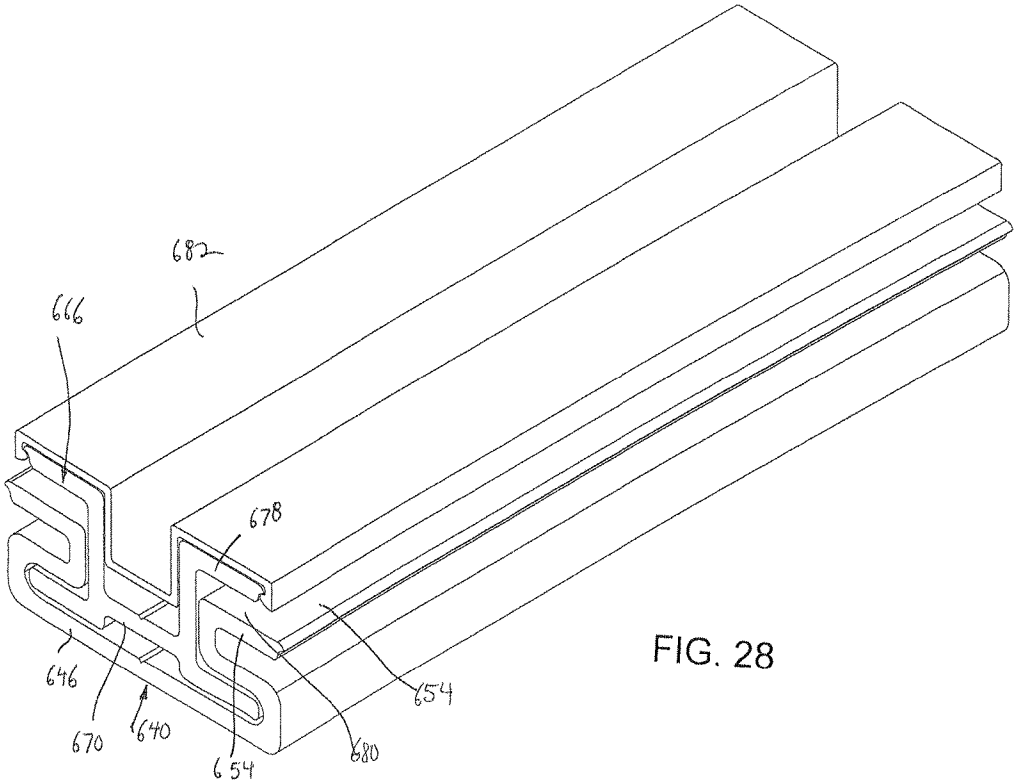
FIG. 28 is a perspective view of a modified adjustment support member and modified wall panel sliding support for adjustment in a single direction.
Figure 29:
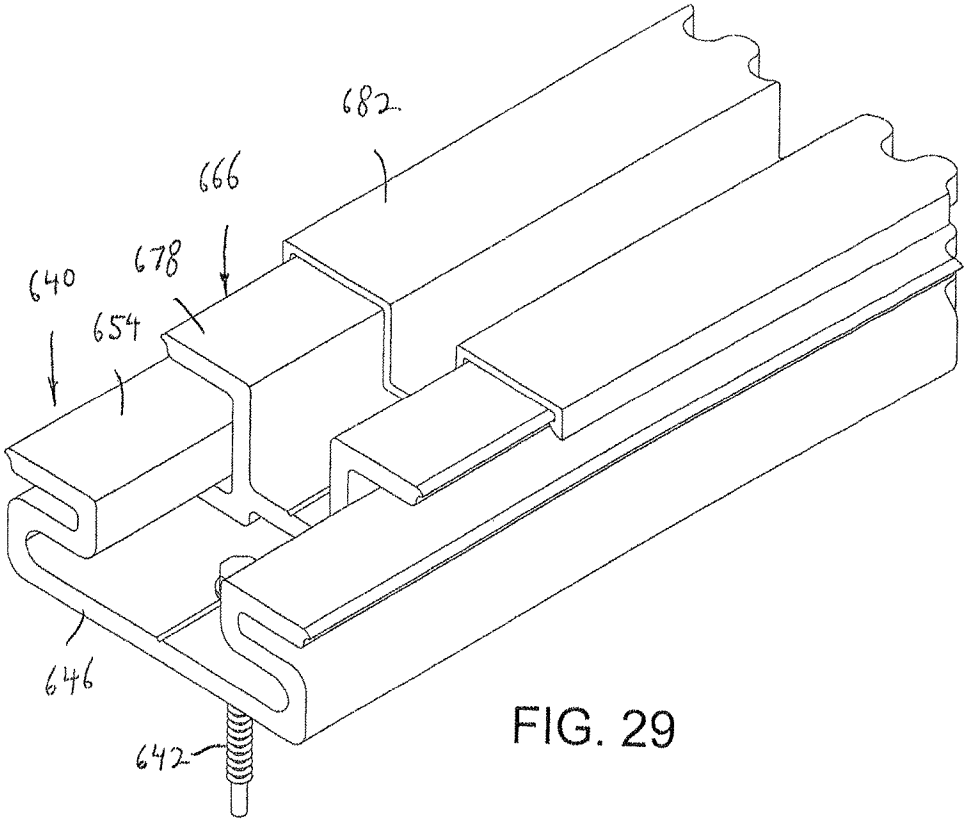
FIG. 29 is a perspective view of the arrangement of FIG. 28, showing the sliding arrangement of the parts.

One example of this arrangement, corresponding to FIG. 5, is shown in FIGS. 28 and 29 in which a modified adjustment support member 640 is provided, with a lower plate 646 adapted to be secured by screws 642 to an existing wall. A modified wall panel sliding support 666 is slidably retained by adjustment support member 640. It will be appreciated that elongated rectangular lower plate 670 of wall panel sliding support 666 has an inverted U-shape so as not to engage with the screws used to secure lower plate 646 to the existing wall. As with the aforementioned embodiments, the securing walls 94 of wall panels 86 are inserted in the space 680 between retaining wall 654 of adjustment support member 640 and retaining wall 678 of wall panel sliding support 666. A cover 682 is also shown which engages over retaining walls 678.

Figure 30:
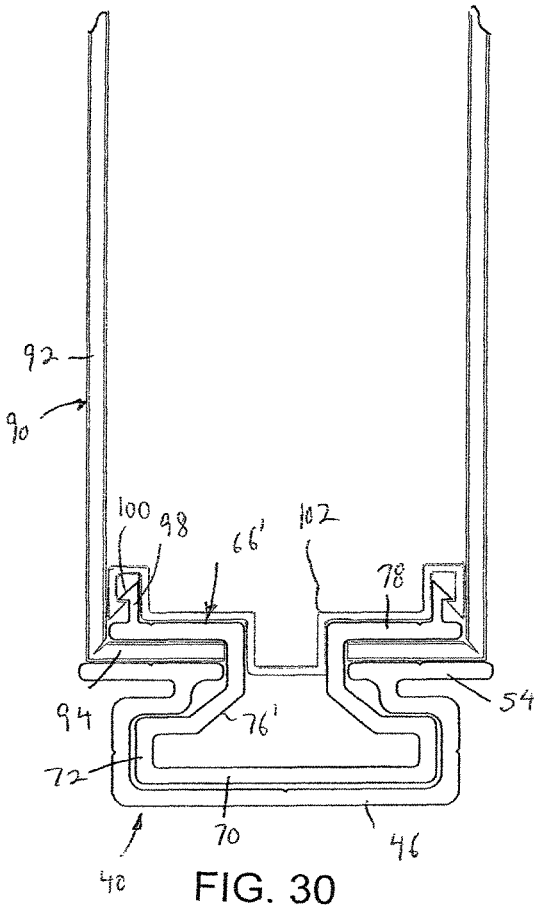
FIG. 30 is a plan view, similar to the arrangement of FIG. 28, with a further modified wall panel sliding support.
Figure 31:
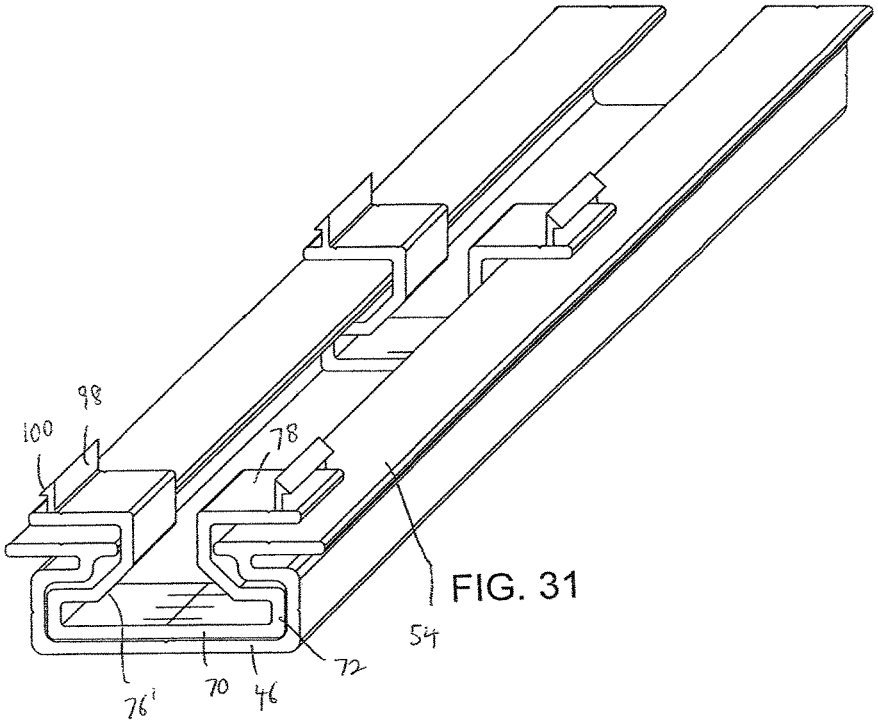
FIG. 31 is a perspective view of the arrangement of FIG. 30.
Figure 32:
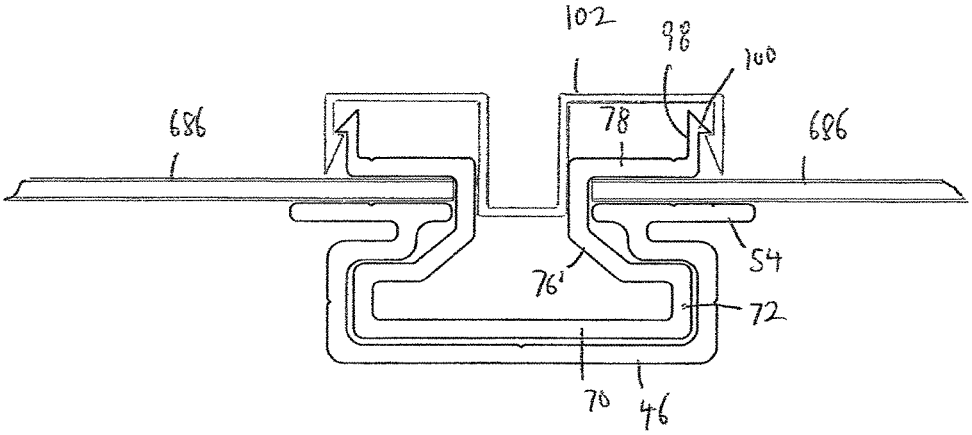
FIG. 32 is a plan view, similar to FIG. 32, showing connection with different wall panels.

As another example, reference is made to FIG. 30 which corresponds to the arrangement shown in FIGS. 7 and 8, but with elongated rectangular plate 42 removed. FIG. 32 is similar to FIG. 30, except that planar wall panels 686 are provided.

It will be appreciated that, with all of the above embodiments, wall panels 86 have been connected to adjustment support member 40 and/or wall panel sliding supports 66. However, wall panels 86 can alternatively be connected with connecting panels 60 which connect spaced apart adjustments support members 40.

Figure 33:
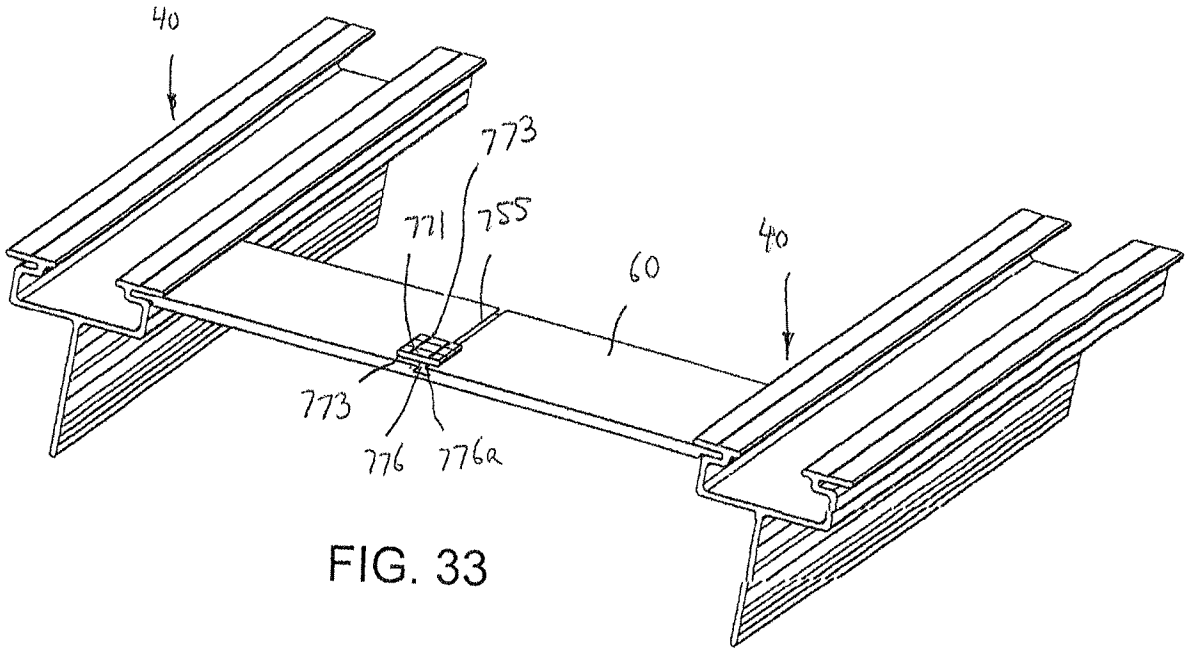
FIG. 33 is a perspective view of two adjustment support members connected together by connecting panels, with a first arrangement on the connecting panels for supporting wall panels.

Thus, for example, a rectangular securing plate 771, as shown in FIG. 33, and which is similar to rectangular securing plate 171, is connected to the upper end of an extension wall 776 having a dovetail shaped lower end 776*a* which fits within a dovetail shaped slot 755 extending in the first lengthwise direction in a connecting panel 60. As with rectangular securing plate 171, rectangular securing plate 771 defines tabs 773 extending to opposite sides of extension wall 776, for insertion into slots 189 in a side wall of a single panel member 188 of a wall panel 186 in order to retain wall panels 186 in position. With this arrangement, rectangular securing plate 771 can be moved to provide adjustment of wall panels 86. Further, with this arrangement, wall panel sliding supports 66 are eliminated.

Figure 34:
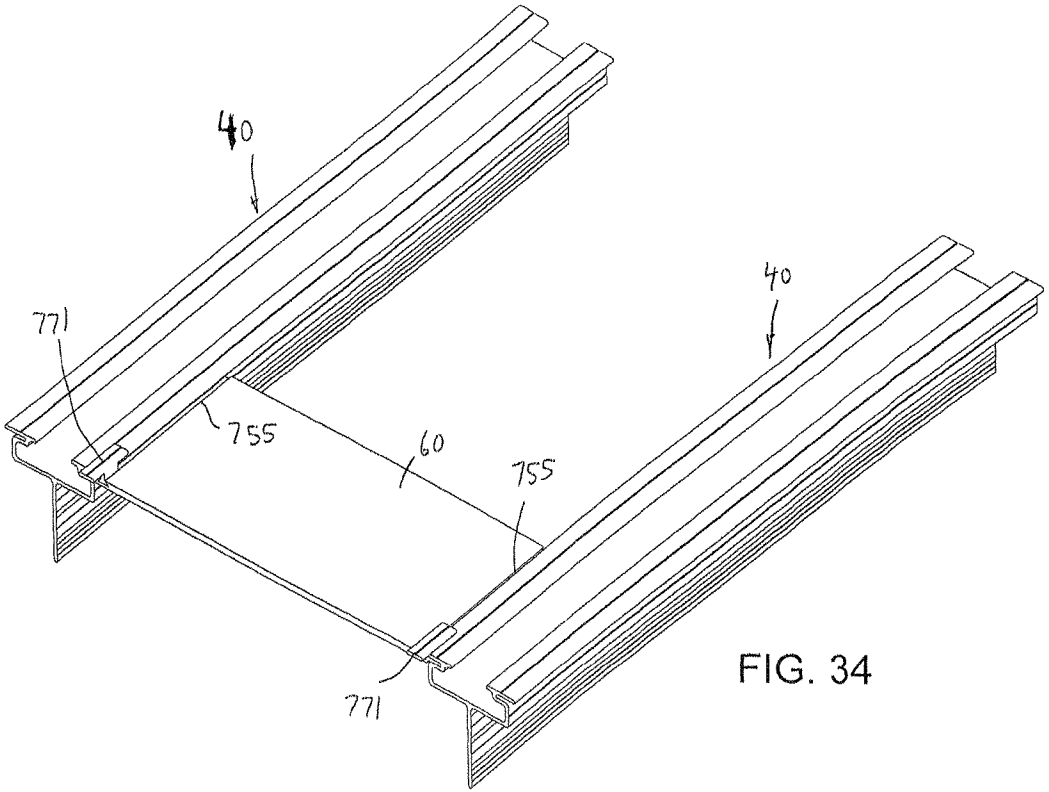
FIG. 34 is a perspective view similar to FIG. 33, with a modified arrangement on the connecting panels for supporting wall panels.
Figure 35:
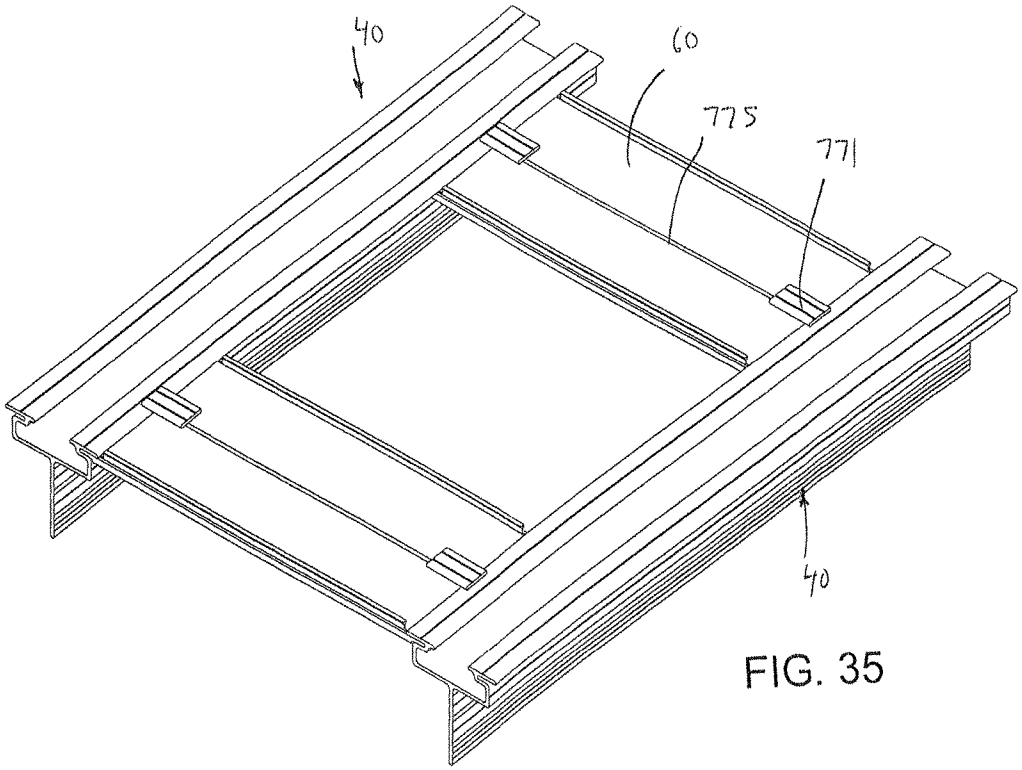
FIG. 35 is a perspective view similar to FIG. 33, with a further modified arrangement on the connecting panels for supporting wall panels.

While only one dovetail shaped slot 755 has been shown in FIG. 33, more than one dovetail shaped slot 755 can be provided, as shown in FIG. 34. Further, while dovetail shaped slots 755 has been shown in FIGS. 33 and 34 extending the first lengthwise direction, it can alternatively extend in the second transverse direction, as shown in FIG. 35.

Figure 36:
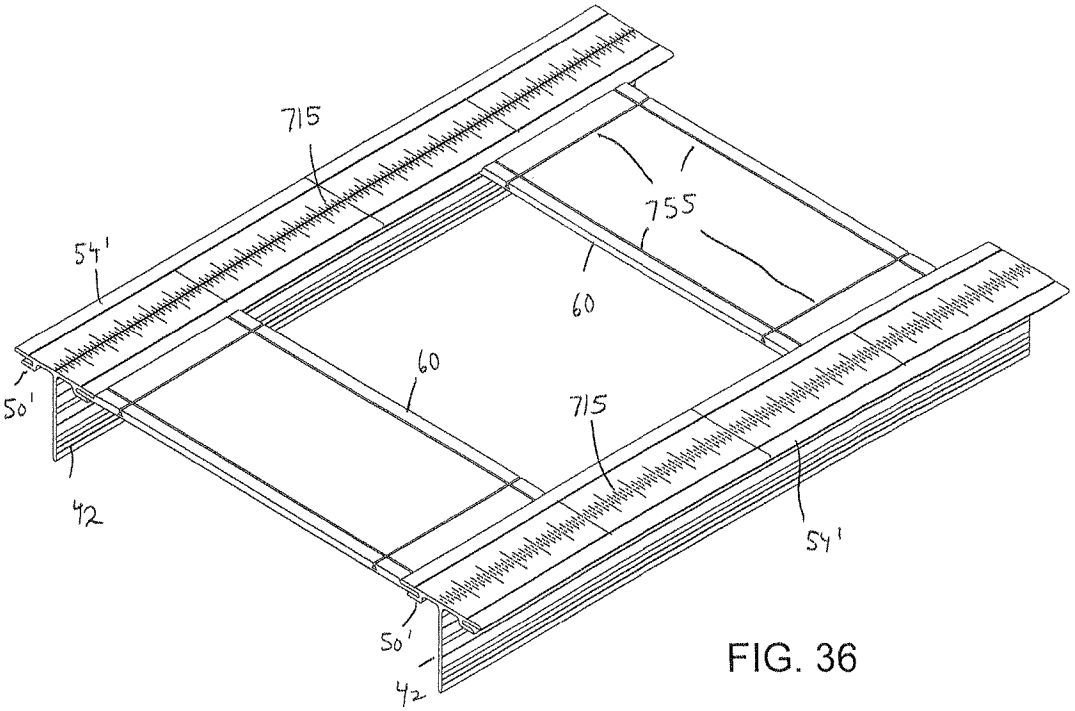
FIG. 36 is a perspective view similar to FIG. 33, with a still further modified arrangement on the connecting panels for supporting wall panels.

Still further, multiple dovetail shaped slots 755 can be provided, as shown in FIG. 36, in both the first lengthwise direction and second transverse direction. In addition, since the wall panels will be secured to rectangular securing plates 771, there is no longer a need for U-shaped track 44, and accordingly, an arrangement similar to that shown in FIG. 24 can be used, with platform wall 54' and L-shaped walls 50'. Further, measuring markings or gradations 715 are provided on the upper surface of platform wall 54'.

Figure 37:
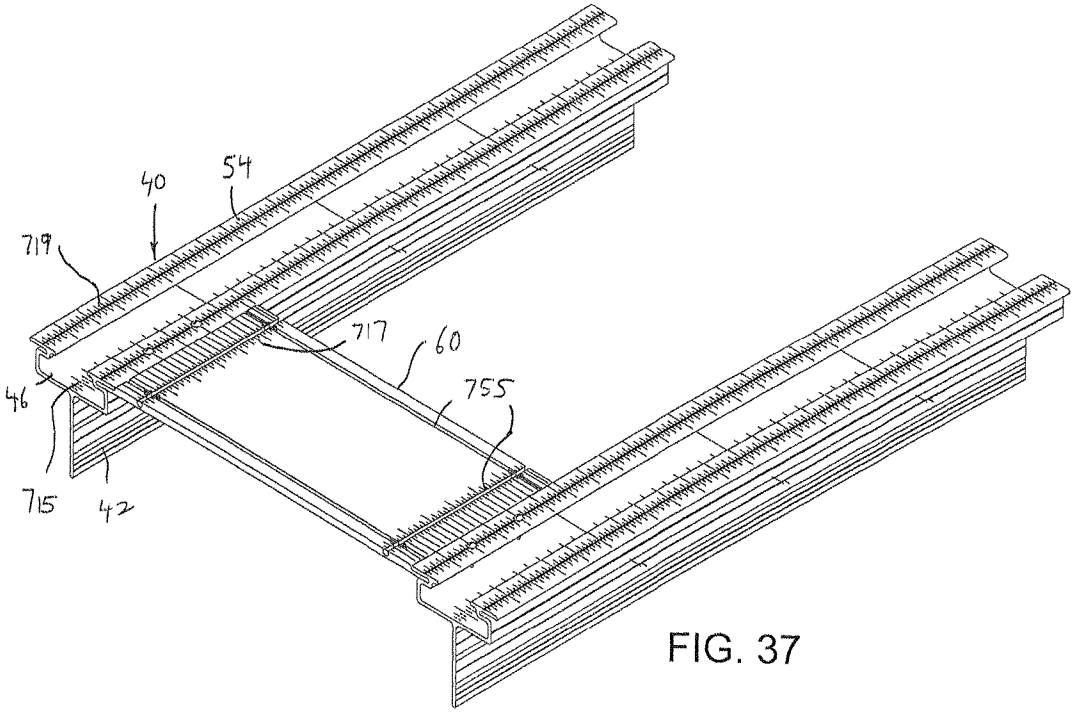
FIG. 37 is a perspective view similar to FIG. 33, with a yet further modified arrangement on the connecting panels for supporting wall panels.

FIG. 37 shows another modification in which connecting panel 60 of the type shown in FIG. 36 is connected to adjustment support members 40, with measuring markings or gradations 715, 717 and 719 provided on elongated rectangular lower plate 46, connecting plate 60 and elongated retaining walls 54, respectively.

Figure 38:
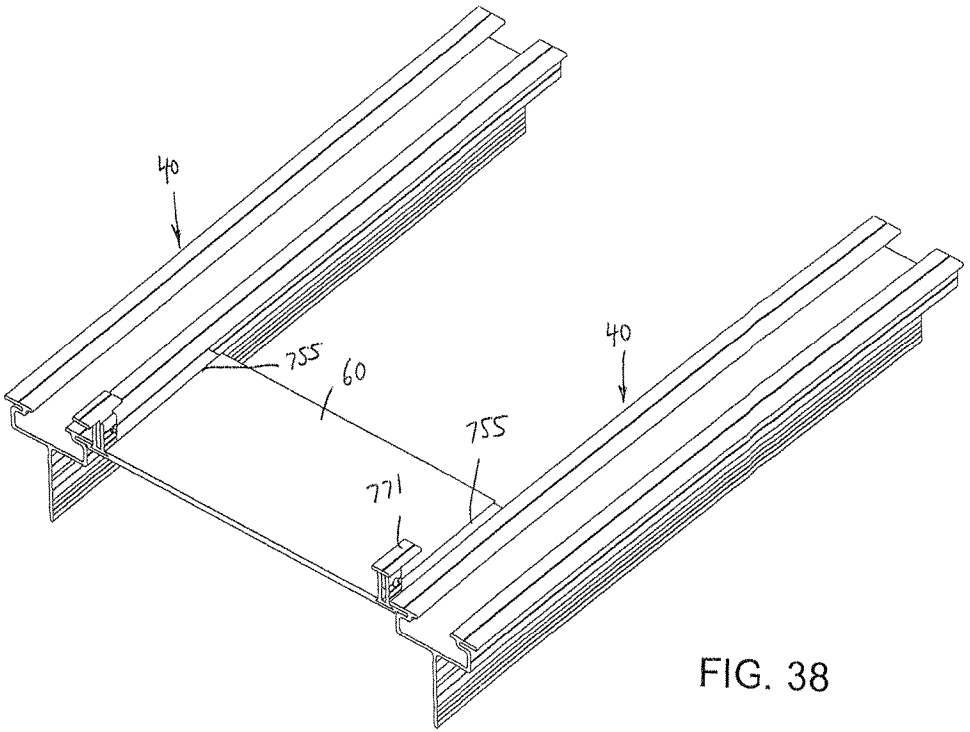
FIG. 38 is a perspective view similar to FIG. 33, with another modified arrangement on the connecting panels for supporting wall panels.

A further modification of the arrangement shown in FIG. 34 is shown in FIG. 38, in which rectangular securing plates 771 can be adjustably moved in the third orthogonal direction, in the same manner as previously described in regard to FIG. 10.

Figure 39:
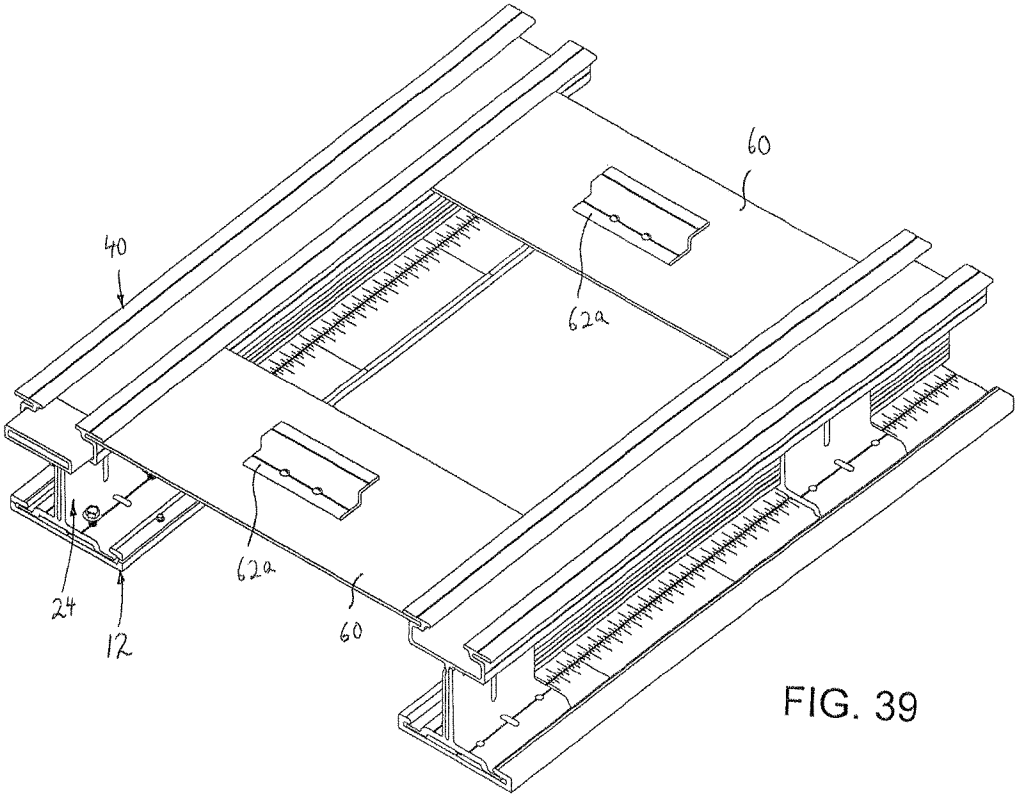
FIG. 39 is a perspective view of two adjustment support members connected together by connecting panels, with a second arrangement on the connecting panels for supporting wall panels.
Figure 40:
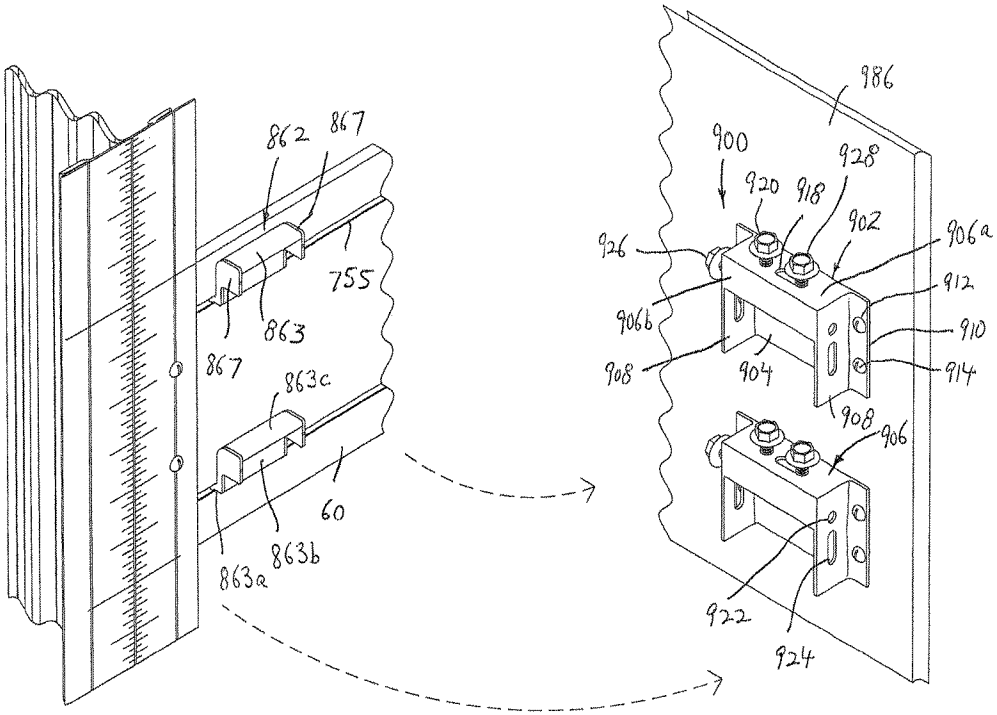
FIG. 40 is a perspective view of a portion of a modified arrangement similar to FIG. 39 for supporting wall panels according to the second arrangement
Figure 41:
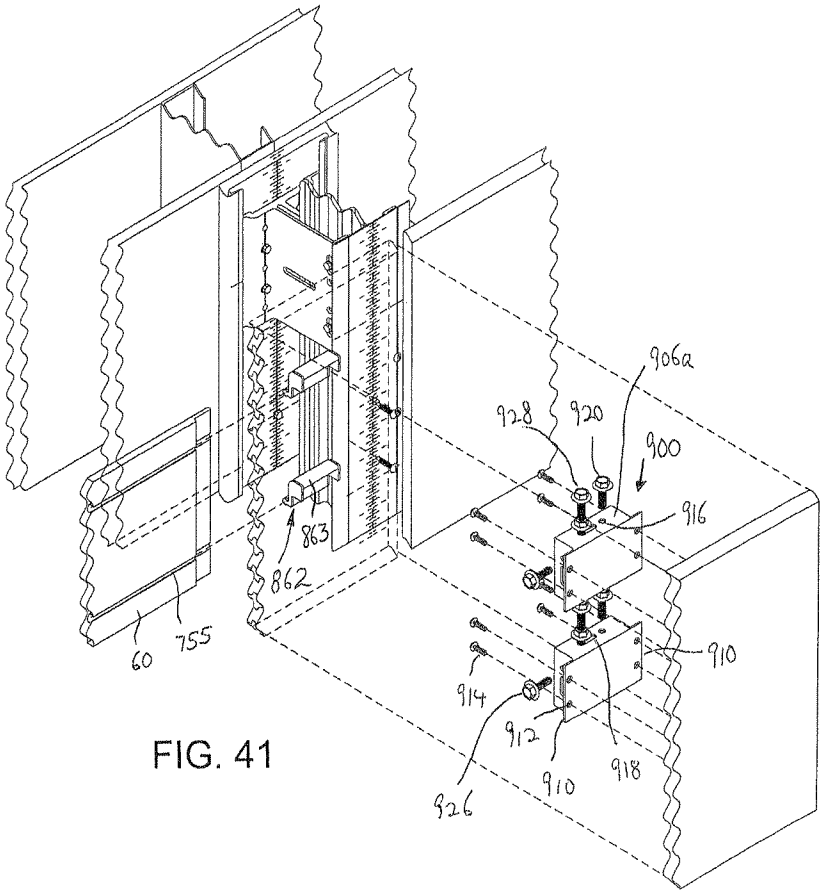
FIG. 41 is a first exploded perspective view of the arrangement of FIG. 40.
Figure 42:
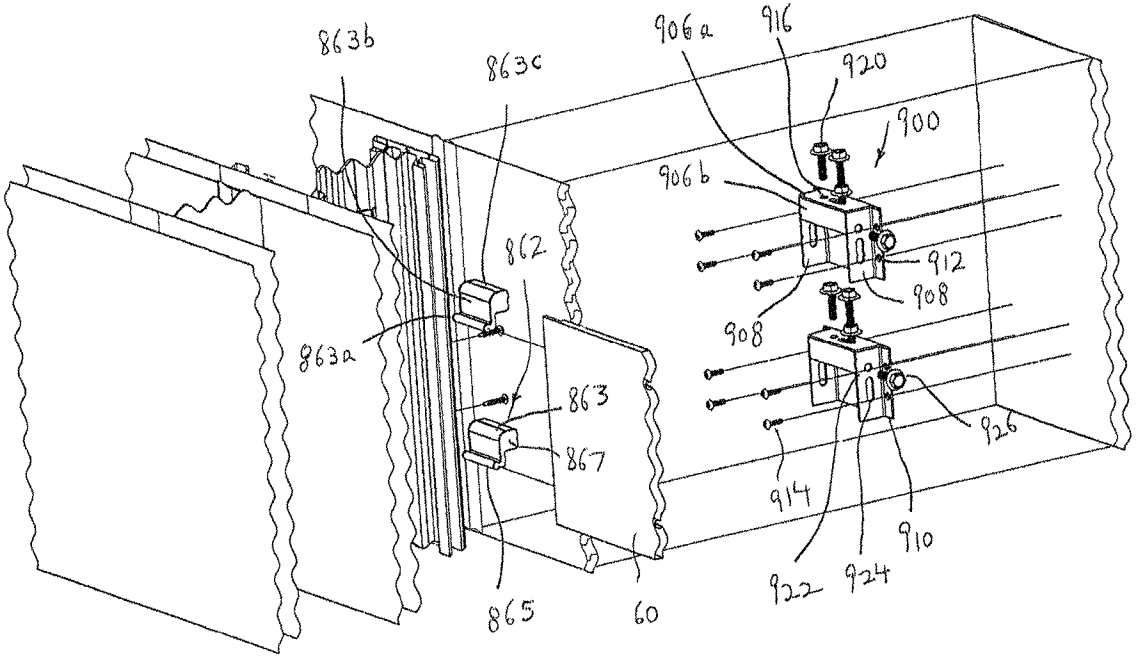
FIG. 42 is a second exploded perspective view of the arrangement of FIG. 40.
Figure 43:
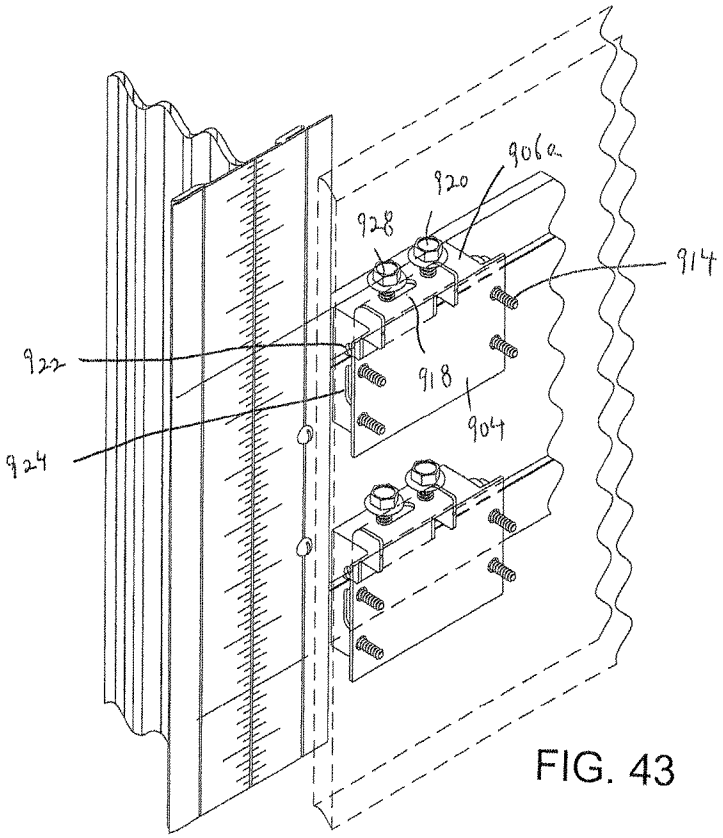
FIG. 43 is an enlarged perspective view of the portion of the modified arrangement of FIG. 40, in assembled condition.

Alternatively, instead of providing rectangular securing plates 771 with tabs 773 that fit within slots 189 in a side wall of a single panel member 188 of a wall panel 186 in order to retain wall panels 186 in position, one or more brackets can be secured on the exposed surface of each connecting panel 60, with a wall panel secured to each bracket in a hanging manner, similar to a picture frame. For example, as shown in FIG. 39, a single Z-shaped bracket 62*a* is mounted to each connecting panel 60. Similar brackets would then be provided on the rear surface of each planar wall panel for mounting the wall panel on brackets 62*a*.

In this regard, a preferred embodiment is shown in FIGS. 40-43 in which each Z-shaped bracket 862 has a Z-shaped wall 863 having one end 865 formed in a bulbous or dovetail shape for slidable insertion in a correspondingly shaped slot 755 of a connecting panel 60. Specifically, each Z-shaped wall 863 includes a first wall 863*a* having the bulbous end 865 and extending orthogonally out from the outer surface of the respective connecting panel 60, a second wall 863*b* extending orthogonally up from the free end of first wall 863*a*, and a third top wall 863*c* extending orthogonally out from the free end of second wall 863*b*. Z-shaped brackets 862 further include side walls 867 on opposite sides thereof.

Complementary hook assemblies 900 are secured to the rear surface of a planar wall panel 986 for connection with Z-shaped brackets 862. Specifically, each hook assembly 900 includes an inverted J-shaped wall 902 formed by a first rectangular wall 904 which seats flush against the rear surface of wall panel 986, and an inverted L-shaped wall 906 which extends out from the upper edge of first rectangular wall 904. L-shaped wall 906 includes a first top wall 906*a* which extends orthogonally out from the top edge of rectangular wall 904 and a downwardly extending wall 906*b* which extends down from the free edge of top wall 906*a* in parallel spaced apart relation from first wall 904. Rectangular side walls 908 are connected to and close off both sides of J-shaped wall 902. The width of rectangular wall 904 is greater than the width of J-shaped wall 902, such that rectangular wall extensions 910 extend to the sides of side walls 908, while also seating flush against the rear surface of wall panel 986. Openings 912 are provided in wall extensions 910 in order to receive screws 914 therein to secure each hook assembly 900 to the rear surface of wall panel 986.

With this arrangement, hook assemblies 900 are positioned over Z-shaped brackets 862 for mounting wall panels 986 to connecting panel 60. In such case, top wall 906*a* seats on top wall 863*c*, and side walls 908 encompass and surround side walls 867. Further, downwardly extending wall 906*b* is positioned behind second wall 863*b* to prevent pullout of wall panels 986.

In order to provide vertical adjustment of wall panels 986 relative to connecting panels 60, upper wall 906*a* includes a first circular threaded opening 916 and an adjacent slot 918. An adjustment bolt 920 is threaded within the threaded opening 916 and engages the upper surface of top wall 863*c* for moving each hook assembly 900 up and down relative to the respective connecting panel 60.

In order to provide side to side adjustment of wall panels 986 relative to connecting panels 60, at least one side wall 908 includes a first circular threaded opening 922 and an adjacent slot 924. An adjustment bolt 926 is threaded within the threaded opening 922 and engages the adjacent side wall 867 for moving each hook assembly 900 side to side relative to the respective connecting panel 60.

In this regard, it will be appreciated that hook assemblies 900 are positioned near the edges of wall panel 986 in order to permit access to adjustment screws 920 and 926.

After adjustment bolts 920 and 926 have been rotated to provide adjustment of hook assemblies 900 relative to Z-shaped brackets 862, and thereby adjustment of wall panel 986 relative to the corresponding connecting panel 60, securing screws 928 which extend through slots 918 and 924 into threaded engagement with top wall 863*c* and side wall 867, respectively, are rotated to fix hook assemblies 900 relative to Z-shaped brackets 862.

Figure 44:
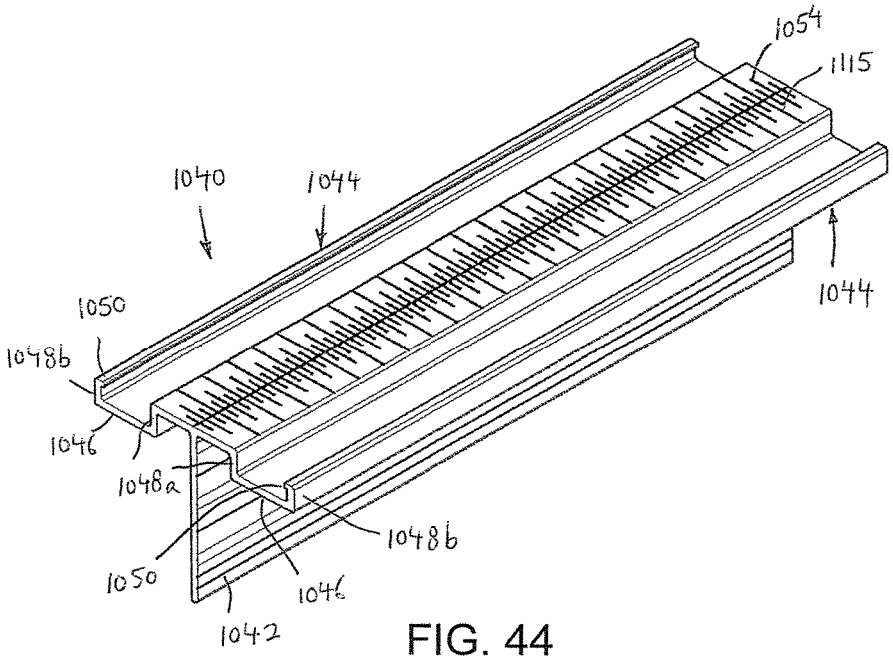
FIG. 44 is a perspective view of a modified adjustment support member according to another embodiment of the present invention.
Figure 45:
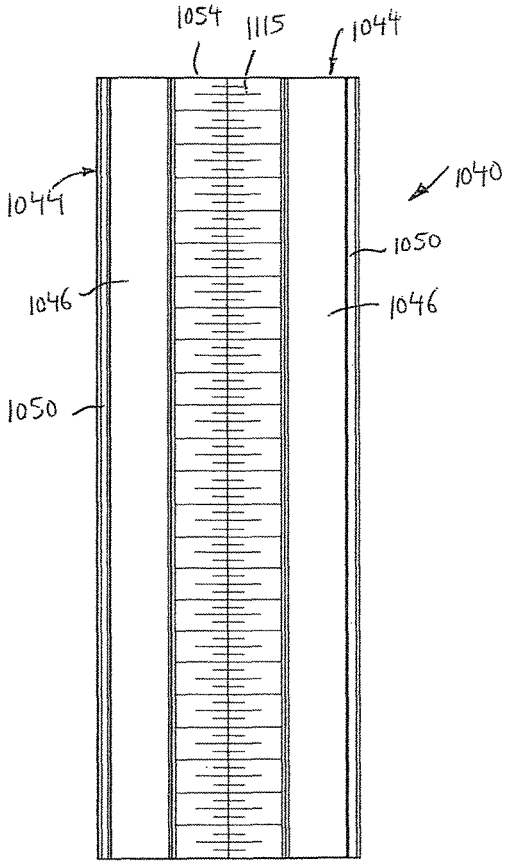
FIG. 45 is a top plan view of the modified adjustment support member of FIG. 44.
Figure 46:
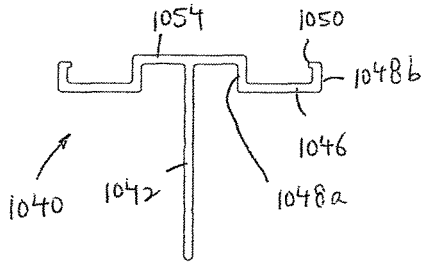
FIG. 46 is an end elevational view of the modified adjustment support member of FIG. 44.

Referring now to FIGS. 44-46, there is shown a modified adjustment support member 1040 which includes an elongated rectangular plate 1042 that is dimensioned to fit snugly between capture walls 30 and 32, such that retaining lip 30*a* applies pressure to plate 1042. As with adjustment support member 40, it will be appreciated that plate 1042 can be moved in the first lengthwise direction, as well as the third direction which is orthogonal to the first lengthwise direction and second transverse direction, and once positioned at the desired location, is secured in that position by screws extending through at least one of slots 34, 36 and openings 38. Although there are no fixed openings in plate 1042, the screws can still pass therethrough. Alternatively, openings can also be provided in plate 1042. Further, at any time, the screws can be loosened, plate 1042 is then adjusted in position and the screws are retightened. Alternatively, it will be appreciated that slots 34, 36 and openings 38 can be provided in plate 1042 instead of, or in addition to, capture walls 30 and 32.

The upper edge of plate 1042 is connected centrally in the lengthwise direction thereof to the underside of an elongated rectangular platform wall 1054. Measuring markings or gradations 1115 are provided on the upper surface of elongated rectangular platform wall 1054. Two U-shaped tracks 1044 are provided, each track 1044 connected to one lengthwise end edge of platform wall 1054. Each U-shaped track 1044 includes elongated, parallel, spaced apart walls 1048*a* and 1048*b* connected together by an elongated lower plate 1046. Specifically, the upper edge of each wall 1048*a* is connected to a respective lengthwise end edge of platform wall 1054, and extends downwardly therefrom, in parallel, spaced apart relation to plate 1042. Accordingly, lower plates 1046 are parallel to platform wall 1054, but positioned lower relative thereto. An elongated, inwardly turned lip 1050 extends inwardly from the upper edge of each wall 1048*b*.

Measuring markings or gradations can also be provided anywhere on any wall of U-shaped tracks 1044.

Figure 47:
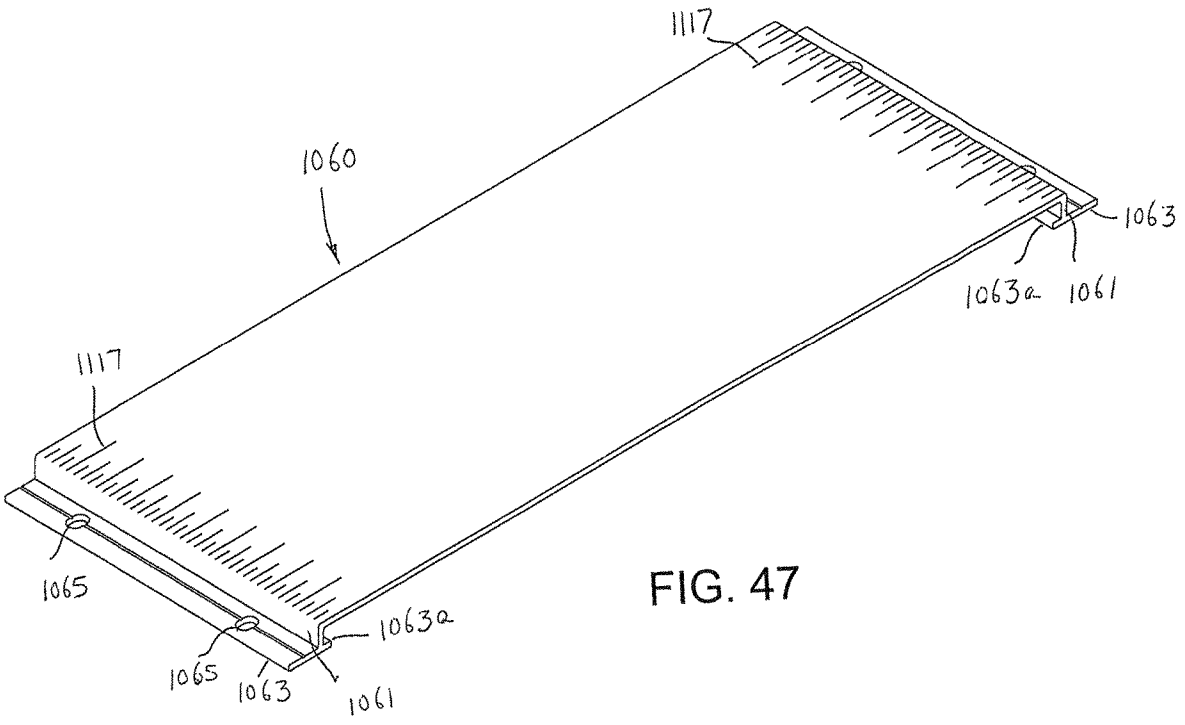
FIG. 47 is a perspective view of a modified connecting panel for use with the modified adjustment support member of FIG. 44.
Figure 48:
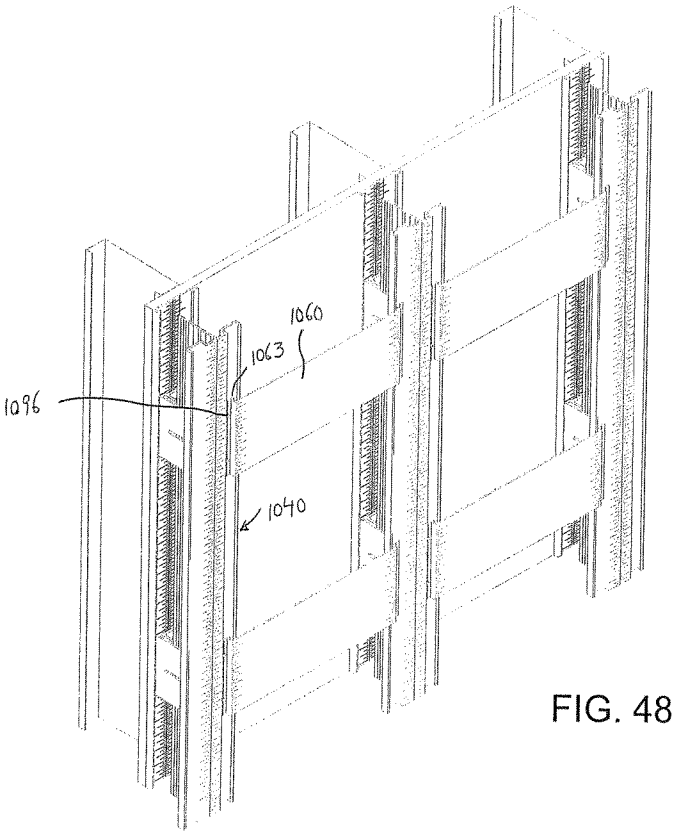
FIG. 48 is a perspective view showing assembly of modified connecting panels of FIG. 47 with modified adjustment support members of FIG. 44.

As shown in FIGS. 47 and 48, connecting panels 1060 are provided with short downwardly turned walls 1061 at opposite end edges thereof. Rectangular slide walls 1063 are connected to the free ends of downwardly turned walls 1061. Preferably, the free end of each downwardly turned wall 1061 is connected to a respective slide wall 1063 at a position about one-fourth of the distance from the inner edge 1063*a* of each slide wall 1063. The portion of each slide wall 1063 to the outside of the respective downwardly turned wall 1061 is provided with elongated openings 1065, each having its longer axis extending in the widthwise direction of each slide wall 1063. Further, measuring markings or gradations 1117 are provided at the opposite ends of connecting panel 1060, adjacent downwardly turned walls 1061.

With this arrangement, it becomes much easier to assemble connecting panels 1060 with modified adjustment support members 1040, while enabling adjustment of each connecting panel 1060 relative to modified adjustment support member 1040 in two orthogonal directions. Specifically, it is only necessary to lay each slide wall 1063 in a respective U-shaped track 1044, with slide wall 1063 seating on elongated lower plate 1046 thereof, rather than sliding into the connecting panel as with prior embodiments. In this position, measuring markings or gradations 1115 and 1117 are adjacent each other, so that connecting panel 1060 can be accurately positioned in the lengthwise direction of modified adjustment support member 1040. Then, screws 1096 (FIG. 48) are inserted through elongated slots 1065 into lower plate 1046, but not finally tightened. It will be appreciated that inwardly turned lip 1050 aids in preventing escape of slide walls 1063 during this procedure. The connecting panel 1060 is then adjusted in the widthwise direction by reason of elongated slots 1065, and screws 1096 are fully tightened to secure the connecting panel 1060 in position. Further, screws 1096 can be loosened and connecting panels 1060 can be adjusted in position, for example, to allow adjustment for expansion and contraction of materials. Also, with this arrangement, connecting panels 1060 can be removed at any time and replaced, whereas in prior embodiments where there is a sliding in arrangement, this cannot occur.

Figure 49:
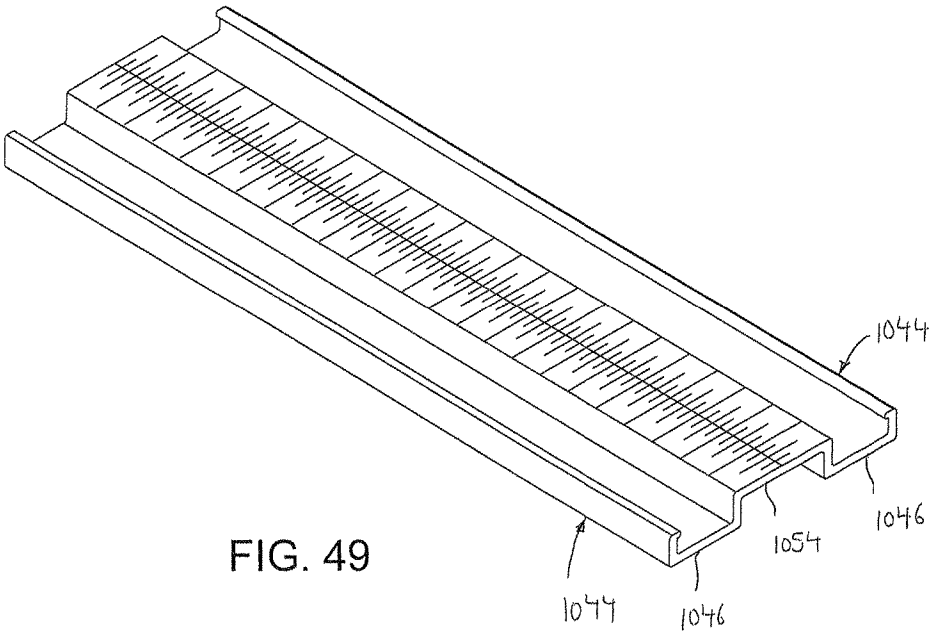
FIG. 49 is a perspective view of a modified adjustment support member according to another embodiment of the present invention.

Of course, as shown in FIG. 49, it will be appreciated that elongated rectangular plate 1042 can be eliminated, with lower plates 1046 and/or rectangular platform wall 1054 secured directly to an existing wall, in a similar manner as discussed above with respect to FIGS. 28 and 29.

Figure 50:
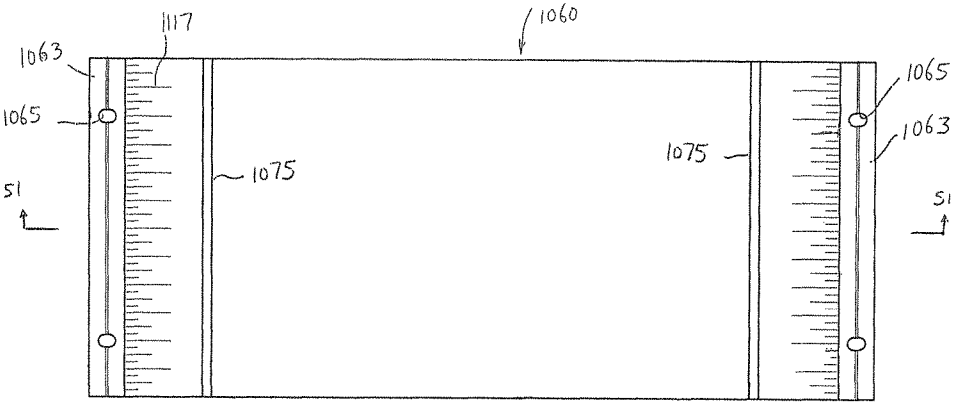
FIG. 50 is a top plan view of a modified connecting panel according to another embodiment of the present invention.
Figure 51:
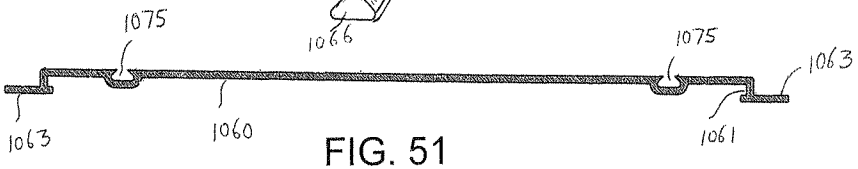
FIG. 51 is a cross-sectional view of the connecting panel of FIG. 50, taken along line 51-51 thereof.
Figure 53:
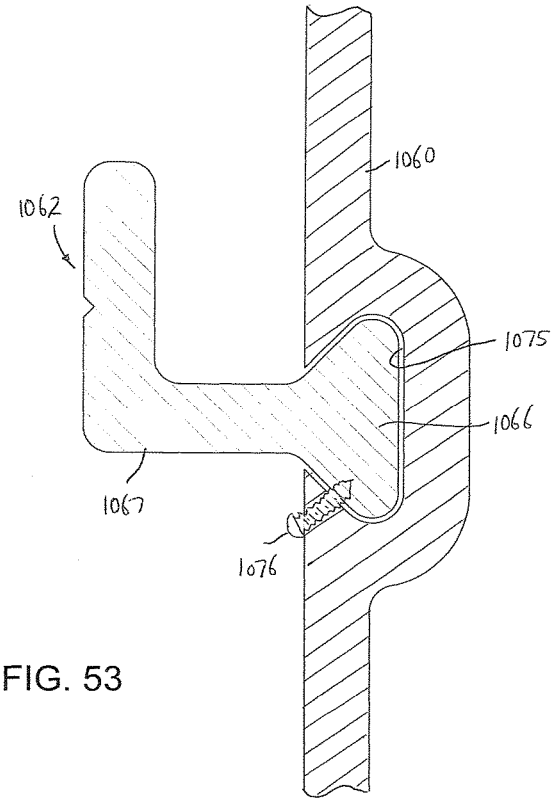
FIG. 53 is an enlarged cross-sectional view showing the hook assembled in a slot of the modified connecting panel of FIG. 50.

It will be appreciated that, preferably, connecting panels 1060 are provided with dovetail shaped slots 1075 extending transversely across the upper surface thereof in the widthwise direction thereof, as shown in FIGS. 50, 51 and 53.

Figure 52:
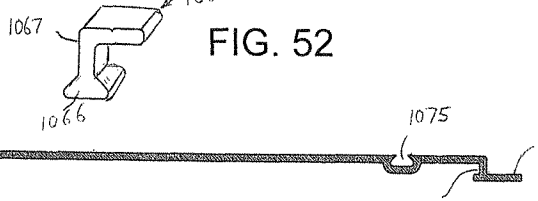
FIG. 52 is a perspective view of a hook for use with the modified connecting panel of FIG. 50.

Thus, in accordance with another embodiment of the present invention, as shown in FIGS. 52 and 53, hooks 1062 are slidably inserted into slots 1075. As shown, each hook 1062 includes a dovetail shaped base 1066, with an L-shaped wall 1067 extending outwardly from dovetail shaped base 1066. Once a hook 1062 is slid into a slot 1075 at a desired location, it can be fixed in place by any suitable means. For example, screws (not shown) can be screwed into slots 1075 on opposite sides of the slid-in hook 1062. Alternatively, as shown in FIG. 53, screws 1076 can be screwed through the upper surface of connecting panel 1060 adjacent a slot 1075 and into dovetail shaped base 1066. Still further, screws (not shown) can be screwed through the undersurface of connecting panel 1060 into dovetail shaped base 1066. As a further alternative, stops (not shown) can be inserted into slots 1075 on opposite sides of hooks 1062 to temporarily hold hooks 1062 in position until they are secured in position by screws.

With this arrangement, similar brackets or hooks would be mounted on the rear surface of each planar wall panel for mounting the wall panel on hooks 1062 in the manner discussed above with respect to FIG. 39. For example, complementary hook assemblies 900 (FIGS. 40-42) can be secured to the rear surface of a planar wall panel for connection with hooks 1062 in order to hang the wall panels on hooks 1062.

As a further alternative, short downwardly turned walls 1061 and rectangular slide walls 1063 can be eliminated. In such case, the lengthwise side edges of connecting panel 1060 to the outside of slots 1075 would slide into elongated gap 56 of adjustment support member 40, in the manner described with the previous embodiments.

It will be appreciated that, with the above embodiments, slots 1075 need not be dovetail shaped. For example, they can have any bulbous cross-sectional shape, such as circular, T-shaped, triangular, etc., and in such case, bases 1066 would have complementary shapes.

Figure 54:
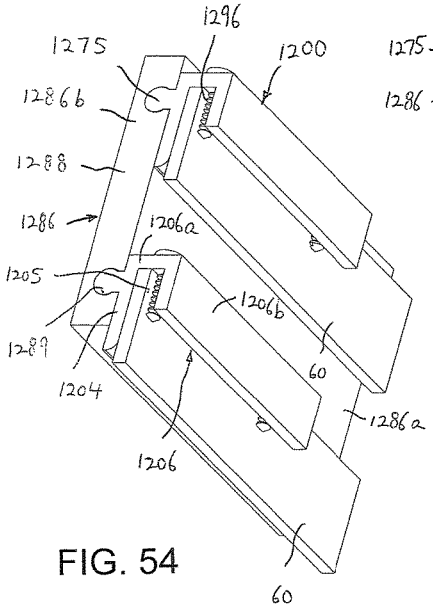
FIG. 54 is a perspective view of a wall panel having hook assemblies mounted thereto and hung on connecting panels.
Figure 55:
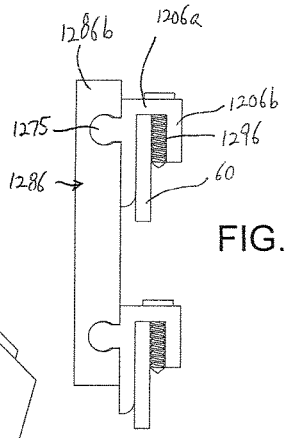
FIG. 55 is a side elevational view of the arrangement of FIG. 54.
Figure 56:
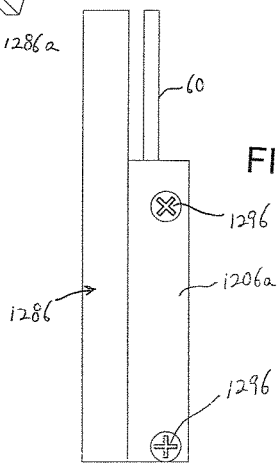
FIG. 56 is a top plan view of the arrangement of FIG. 54.

Referring now to FIGS. 54-56, a wall panel 1286 having only an outer exposed panel section 1288, that is, with the inwardly extending L-shaped connecting walls eliminated, includes elongated transverse cylindrical grooves 1289 therein which open to the rear surface 1286*a* of wall panel 1286 and to at least one side edge 1286*b* thereof, and preferably to both side edges thereof.

Hook assemblies 1200 are mounted to the rear surface of wall panel 1286. Specifically, each hook assembly 1200 includes an elongated rectangular wall 1204 that lies flush against the rear surface 1286*a* of wall panel 1286. The lower surface of elongated rectangular wall 1204 includes an elongated cylindrical projection 1275 that fits within elongated transverse cylindrical grooves 1289 so as to secure hook assemblies 1200 to the rear of wall panels 1286. An L-shaped hook wall 1206 extends rearwardly from one free lengthwise edge of elongated rectangular wall 1204 so as to define an open area 1205 between elongated rectangular wall 1204 and L-shaped hook wall 1206. L-shaped hook wall 1206 includes a first wall 1206*a* that extends rearwardly from the free lengthwise edge of elongated rectangular wall 1204 and a second wall 1206*b* that extends in parallel, spaced apart relation to elongated rectangular wall 1204.

With this arrangement, L-shaped hook walls 1206 are shown positioned over connecting panels 60 in order to hang wall panels 1286 thereon. In order to lock wall panels 1286 thereon, screws 1296 are screwed through first wall 1206*a* to a position between second wall 1206*b* and connecting panel 60 positioned in open area 1205 in order to wedge lock wall panels 1286 to hook assemblies 1200.

It will be appreciated that, although projections 1275 have been described as cylindrical, the present invention is not limited thereto, and any other suitable cross-sectional shape can be used, such as dovetail shaped, T-shaped, triangular, etc.

Further, although hook assemblies 1200 have been described as hanging directly from connecting panels 60, they can also hang from hooks or brackets of the type previously described, which are mounted to connecting panels 60.

Referring now to FIGS. 57-60, a modification of the arrangement of FIGS. 54-56 is shown.

Specifically, elongated cylindrical projections 1275 and elongated transverse cylindrical grooves 1289 are eliminated. Instead, elongated rectangular wall 1204 is provided with countersunk openings 1204*a* for receiving screws 1276 therein in order to secure the hook assembly 1200 to the rear surface of wall panel 1286. In such case, the upper surface of the head of each screw 1276 is flush with the outer surface of elongated rectangular wall 1204.

In addition, adjustment screws 1297 are screwed through first wall 1206*a* to a position onto the top surface of the connecting panel 60 but merely function to adjust the vertical position of hook assemblies 1200, and thereby, of wall panels 1286, relative to connecting panels 60. Thereafter, securing screws 1296 are screwed into position to wedge lock the wall panel 1286 to the connecting panel 60 in the manner described in the previous embodiment.

Alternatively, in place of countersunk openings 1204*a*, screws 1276 can just be screwed into the front surface of wall panel 1286 into elongated rectangular wall 1204 to secure the two together.

Referring now to FIGS. 61-64, there is shown another embodiment for securing walls panels to an existing wall. Specifically, each wall panel 1386 includes two elongated transverse dovetail shaped grooves 1389 therein which open to the rear surface 1386*a* of wall panel 1386 and to one side edge 1386*b* thereof, and extends for about one-quarter of the width of wall panel 1386.

Connecting panel 1360 is bent to form two parallel, spaced apart, dovetail shaped bent wall sections 1361. The spacing between dovetail shaped bent wall sections 1361 is the same as the spacing between transverse dovetail shaped grooves 1389 so that, when wall panel 1386 is positioned against connecting panel 1360, dovetail shaped bent wall sections 1361 align and open up to transverse dovetail shaped grooves 1389.

With this arrangement, a locking bar 1391 is slid into dovetail shaped bent wall sections 1361 and transverse dovetail shaped grooves 1389, to secure wall panel 1386 to connecting panel 1360. In this regard, locking bar 1391 has a generally hourglass shaped cross-section with a first dovetail shaped section 1391*a* for fitting within transverse dovetail shaped grooves 1389, and a second connected dovetail shaped section 1391*b* for fitting within dovetail shaped bent wall sections 1361. Screws 1393 are then screwed through dovetail shaped bent wall sections 1361 and locking bar 1391 to lock these elements in place relative to each other. Preferably, locking bar 1391 is made of a material, such as polyamide, that is not thermally conductive, that is, that does not transfer heat and cold between the wall panel and the connecting panel.

Of course, it will be appreciated that connecting panels 1360 are connected at their ends to adjustment support members in any of the arrangements previously described, and which is not shown herein.

Further, although grooves 1389 and bent wall sections 1361 have been described as being dovetail shaped, the present invention is not limited thereto, and any other suitable cross-sectional shape can be provided, for example, circular, T-shaped, triangular, etc. Rather, it is only important that a width of each locking bar 1391 at a connecting area between first section 1391*a* and second section 1391*b* be of a lesser dimension than at other areas of portions of first section 1391*a* and second section 1391*b*.

For assembly purposes, wall panel 1386 can be positioned with connecting panel 1360, and then locking bar 1391 is slid into dovetail shaped bent wall sections 1361 and transverse dovetail shaped grooves 1389. Alternatively, first dovetail shaped sections 1391*a* of locking bars 1391 are slid into transverse dovetail shaped grooves 1389, and then dovetail shaped bent wall sections 1361 are slid onto second dovetail shaped sections 1391*b* of locking bars 1391. As a further alternative, second dovetail shaped sections 1391*b* of locking bars 1391 are slid into dovetail shaped bent wall sections 1361, and then, transverse dovetail shaped grooves 1389 are slid onto first dovetail shaped sections 1391*a* of locking bars 1391.

Figure 61:
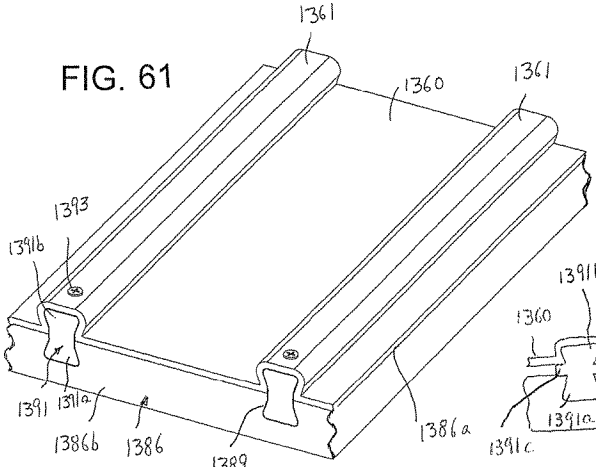
FIG. 61 is a perspective view of a further embodiment of the present invention for securing the wall panels to the connecting panels.
Figure 64:
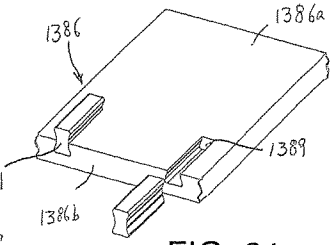
FIG. 64 is a perspective view of the further embodiment of FIG. 61, with the connecting panel removed.
Figure 61A:
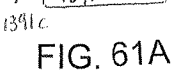
FIG. 61A is a side elevational view of a modification of the embodiment of FIG. 61.
Figure 67:
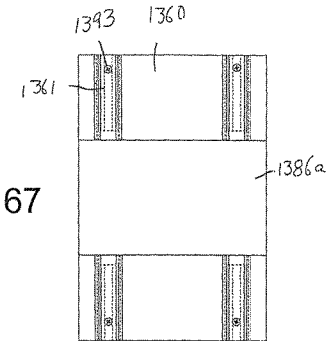
FIG. 67 is a top plan view of the further embodiment of FIG. 66.
Figure 68:
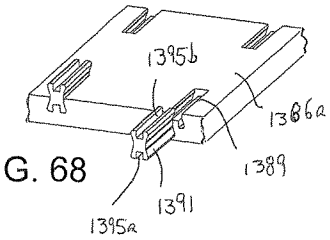
FIG. 68 is a perspective view of the further embodiment of FIG. 66, with the connecting panel removed.
Figure 66:
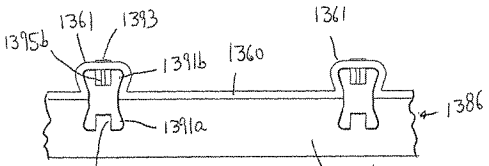
FIG. 66 is a side elevational view of the further embodiment of FIG. 66.

A further modification is shown in FIG. 61A in which first dovetail shaped sections 1391*a* and second dovetail shaped sections 1391*b* are connected together by a spacer section 1391*c* to separate connecting panel 1360 from wall panel. 1386 by an air gap therebetween. Again, in such case, locking bars 1391 are made of a thermally isolated material such as polyamide, an equivalent thereof or any other suitable material.

FIGS. 65-68 show a modification of the further embodiment of FIG. 61. Specifically, a parallel, spaced apart pair of transverse dovetail shaped grooves 1389 is provided on each side of wall panel 1386, and two narrower, spaced apart connecting panels 1360 are mounted thereto in the manner described above.

Further, the free lower surface of each first dovetail shaped section 1391*a* of locking bar 1391 is provided with an elongated recess 1395*a* therein, and the free upper surface of each second dovetail shaped section 1391*b* of locking bar 1391 is provided with an elongated recess 1395*b* therein. Therefore, locking bar 1391 has an essentially H-shape in cross-section. This enables screws 1393 to more easily be screwed through locking bar 1391 into wall panel 1386 before being assembled with connecting panels 1360.

Figure 65:
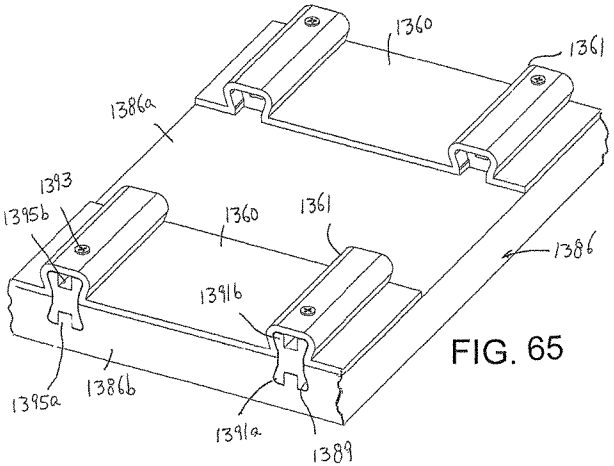
FIG. 65 is a perspective view of a modification of the further embodiment of FIG. 61.
Figure 71:
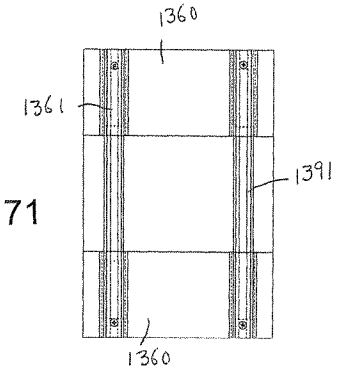
FIG. 71 is a top plan view of the further embodiment of FIG. 69.
Figure 72:
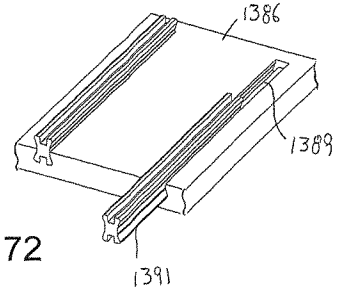
FIG. 72 is a perspective view of the further embodiment of FIG. 69, with the connecting panel removed.
Figure 70:
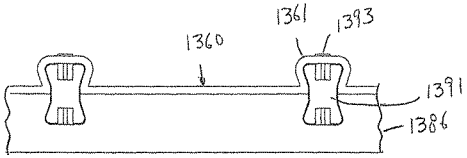
FIG. 70 is a side elevational view of the further embodiment of FIG. 69.
Figure 69:
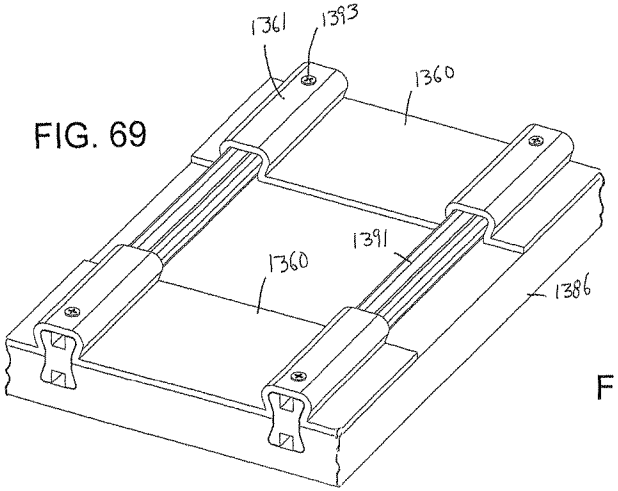
FIG. 69 is a perspective view of a modification of the further embodiment of FIG. 65.

FIGS. 69-72 show a modification of the further embodiment of FIG. 65. Specifically, there is only one pair of parallel, spaced apart transverse dovetail shaped grooves 1389, but they extend almost the entire width of wall panel 1386, and the length of locking bars 1391 is thereby also increased accordingly.

Figure 73:
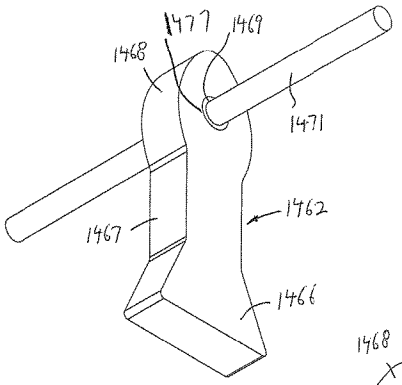
FIG. 73 is a perspective view of a hanging member that can be used to assembly a wall panel with a connecting panel.
Figure 75:
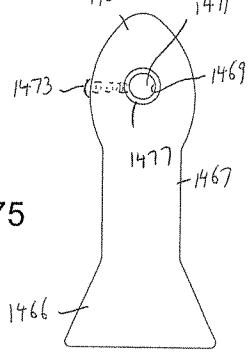
FIG. 75 is a front elevational view of the hanging member of FIG. 73.
Figure 74:
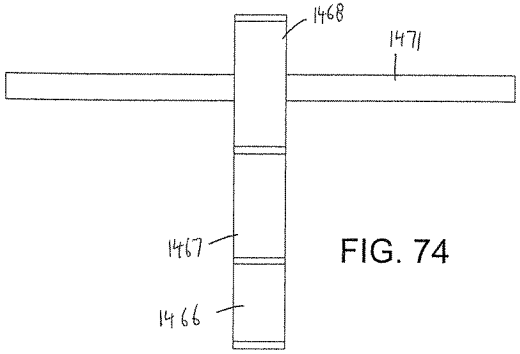
FIG. 74 is a side elevational view of the hanging member of FIG. 73.
Figure 76:
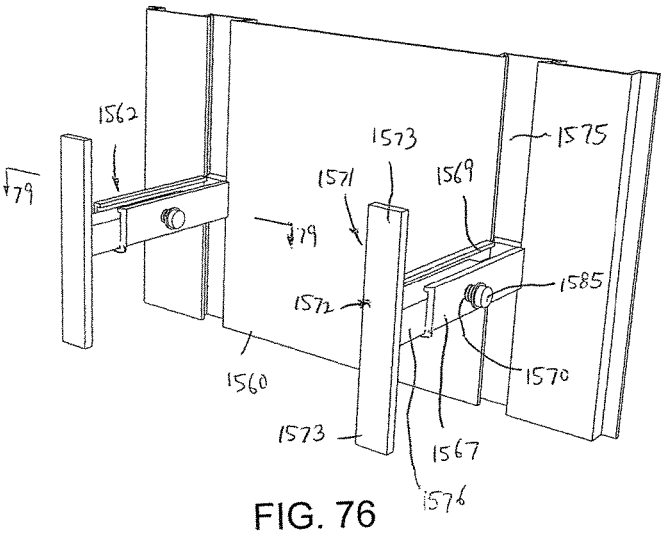
FIG. 76 is a perspective view of a hanging member that can be used to assembly a wall panel with a connecting panel.
Figure 77:
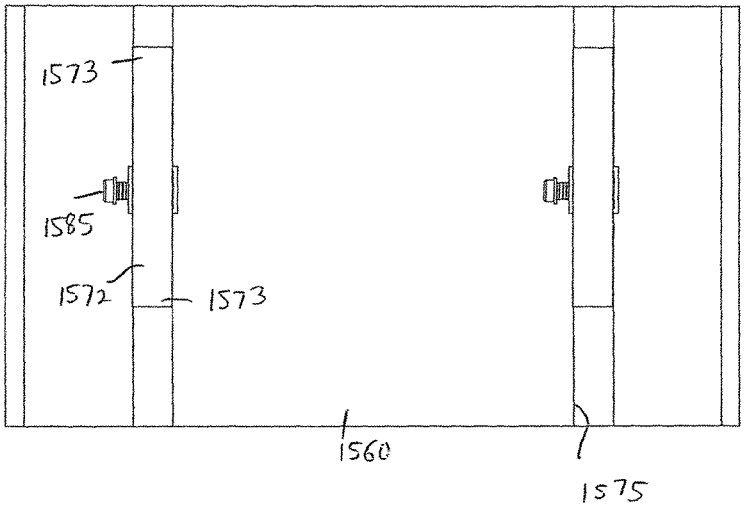
FIG. 77 is a top plan view of the hanging member of FIG. 76.
Figure 78:
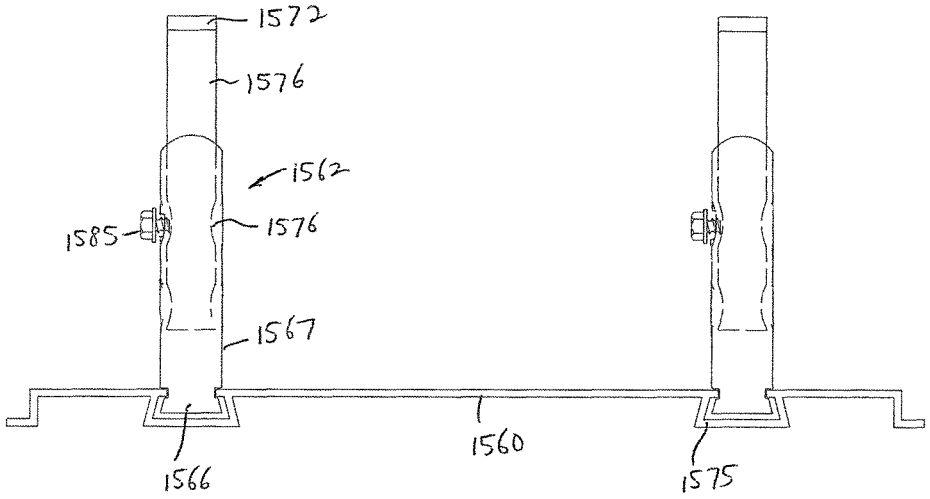
FIG. 78 is a side elevational view of the hanging member of FIG. 76.
Figure 79:
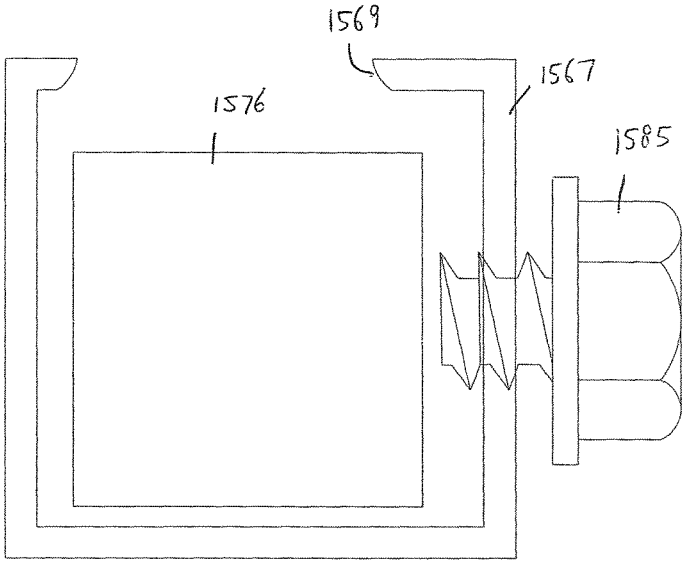
FIG. 79 is a cross-sectional view of FIG. 76, taken along line 79-79 thereof.
Figure 80:
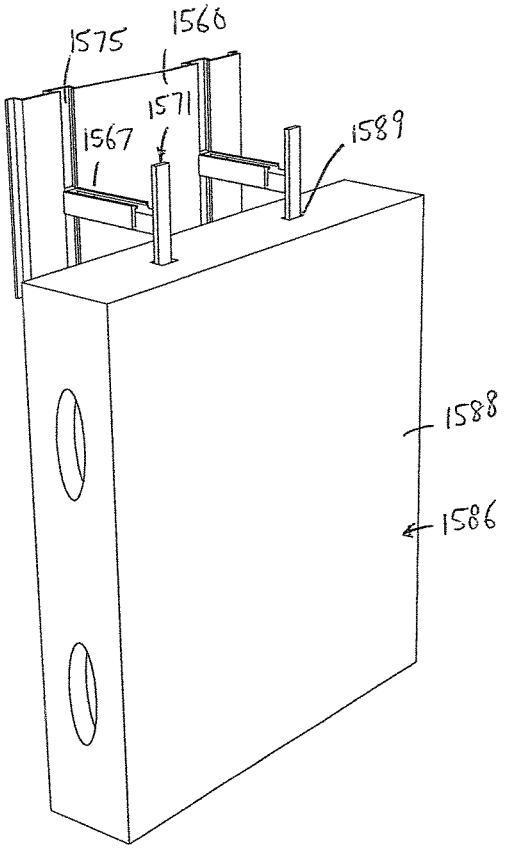
FIG. 80 is a perspective view of the hanging member of FIG. 76 assembled with a wall panel.

Referring now to FIGS. 73-75, there is shown another embodiment for securing walls panels to an existing wall. Specifically, in place of hooks 1062, hanging members 1462 are provided. Each hanging member 1462 includes a dovetail shaped base 1466, which continues outwardly with a center rectangular extension wall section 1467 and terminating at a bulbous extension wall section 1468, having a through opening 1469 extending therethrough.

With this embodiment, dovetail shaped base 1466 is slid into a slot 1075 of a connecting panel 1060 to a desired location, and it can be fixed in place by any suitable means, for example, as previously described relative to hooks 1062. A rod 1471 is then inserted through opening 1469. Rod 1471 can be secured in position by any suitable means. For example, each opening 1469 can have a rubber grommet 1477 to hold rod 1471. Alternatively, a tightening set screw 1473 extends through bulbous wall section 1468, as shown in FIG. 75.

Figure 57:
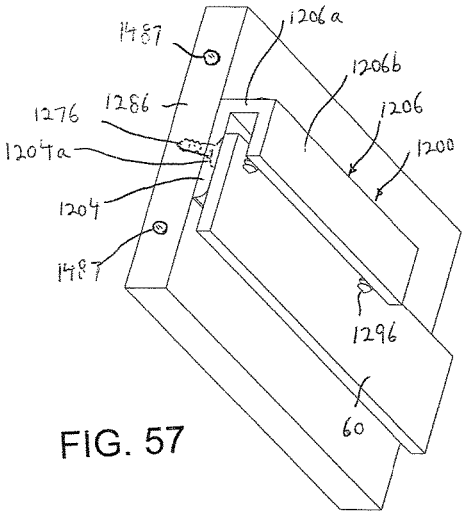
FIG. 57 is a perspective view of a wall panel having modified hook assemblies mounted thereto and hung on connecting panels.
Figure 58:
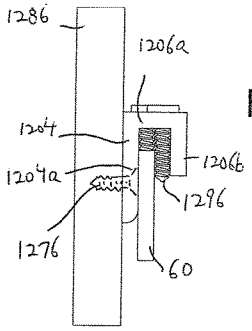
FIG. 58 is a side elevational view of the arrangement of FIG. 57.
Figure 59:
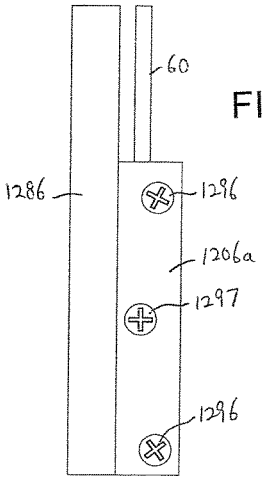
FIG. 59 is a top plan view of the arrangement of FIG. 57.
Figure 60:
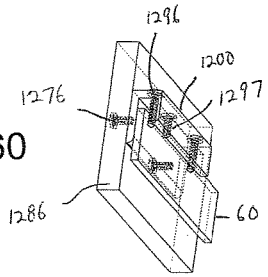
FIG. 60 is a perspective view of the arrangement of FIG. 57, showing a modification of securement of the hook assembly to the wall panel.
Figure 63:
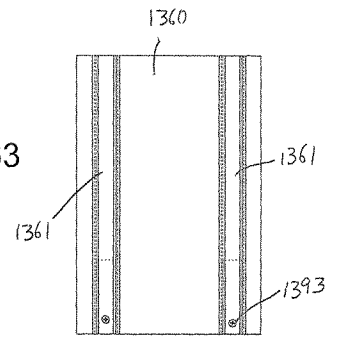
FIG. 63 is a top plan view of the further embodiment of FIG. 61.
Figure 62:
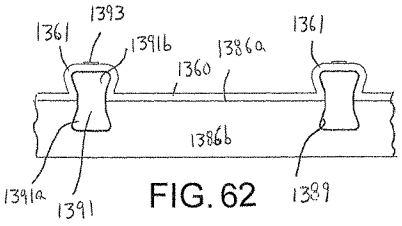
FIG. 62 is a side elevational view of the further embodiment of FIG. 61.

With this embodiment, the wall panels would have through openings 1487 therethrough, as shown in wall panels 1286 in FIG. 57, through which rods 1471 would extend for mounting the wall panels. Of course, set screws can extend through the wall panels for securing the rods 1471 therein.

Referring now to FIGS. 76-80, there is shown another embodiment for securing walls panels to an existing wall. Specifically, in place of hanging members 1462, hanging members 1562 are provided. Each hanging member 1562 includes a dovetail shaped base 1566, which continues outwardly with a peripheral rectangular wall housing 1567. An elongated slot 1569 is provide along the length of rectangular wall 1567 at one side, although this is not required by the present invention. Further, a threaded opening 1570 is provided in one side of rectangular wall 1567.

A T-shaped securing member 1571 is provided and includes a rectangular slide member 1576 slidably positioned within rectangular wall 1567, and a rectangular securing plate 1572 mounted centrally to the free end of rectangular slide member 1576 so as to define tabs 1573 extending to opposite sides of rectangular slide member 1576. Rectangular slide member 1576 can be selectively secured at a desired height within rectangular wall 1567 by adjusting the position of rectangular slide member 1576 therein, and then securing the position by a bolt or screw 1585 extending through threaded opening 1570 into engagement with a side of rectangular slide member 1576. To aid in such securement, rectangular slide member 1576 preferably has a plurality of spaced depressions 1576*a* along the length thereof.

Each wall panel 1586 is formed from a single panel member 1588 having slots 1589 at opposite side edges thereof. As a result, with dovetail shaped bases 1566 secured in dovetail shaped slots 1575 of a connecting panel 1560, and with the height of rectangular slide member 1576 adjusted and secured in rectangular wall 1567, tabs 1573 are inserted within slots 1589.

Figure 81:
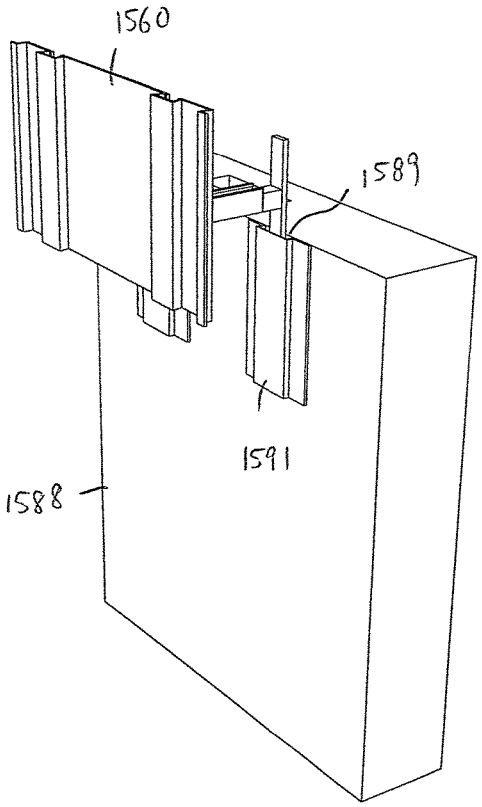
FIG. 81 is a perspective view of the hanging member of FIG. 76 assembled with a wall panel having a bracket.

Alternatively, as shown in FIG. 81, instead of slots 1589 in single panel member 1588, U-shaped brackets 1591 can be secured to the rear surface of single panel member 1588 to create slots 1589.

It will be appreciated that slots 1575 can be oriented vertically, and in such case, a bottom wall panel 1586 is first provided, following by tabs 1573 inserted into slots 1589 in the upper facing edge of bottom wall panel 1586. Then, another wall panel 1586 is positioned to receive the opposite facing tabs 1573 in slots 158 in the lower facing edge of the next wall panel 1586, and so on. Alternatively, slots 1575 can be positioned horizontally, and the same process is performed horizontally.

It will be appreciated that slots 1575 need not be dovetail shaped. For example, they can have any bulbous cross-sectional shape, such as circular, T-shaped, triangular, etc., and in such case, bases 1566 would have complementary shapes.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall, comprising:

a plurality of adjustment support members adapted to be secured one of:

directly to an existing wall, and indirectly to the existing wall through intermediary members;

a plurality of connecting panels for connecting together spaced apart adjustment support members, with said connecting panels supporting wall panels thereon;

wherein each said adjustment support member includes at least one U-shaped track extending along at least one side edge thereof, each U-shaped track including an upper exposed surface arranged parallel to the existing wall when a respective said adjustment support member is secured to the existing wall and first and second end walls extending at an angle from opposite sides of the upper exposed surface so as to define a channel therebetween, the first and second end walls extending in a first lengthwise direction and spaced apart from each other in a second transverse direction; and wherein each connecting panel includes a main panel wall, a first slide wall extending from one side edge of the main panel wall and a second slide wall extending from an opposite side edge of the main panel wall, with said first and second slide walls of each connecting panel adapted to be positioned in respective said channels of two different adjustment support members which are spaced apart in said second transverse direction for sliding movement therein in said first lengthwise direction.

2. A system according to claim 1, wherein each slide wall is positioned in the channel for sliding movement in two orthogonal directions therein.

3. A system according to claim 1, wherein each slide wall includes at least one opening for insertion of a fastening member therethrough into the upper exposed surface to secure the connecting panel thereof to a respective said adjustment support member.

4. A system according to claim 3, wherein each opening is elongated to permit adjustment of each slide wall in a respective said channel.

5. A system according to claim 1, wherein:

each adjustment support member includes measuring markings adjacent side edges thereof, and each main panel wall includes measuring markings adjacent side edges thereof for alignment with the measuring markings of each adjustment support member.

6. A system according to claim 1, wherein each adjustment support member includes a central plate and two said U-shaped tracks, each extending from an opposite side edge of the central plate.

7. A system according to claim 6, wherein an upper end of the first end wall of each U-shaped track is connected to a respective said side edge of the central plate, such that each upper exposed surface is positioned in parallel offset relation to the central plate.

8. A system according to claim 7, wherein each adjustment support member further includes an adjustment plate having an upper edge connected centrally to a lower surface of the central plate, for securement to an intermediary member.

9. A system according to claim 1, wherein each second end wall includes an inturned lip extending therealong.

10. A system according to claim 1, wherein positioning of each slide wall on the upper exposed surface of a respective U-shaped track is in a flush face to face arrangement.

11. A system according to claim 1, wherein each connecting panel includes at least one slot therein, and further comprising at least one hook member slidably mounted in the at least one slot and adapted to hang a respective said wall panel thereon.

12. A system according to claim 11, wherein each hook member includes:

a securing base adapted to be slidably held in a respective said slot, and a hook connected with the base; and each wall panel includes a bracket for engaging with the hook to support the wall panel in a hanging manner thereon.

13. A system according to claim 1, wherein each wall panel includes at least one hook member on a rear surface thereof for hooking over at least one connecting panel to hang the wall panel thereon, each hook member including a substantial portion thereof secured to said rear surface at a position spaced inwardly from an edge of the wall panel.

14. A system according to claim 13, wherein each hook member includes a securing arrangement for securing each wall panel to the at least one connecting panel at a desired position.

15. A system according to claim 14, wherein each hook member defines a channel therein for receiving a respective said connecting panel, and said securement arrangement includes a member for wedge locking said connecting panel in the channel.

16. A system according to claim 15, wherein each hook member includes an adjustment arrangement for engaging an edge of the connecting panel to adjust a position of the connecting panel in the channel prior to wedge locking the connecting panel in the channel.

17. A system according to claim 16, wherein:

said wedge locking arrangement includes at least one screw positioned between a surface of the connecting panel and the hook member, and said adjustment arrangement includes at least one biasing screw for engaging the edge of the connecting panel to adjust a position of the connecting panel in the channel.

18. A system according to claim 1, wherein each connecting panel includes at least one slot therein;

wherein each wall panel includes at least one slot therein for alignment with the at least one slot of each connecting panel when the connecting panel and wall panel are positioned adjacent each other; and further comprising at least one locking bar for engaging within the at least one slot in both the connecting panel and the wall panel to support the wall panel on the connecting panel.

19. A system according to claim 18, wherein each locking bar has a first section for securement within one said slot of the wall panel, and a second section for securement within one said slot of the connecting panel.

20. A system according to claim 19, wherein a width of each locking bar at a connecting area between the first end and second sections thereof is of a lesser dimension than at portions of the first end and second sections spaced from the connecting area.

21. A system according to claim 20, where each of the first and second sections have a cross-sectional shape selected from one of the following shapes:

dovetail shaped,
circular shaped,
T-shaped, and
triangular shaped.

22. A system according to claim 19, wherein at least one of the first and second sections has a recess for receiving a fastening member therethrough.

23. A system according to claim 18, wherein each locking bar is made of a thermally insulating material, and includes a spacer section to separate the wall panel from the connecting panel by a gap.

24. A system according to claim 1, wherein each connecting panel includes at least one slot therein; and at least one securing member slidably mounted in the at least one slot to support a wall panel on the connecting panel, wherein each securing member includes:

a securing base adapted to be slidably held in a respective said slot, an extension wall extending from said base, and a rod extending through said extension wall for engagement within an opening in a wall panel.

25. A system according to claim 1, wherein each connecting panel includes at least one slot therein; and at least one securing member slidably mounted in the at least one slot to support a wall panel on the connecting panel, wherein each securing member includes:

a securing base adapted to be slidably held in a respective said slot, a housing extending outwardly from the securing base, a slide member slidably received in the housing, a securing arrangement for locking the slide member at a desired location within said housing, and at least one tab extending from the slide member for insertion within a respective opening in a wall panel to secure the wall panel to the securing member.

26. A system according to claim 25, wherein the slide member includes a plurality of spaced apart recesses for receiving the securing arrangement.

27. A system according to claim 25, wherein the securing base has a cross-sectional shape selected from one of the following shapes:

dovetail shaped,
circular shaped,
T-shaped, and
triangular shaped.

* * * * *